US005927037A

United States Patent [19]

Kinsella

[11] Patent Number: 5,927,037

[45] **Date of Patent: *Jul. 27, 1999**

[54] CONSTRUCTION OF SUSPENDED CEILINGS, WALLS, AND PARTITION WALLS

[75] Inventor: Thomas Kinsella, Bray, Ireland

[73] Assignee: T & T Fixings Limited, Wicklow, Ireland

[ * ] Notice: This patent is subject to a terminal disclaimer.

[21] Appl. No.: 09/036,802

[22] Filed: Mar. 9, 1998

Related U.S. Application Data

[63] Continuation of application No. 08/424,296, Apr. 18, 1995.

[30] Foreign Application Priority Data

Oct. 19, 1992 [IE] Ireland ..... S922746
Dec. 23, 1992 [IE] Ireland ..... S922944

[51] Int. Cl.[6] ..... E04B 2/00

[52] U.S. Cl. ..... 52/506.05; 52/712

[58] Field of Search ..... 52/506.07, 506.01, 52/506.05, 712

[56] References Cited

U.S. PATENT DOCUMENTS 5,519,976 5/1996 Gee .

FOREIGN PATENT DOCUMENTS 3 205 706 A1 12/1982 Germany .
2 106 157 4/1983 United Kingdom .

*Primary Examiner*—Creighton Smith
*Attorney, Agent, or Firm*—Hoffmann & Baron, LLP

[57] ABSTRACT

A connector assembly including a support bar and a connector for holding a panel on the support bar having laterally extending flanges, used in the construction of suspended ceilings, walls and partition walls, the connector including a tongue member adapted to engage a panel, further including a wing member of flexible material is movable between an inoperable position and an in-use position in which the wing member is folded over onto a flange of the support bar thereby holding a panel in position on the support bar. The connectors in the various embodiments of the invention, can be manufactured from material such as stainless steel, light aloys and plastics material.

23 Claims, 81 Drawing Sheets

CONSTRUCTION OF SUSPENDED CEILINGS, WALLS, AND PARTITION WALLS

This is a continuation of application Ser. No. 08/424,296 filed on Apr. 18, 1995 allowed files.

The present invention relates to construction of suspended ceilings, walls and partition walls.

Where reference is made to a perimeter profile in this description, it is to be understood to mean a starting trim or a perimeter trim which are terms used by a skilled man in the art.

The term "plastically deformable" shall be construed to mean easily or readily plastically deformable i.e. by using the fingers and thumb of one's hand.

In the construction of suspended ceilings using un-plasticised polyvinyl chloride (UPVC) tongue and groove panels, wooden batons are screwed to a ceiling grid which comprises a network of T-bars interconnected by means of interlocking clips and tabs usually known in the art as noggins, the T-bars having slits for receipt of the noggins of transverse T-bars. Subsequently the ceiling panels are then stapled to the batons. A tongue and groove panel, for constructing a suspended ceiling or wall, has a tongue side and a groove side, the groove side having a flange through which the staple is punched thus securing the panel to the baton. Having secured a panel to the baton in this manner, the tongue side of a second panel is then inserted into the groove side of a first panel and the second panel is then stapled to a baton and so on until the ceiling or wall, as the case may be, has been constructed.

This prior art system has several disadvantages, one of which is that in constructing a ceiling or wall, the system is very costly because of the amount of material required and also because the operation itself is time consuming and laborious. A further disadvantage is that since the staples are punched only through the flange of the panel, this means of attachment is not secure in certain circumstances. Furthermore, in the event of one of the panels of a ceiling becoming damaged and falling off, the entire suspended ceiling has to be disassembled back as far as the nearest wall and then the broken panel is replaced and the other panels repositioned. Obviously this is quite a time consuming and labour intensive operation.

Furthermore, in constructing a ceiling or wall from panels, various types of profiles are used such as perimeter profiles, intermediate or centre join section profiles, external corner profiles, internal corner profiles and pliable joint profiles which are placed regularly at the joint between abutting panels.

Conventionally, a profile is affixed to a wall or timber baton by means of the flange on the profile being screwed or stapled onto the wall or baton. This type of fixing has the disadvantage that the weight of the entire trim is being carried by the screw or staple through the flange. Thus, this is not a very stable means of holding the profile in place.

When constructing a suspended ceiling, it is desirable to fix an angle trim to the existing wall structure so as to provide a base on which the interlocked noggins and T-bars comprising the ceiling grid, may sit. The prior art means of connecting an angle trim to a wall involves screwing the angle trim to the wall then screwing a piece of timber onto the angle trim and then attaching the perimeter profile to the timber by means of staples.

It is also known in the art that when connecting UPVC panels or such like to a wall, a timber lath is screwed onto the wall and then the UPVC panels are screwed or stapled to the timber lath. It is also understood and known in the prior art that T-bars cannot be used in the construction of walls from panels, thus timber laths, not T-bars, are used in order to affix UPVC panels to an existing wall structure. In the prior art, difficulty arises when one encounters pipework protruding from the existing wall. In this case one has to construct the panel wall out from the existing wall structure working around obstructions such as pipework is extremely laborious using the prior art materials and method.

In the construction of partition walls, H-shaped channels are used. These channels are supplied with an L-shaped bracket screwed to an end edge of the H-shaped channel. To construct a framework of H-shaped channels, the L-shaped bracket is used to attach two H-shaped channels together. An operator must try and align the end edge of one H-shaped channel with the longitudinal portion of a second H-shaped channel. In practice this proves to be an extremely difficult and time consuming task because the L-shaped bracket is often not suitably positioned so as to allow the edges of the two H-shaped channels to abut each other thereby providing a flush surface.

Therefore the prior art generally in the area of construction of suspended ceilings and walls and wall partitions involves time consuming and laborious operations which also requires a lot of materials such as screws or staples.

German Patent Specification No. DE 32 05 706 discloses a connecting element for an auxiliary wall structure such as a sunken ceiling structure, with carrier pieces fitted with a flange. The connecting element has bent tongues connected to its stem piece, for enabling the connector to be clamped onto a flange. The tongues of the connector extend opposite each other, at a distance apart which is equal to the width of the flange across the stem piece. The tongues are bendable around the flange. The specification also discloses a clamp for fitting the connecting element.

German Patent Specification No. DE 20 06 780 discloses a retaining element permitting insertion of elastically deformable lamellae, used for cladding walls or ceilings, from two, three or four sides, without difficulty, producing an intersection point for several lamellae, of the type running at an angle to wall or ceiling plane. This facilitates installation of grid-pattern cladding systems. The retaining element incorporates retainer surfaces, bent back at right angles from a top piece. Each has a retainer aperture into which a lamellae can be hung, inserted or snapped in position. There may be four angles to each other, and the top piece can also have fixing lips and a fixing hole.

Australian Patent Specification No. 24938/71 discloses a ceiling panel suspension device of the kind incorporating a main bearer comprising an upright suspension flange and at least one support flange, and a plurality of sub-bearers each comprising an upright web and at least one panel-resting flange which is able to rest on the support flange and upon which a marginal edge portion of a ceiling panel is able to rest. The suspension flange has a series of holes formed therein, each defining a pair of upstanding tongues which are integral with the main bearer and which can be bent over towards the support flange thereby to engage the web of the sub-bearer resting on the support flange, on either side of its web, and also bear downwardly on the panel-resting flange of the resting sub-bearer.

U.S. Pat. No. 2,822,584 discloses a supporting structure for kerfed wall construction units comprising an elongated spline member having a web normally positioned vertically in installed position, a first flange formed on one side of said web and adapted to cooperate with kerfed wall construction units, a second flange formed on said web and extending substantially perpendicular thereto and spaced from said first flange, a clip having a substantially flat body portion disposed normally vertically and parallel with said web, the lower side of said body portion having a first flange formed thereon disposed substantially perpendicular thereto. The edge of the first clip flange is disposed away from the body portion having a second flange formed thereon and extending below the first clip flange and toward the body portion, the clip flanges engaging the second spline flange, said second clip flange engaging the face of said second spline flange disposed toward the first spline flange being shorter than the second spline flange, a tab formed from the body portion and connected substantially at the junction of the body portion and the first clip flange. The tabs are bent over against the web in a direction away from the body portion to lock the clip flanges in engagement with the second spline flange, a channel having a horizontally disposed flange and a vertically disposed flange, an ear formed on the body portion and spaced therefrom to define a slot extending substantially parallel to the clip flanges. The horizontal channel flange extends into the slot and there is a lug attached to the body portion and spaced from the free end of the ear and bendable into a position contacting the face of the vertical channel flange disposed away from the horizontal channel flange to lock the clip on the channel.

The present invention seeks to alleviate the above disadvantages.

The present invention accordingly provides a connector for securing a panel to a support element for use in the construction of suspended ceilings, walls, partition walls and the like, the connector comprising a panel-connecting element and at least one wing member of plastically deformable material, the wing member being movable between an open position and an engaged position in which the wing member is folded over onto the support element thereby holding the panel in position on the support element characterized in that the panel-connecting element is formed of a plastically deformable material enabling the panel-connecting element to be bent so that it may be arranged out of the plane of body of the connector enabling the connector to be used for connecting two support elements together, for hanging an object, for affixing the panel-connecting element of the connector to an existing wall or ceiling structure, for stabilising panels around light fittings, for forming bulkheads, and/or for connecting a panel or the element in a different plane.

Advantageously, the panel-connecting element comprises a tongue member releasably engagable with the panel.

Preferably, when the wing member is in the engaged position, the connector Is movable along the support element to a desired location in order to allow construction of a suspended ceiling, wall or partition wall.

Conveniently, the material of the wing member is crimpable so as to allow the connector to be crimped securely in the engaged position on the support element.

Ideally, the connector is substantially T-shaped, with the panel-connecting element or tongue member approximating to the horizontal element of the "T" and the body of the connector approximating to the vertical element of the "T" with a wing member at each side of the body extending out of the plane of the "T".

Advantageously, each wing member includes a kink enabling the connector to be held on the support element in the open position.

Conveniently, the body of the connector includes an aperture for receiving a fastening element.

Preferably, the wing member is adapted to fold over a support element having a circular cross-sectional profile.

Advantageously, there is an angle other than 90° between the transverse axis of the tongue member and the longitudinal axis of the wing member thereby allowing for easy construction of an aesthetically pleasing arrangement of panels.

Conveniently, each wing member is folded into the engaged position and each wing member is adapted to enable the connector to be secured an the support element in a pivot-like locking action.

The present invention also provides a connector for securing a profile to a support element for use in construction of suspended ceilings, walls and partition walls and the like, the connector comprising a profile-connecting element and a wing member of plastically deformable material characterised in that the wing member is formed in the closed position, and the wing member is adapted to hold a profile in position on a support element and further characterised in that the wing member is folded over in a plane parallel to the principal axis of the body of the connector and the profile-connecting element is substantially perpendicular to the principal axis of the body and further characterised in that the length of the profile-connecting element is shorter than the length of the body so that it fits into space defined by walls of the profile into which the profile-connecting element is inserted.

Advantageously, the connector includes a detent formed in the body of the connector, the detent being adapted to engage in a groove formed in a support element such as an angle trim when the connector is in use, thereby securing the connector on the angle trim.

The present invention further provides a connector for supporting a length of panel, the connector having an orifice in a body of the connector defined by a panel-supporting element characterised in that the connector includes a wing member which is bent over to form a hook member for honking onto a support element, the length of panel being locatable in the orifice in a direction which is generally transverse to the longitudinal axis of the connector.

The present invention also provides a connector for securing a support element to an existing wall structure, the connector comprising an L-shaped member, one limb of the L-shaped member being fixable to the existing wall structure and the other limb of the L-shaped member being adapted to support the support element, characterised in that the connector also includes at least one clip member arranged for pushing onto and for gripping the support element.

Advantageously, the tongue member is adapted to engage with a support element having a C-channel profile.

Preferably, at least one wing member is included on a first portion of the connector and at least one tongue member is included on a second portion of the connector, the first and second portions being movable with respect to each other.

The present invention further provides a connector for securing two support elements together, for use in construction of suspended ceilings, wall and partition walls and the like, the connector including a first wing member for releasably gripping a first support element, and a second wing member of plastically deformable material, the second wing member being movable between an open position and an engaged position in which the wing member is folded over onto the second support element thereby holding the support elements together and further characterised in that the connector comprises two portions, one portion including the first wing member and the other portion including the second wing member, the portions being movable with respect to each other.

The present invention also provides a wall track for use with a connector according to any one of the preceding claims, characterised in that the wall track has a "top-hat" profile aid includes a plurality of ribs arranged along the longitudinal axis of the profile, the ribs defining a channel adapted for receipt of a connector as claimed in claim 1.

The present invention further provides a method of securing a panel to a support element for use in the construction of suspended ceilings, walls, partition walls and the like characterised in that the method includes the following steps:

(a) bringing a connector as claimed in claim 1 into engagement with a support element;

(b) folding the or each wing member of plastically deformable material from an open position into an engaged position in which the wing member is folded over onto the support element thereby holding the connector in position on the support element;

(c) sliding the connector along the support element to a desired location;

(d) engaging the panel-connecting element which is formed of plastically deformable material in a first panel;

(e) crimping the connector in place on the support element;

(f) bringing an edge of a second panel into abutment with an edge of the first panel;

(g) repeating steps (a) to (f) with another panel.

The present invention will now be described more particularly with reference to the accompanying drawings in which are shown, by way of example only, several embodiments of a connector for use in constructing suspended ceilings, walls and partition walls using panels, in accordance with the present invention.

FIGS. 1*a,* 1*b* and 1*c* are perspective views of a first embodiment of connector.

FIG. 2 is a perspective view of the first embodiment of connector, in use in which a pair of connectors are shown at each side of a UPVC panel and are connected to a transverse or cross T-bar holding the panel to the T-bar;

FIG. 2*a* is a top plan view showing a plurality of transverse T-bars having connectors holding ceiling panels in place;

FIG. 2*b* shows schematically, a damaged panel being removed for a placement panel to slide into place;

Figure 6:
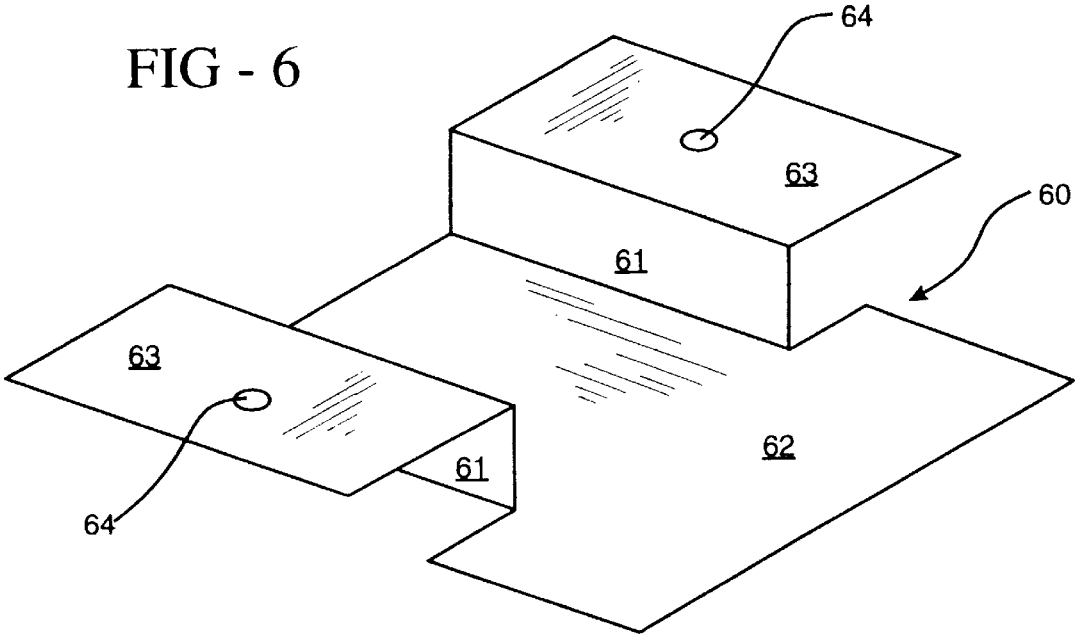
FIG. 6 is a perspective view of a second embodiment of connector.
Figure 6A:
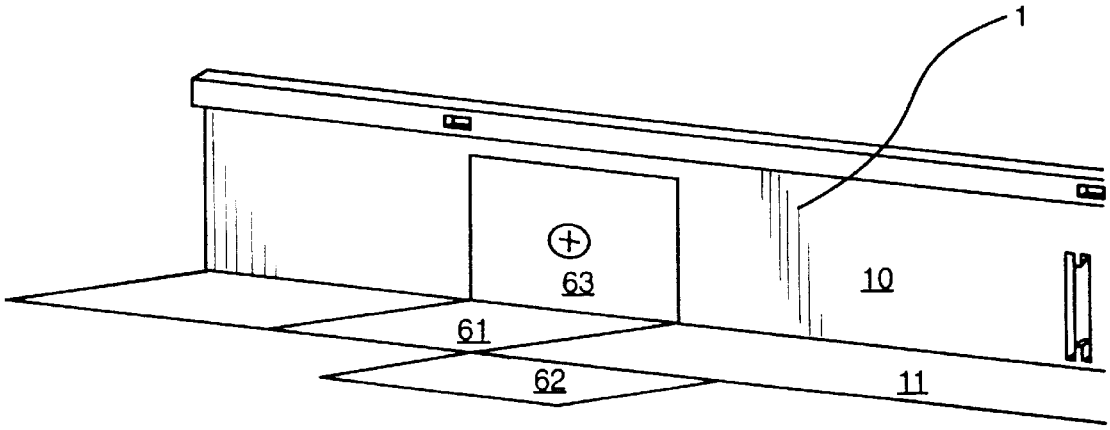
Figure 7:
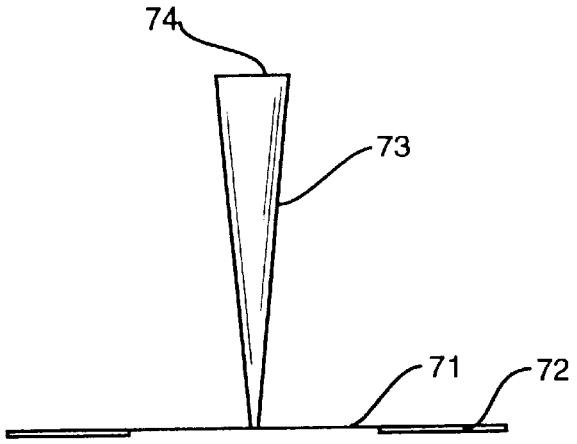
Figure 7A:
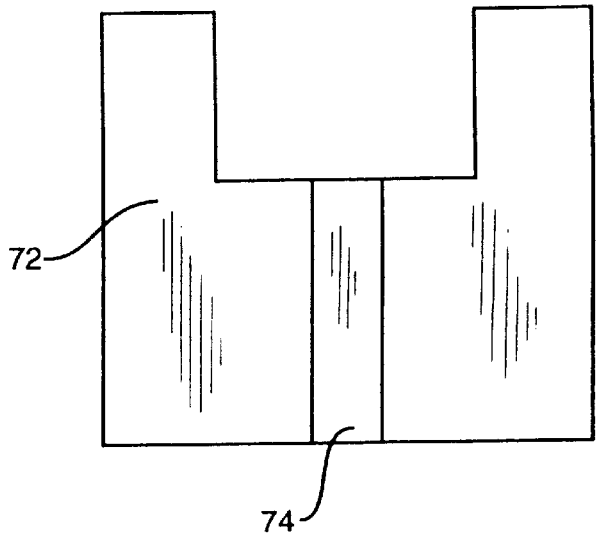
Figure 7B:
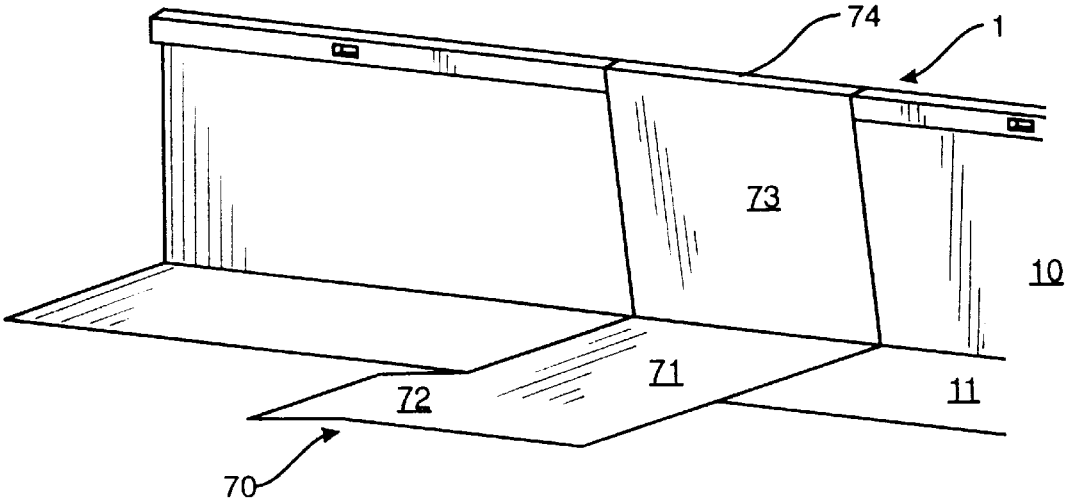
Figure 8:
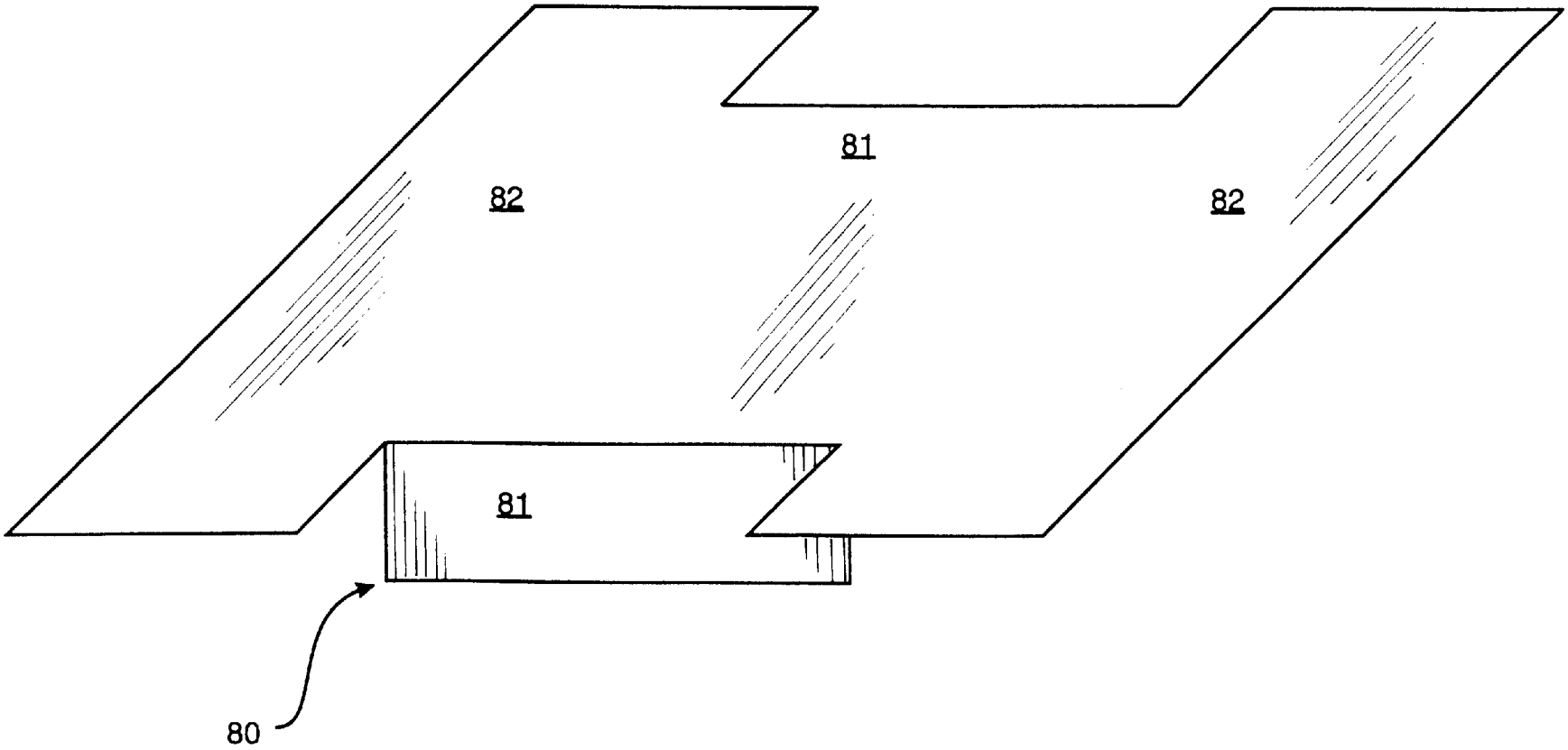
Figure 9:
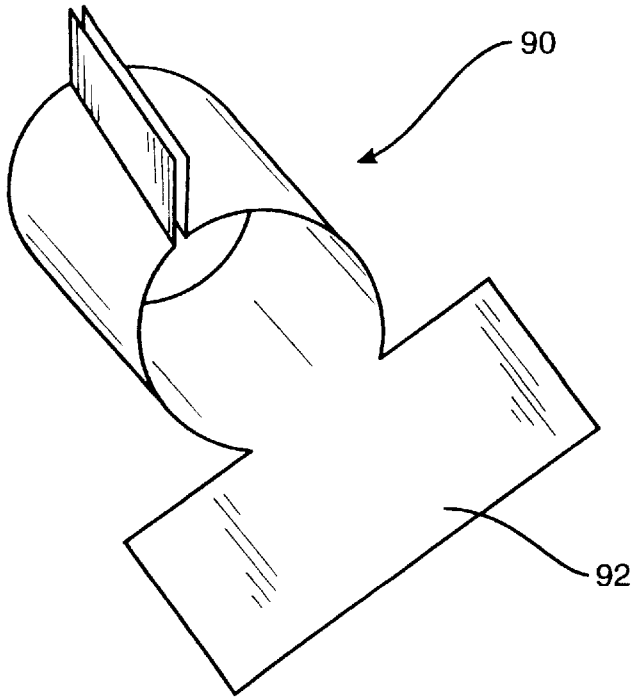
Figure 9A:
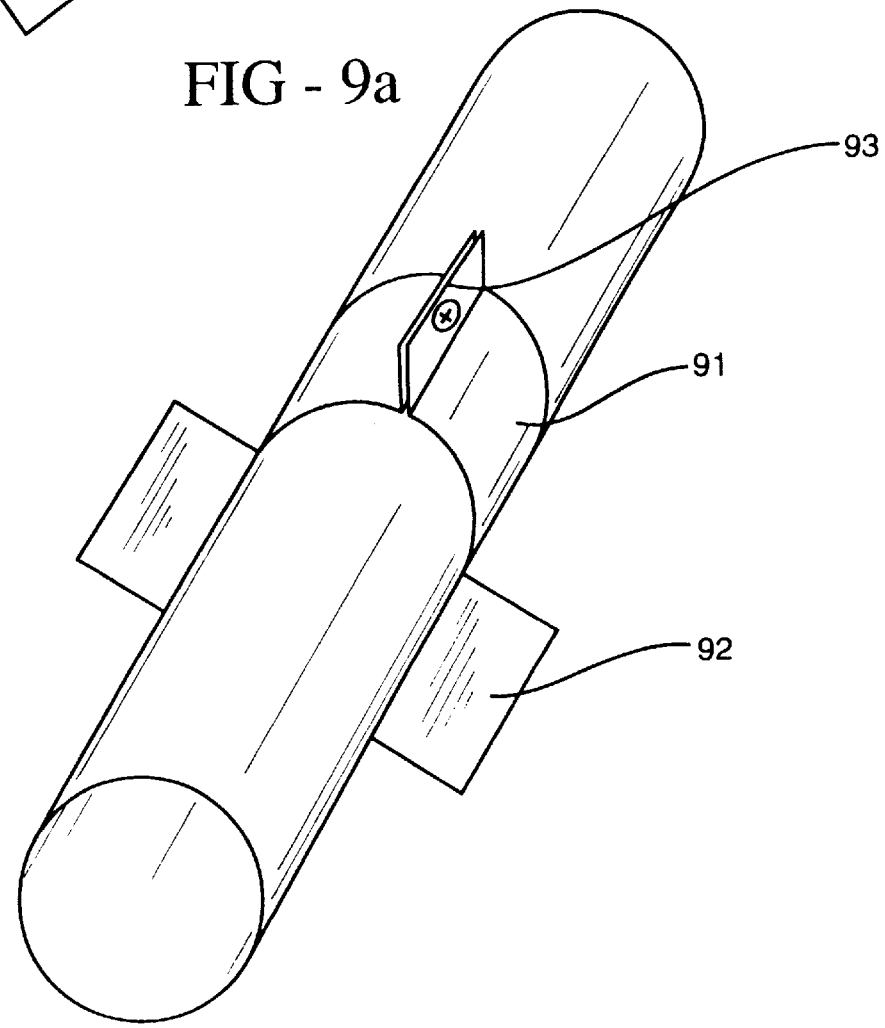
Figure 10C:
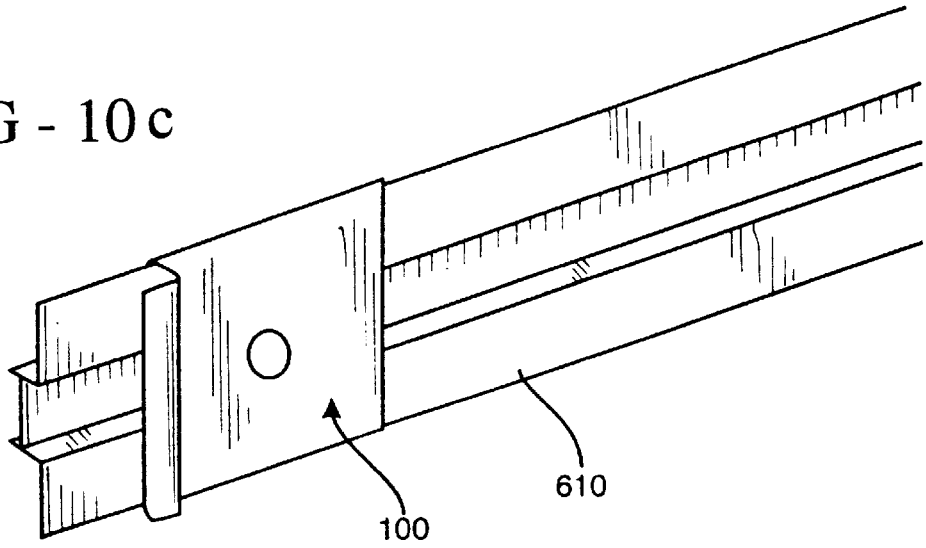
Figure 10A:
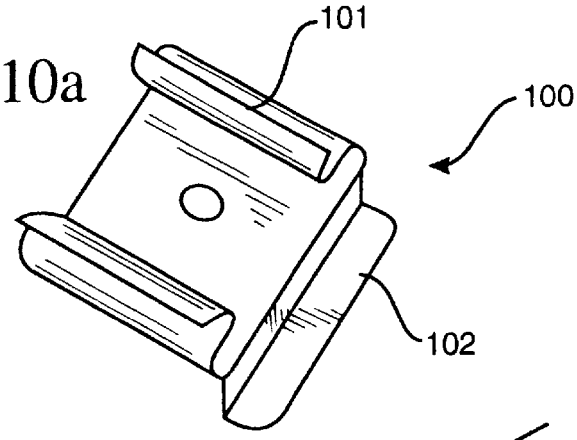
Figure 10B:
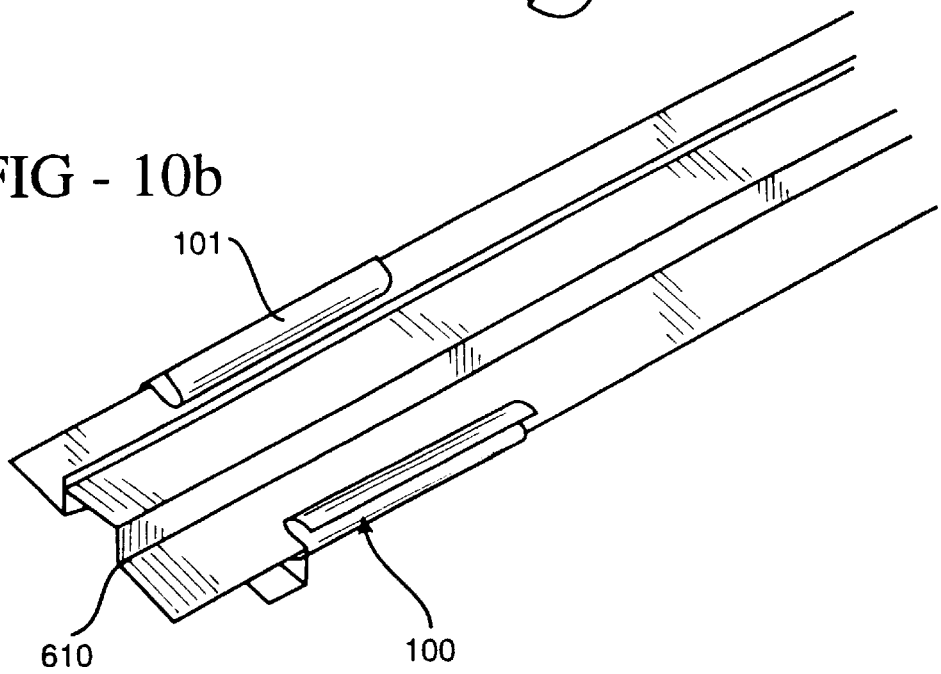

FIG. 6*a* is a perspective view of the second embodiment of connector screwed to a T-bar;

FIG. 7 is a front elevation of a third embodiment of connector;

FIG. 7*a* is a plan view of the connector of FIG. 7;

FIG. 7*b* is a perspective view of the connector of FIGS. 7 and 7*a* attached to a T-bar;

FIG. 8 is a perspective view of a fourth embodiment of connector;

FIG. 9 is a perspective view of a fifth embodiment of connector;

FIG. 9*a* is a perspective view of the connector of FIG. 9 in use about a circular pipe or tube;

FIG. 10*a* is a perspective view of a sixth embodiment of connector;

FIGS. 10*b* and 10*c* are perspective views of the connector of FIG. 10 in use mounted to a wall track which is described in more detail with reference to FIGS. 61*a* and 61*b;*

Figure 11:
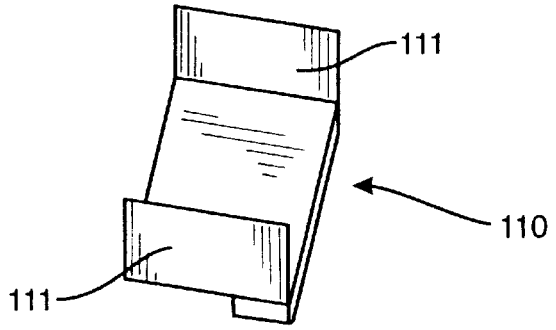
Figure 11A:
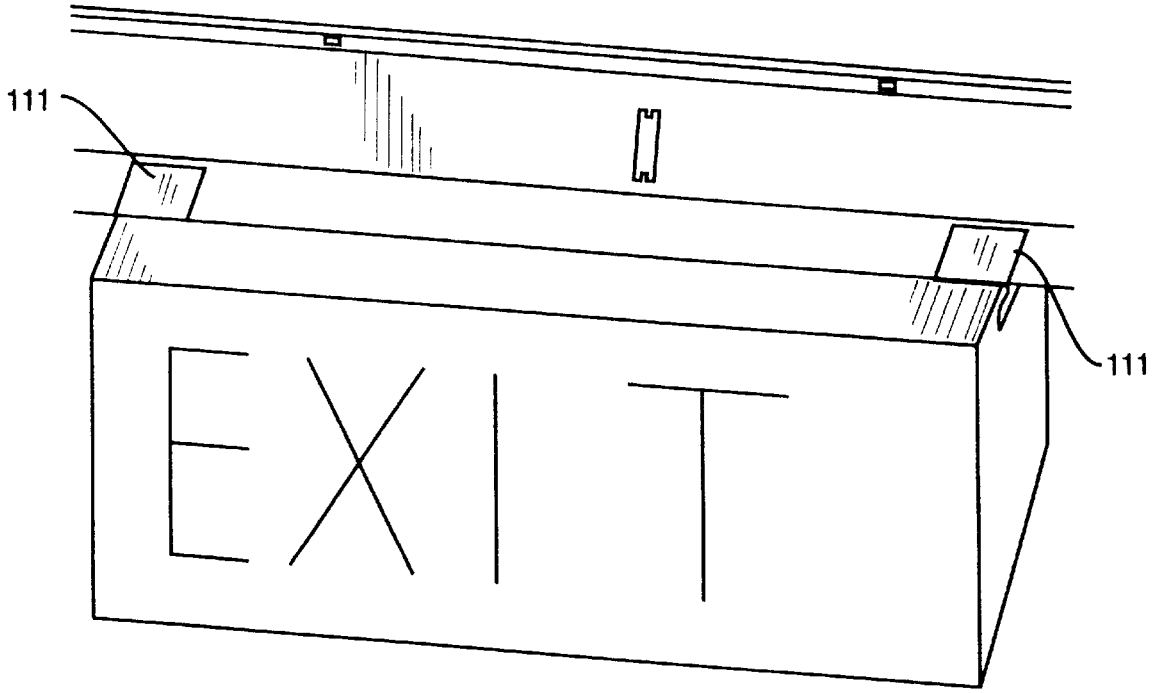
Figure 11C:
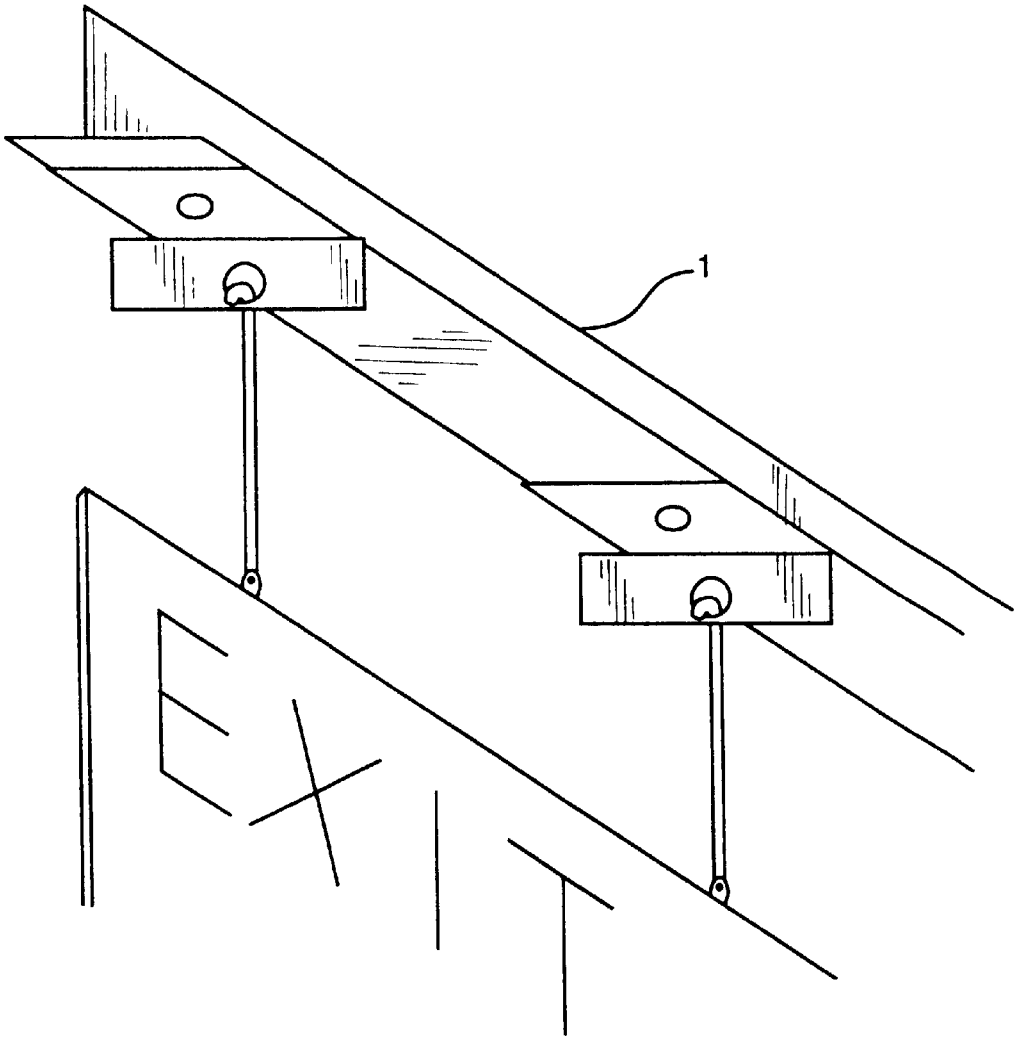
Figure 11B:
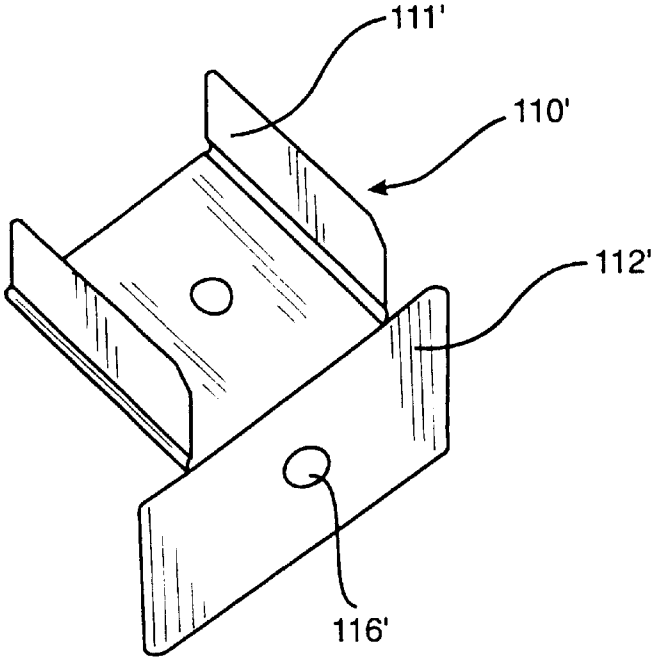
Figure 12:
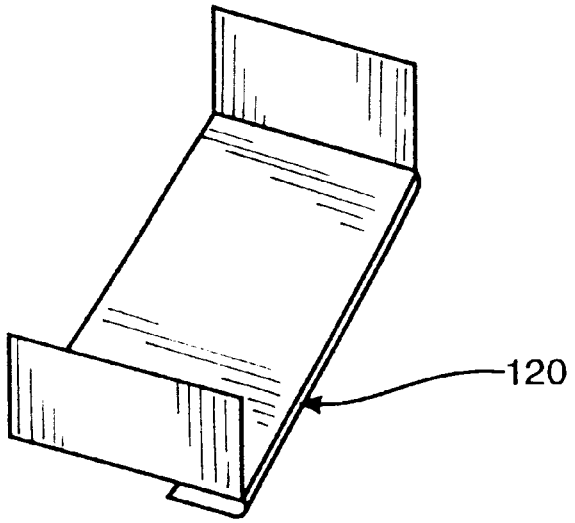
Figure 13:
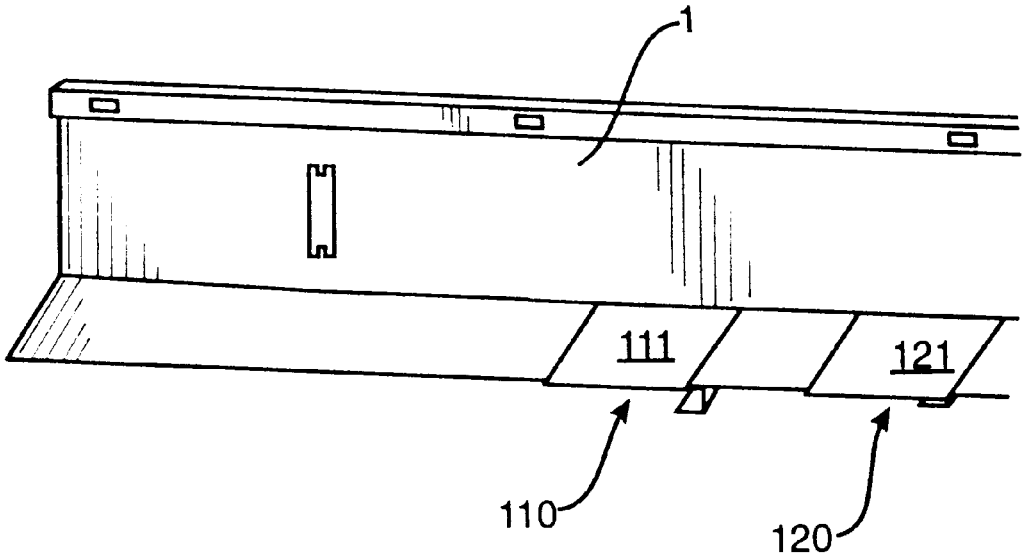
Figure 14:
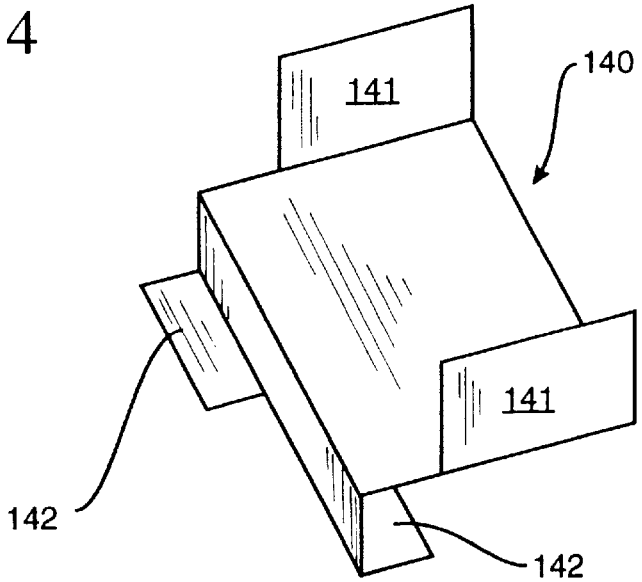
Figure 14A:
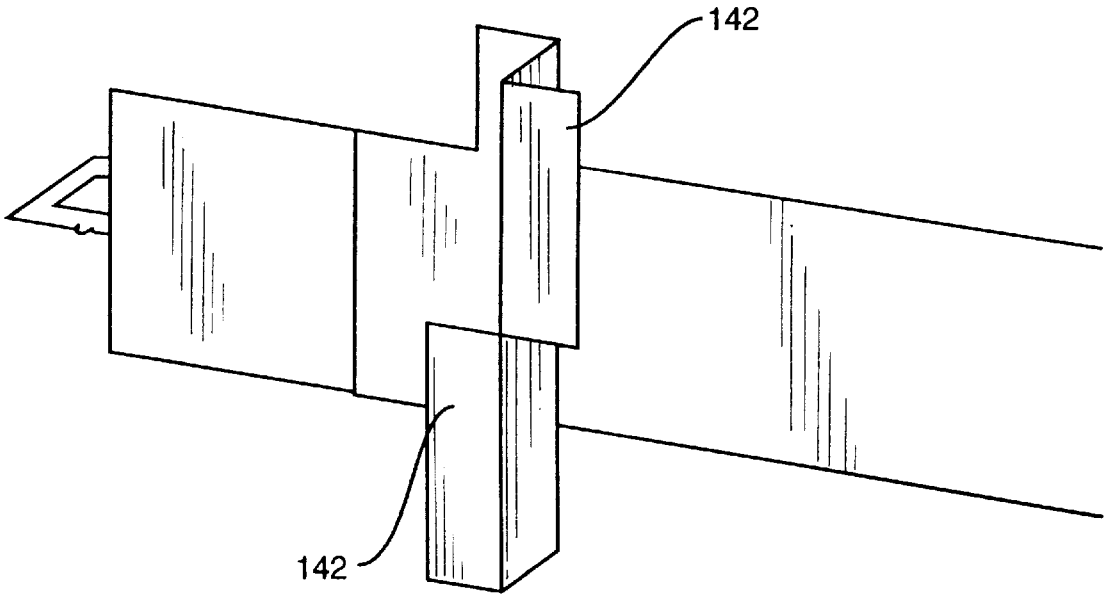
Figure 14B:
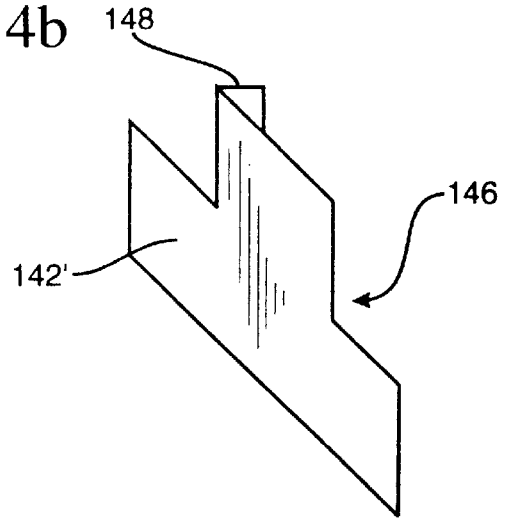
Figure 14C:
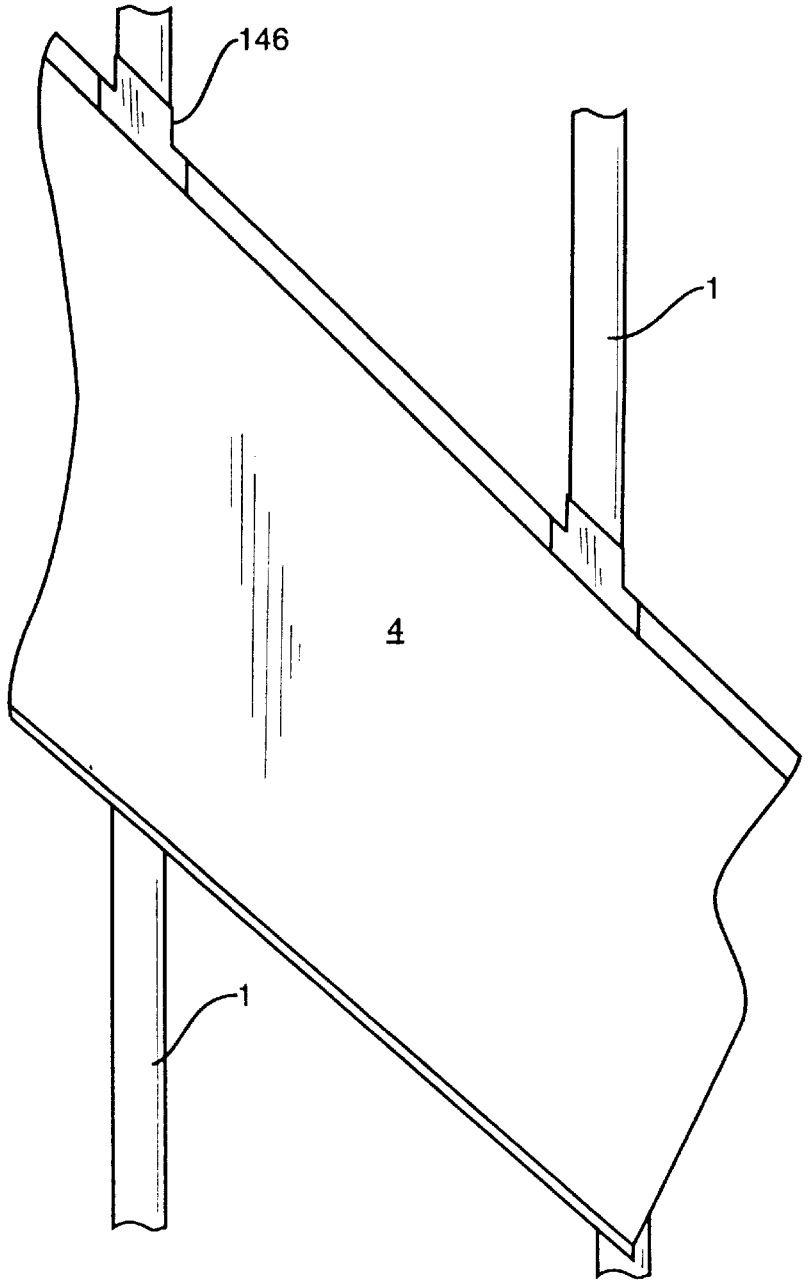
Figure 15:
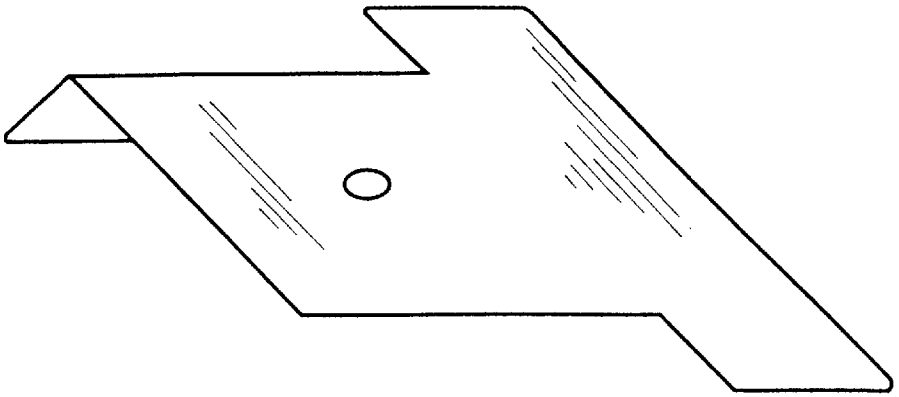

FIG. 11 is a perspective view of a seventh embodiment of connector;

FIG. 11*a* is a perspective view of the connector of FIG. 11 in an alternative use holding a sign from a T-bar;

FIG. 11*b* is a perspective view of an eighth embodiment of connector similar to that of FIG. 11 for use in holding another type of sign or promotional display;

FIG. 11*c* is a perspective view from below showing the connector of FIG. 11*b* holding a sign in place;

FIG. 12 is a perspective view of an alternative embodiment of connector;

FIG. 13 is a perspective view of the eighth and ninth embodiments of connector attached to a T-bar;

FIG. 14 is a perspective view of a tenth embodiment of connector;

FIG. 14*a* is a perspective view of the connector of FIG. 14 in use on a T-bar;

FIG. 14*b* is a front elevation of an eleventh embodiment of connector for orienting UPVC panels at 45° to transverse T-bars;

FIG. 14*c* is a front elevation of the connector of FIG. 14*b* in use;

FIG. 15 is a bottom plan view of a twelfth embodiment of connector for use in achieving a 45° "herring-bone" aesthetic effect similar to that of FIG. 14*c;*

Figure 1A:
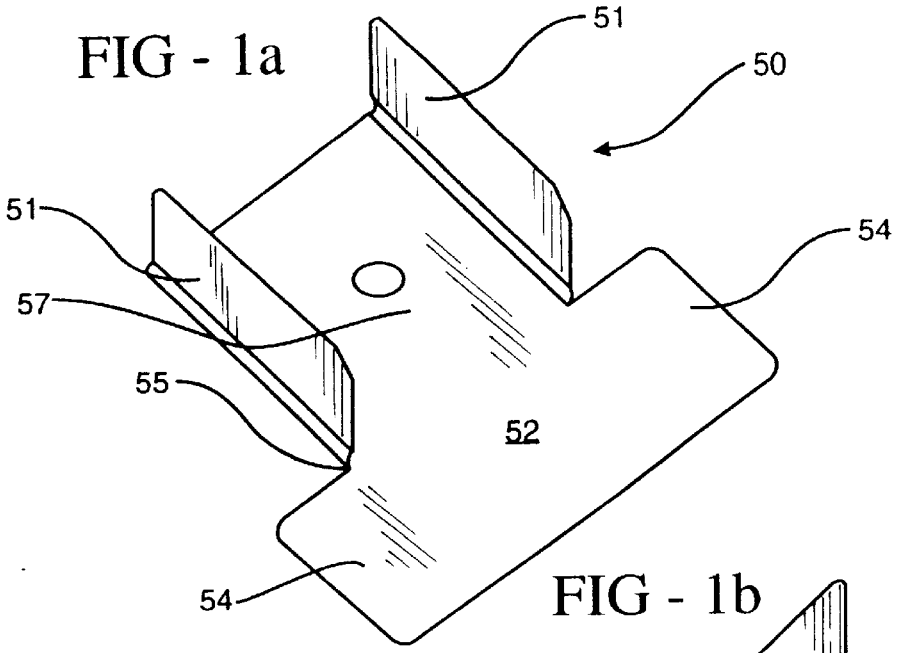
Figure 1B:
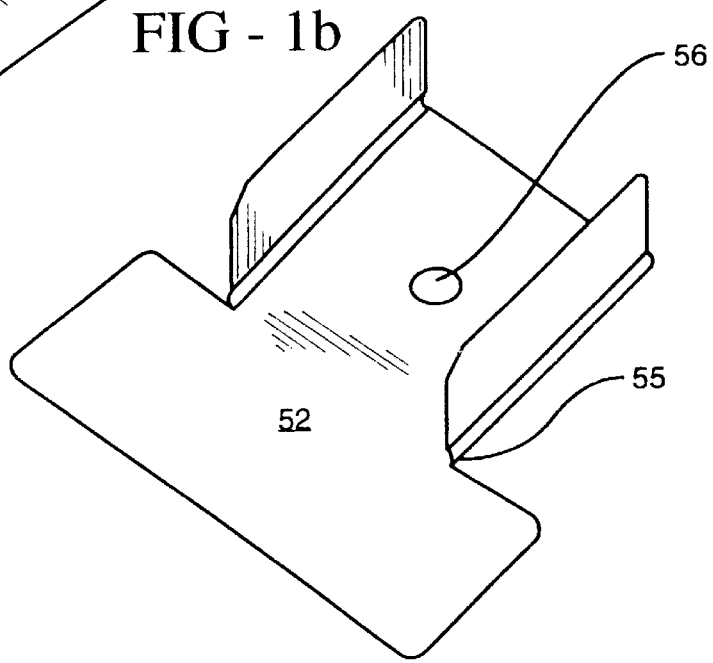
Figure 15A:
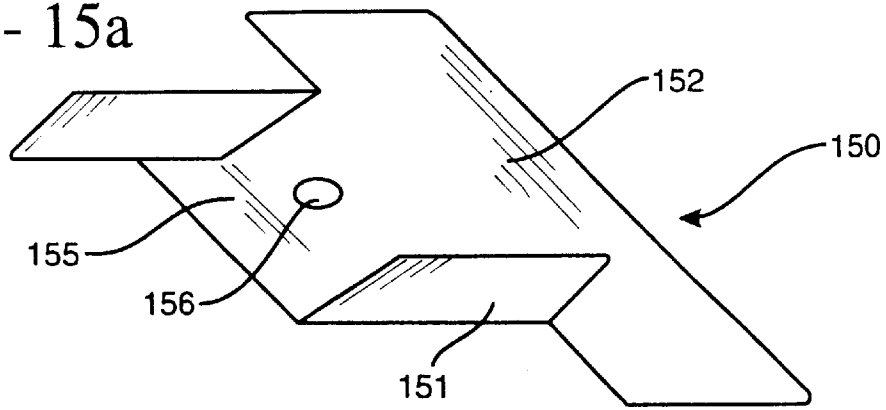
Figure 15B:
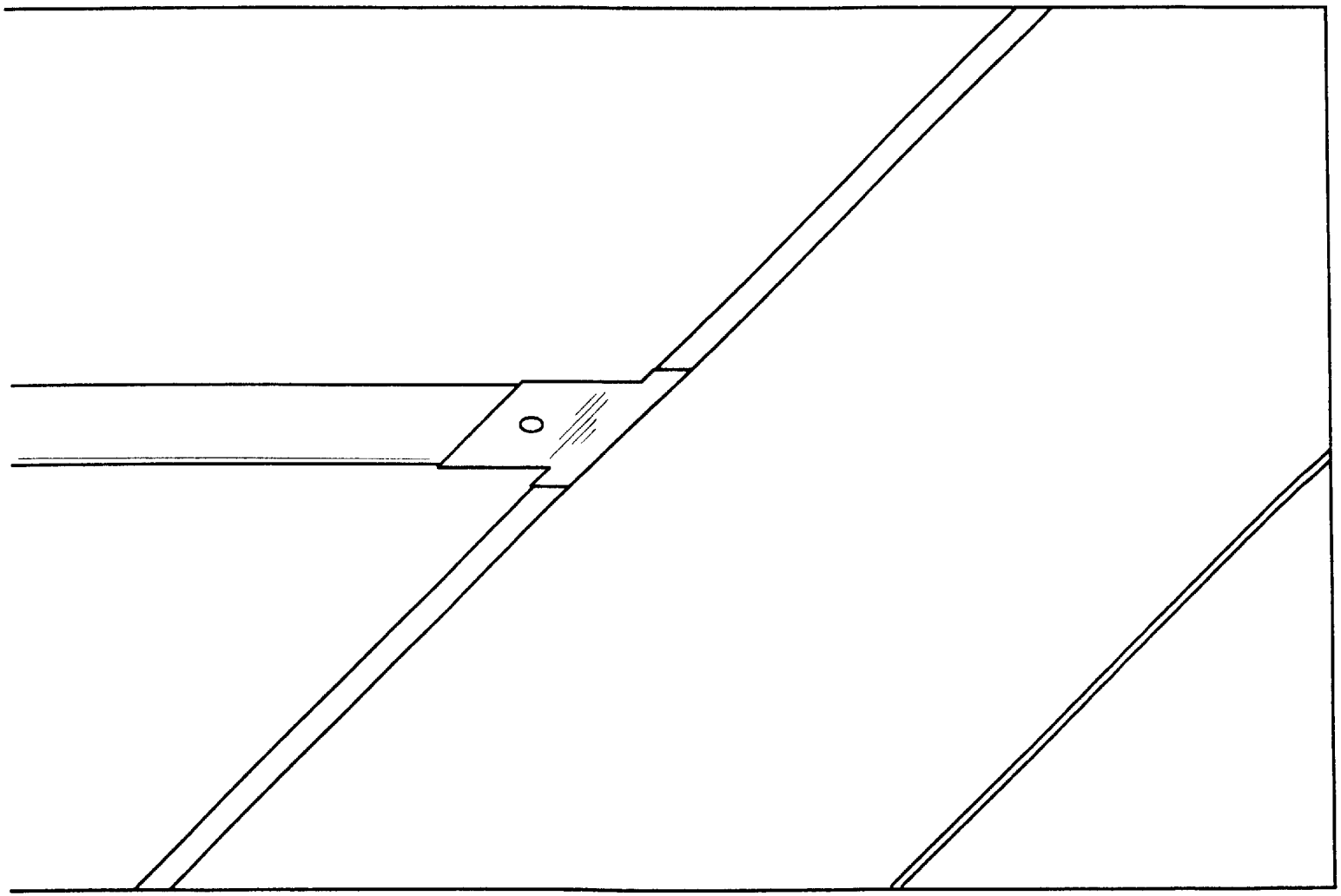
Figure 16:
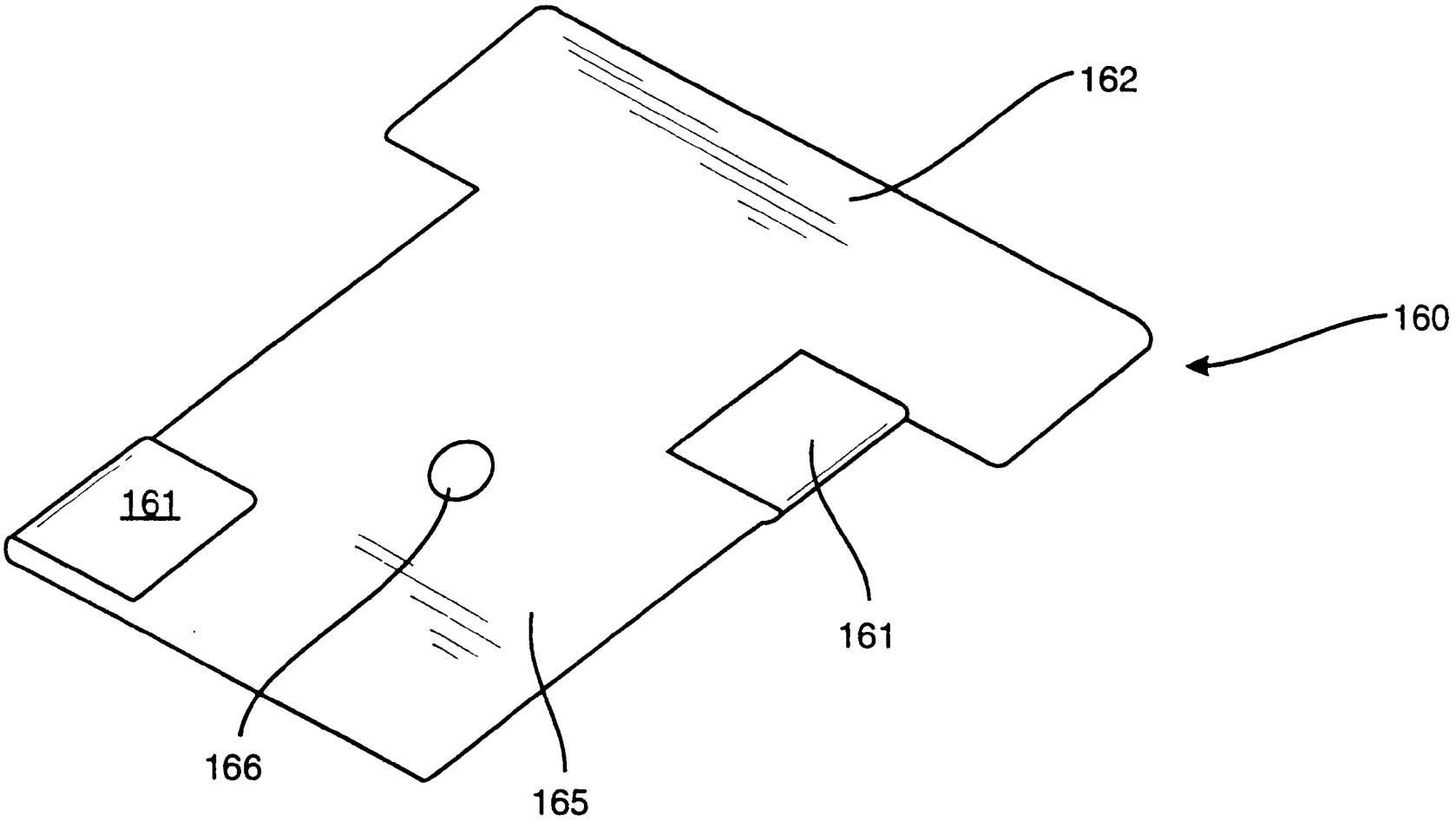
Figure 16A:
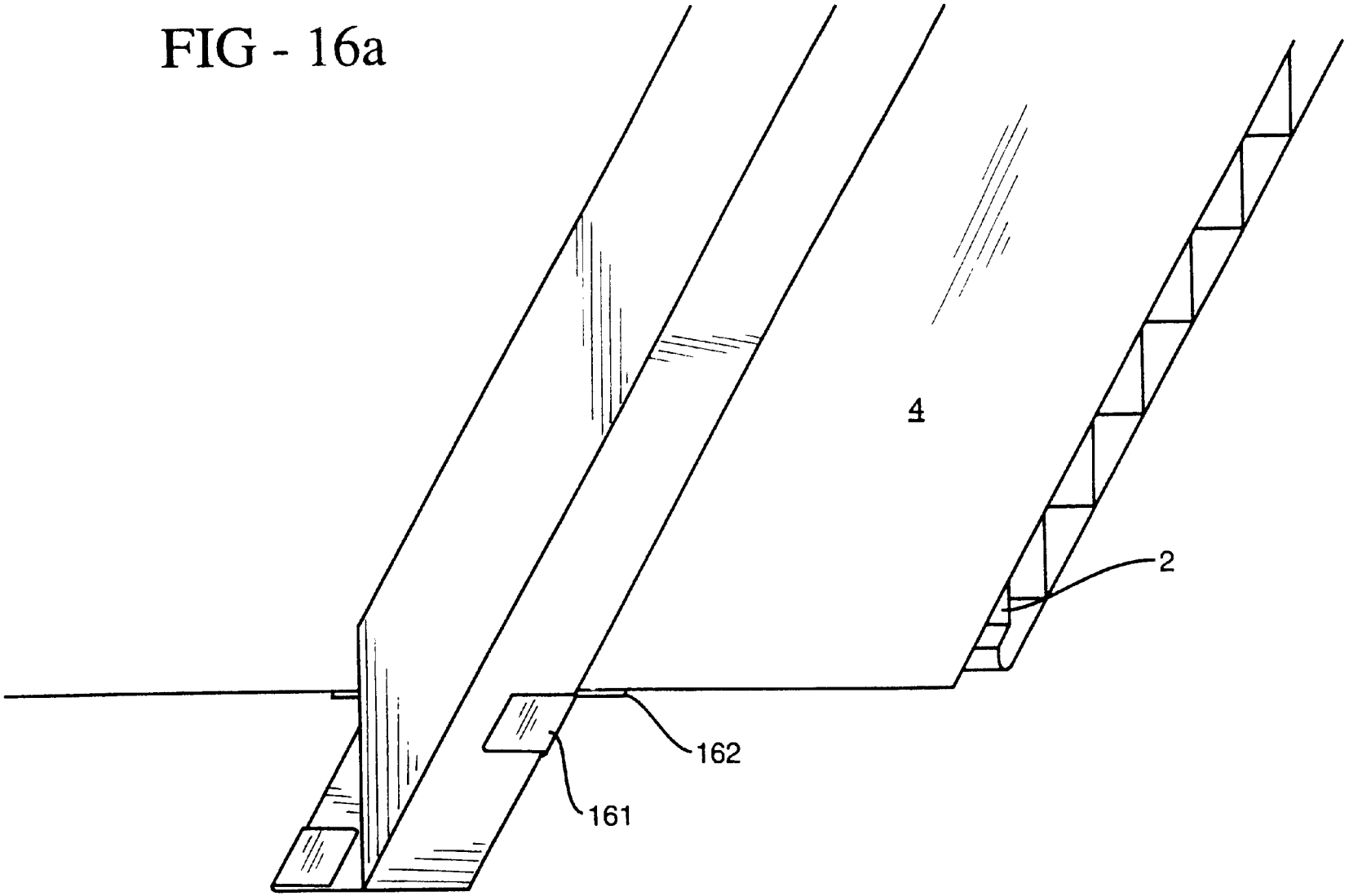
Figure 17A:
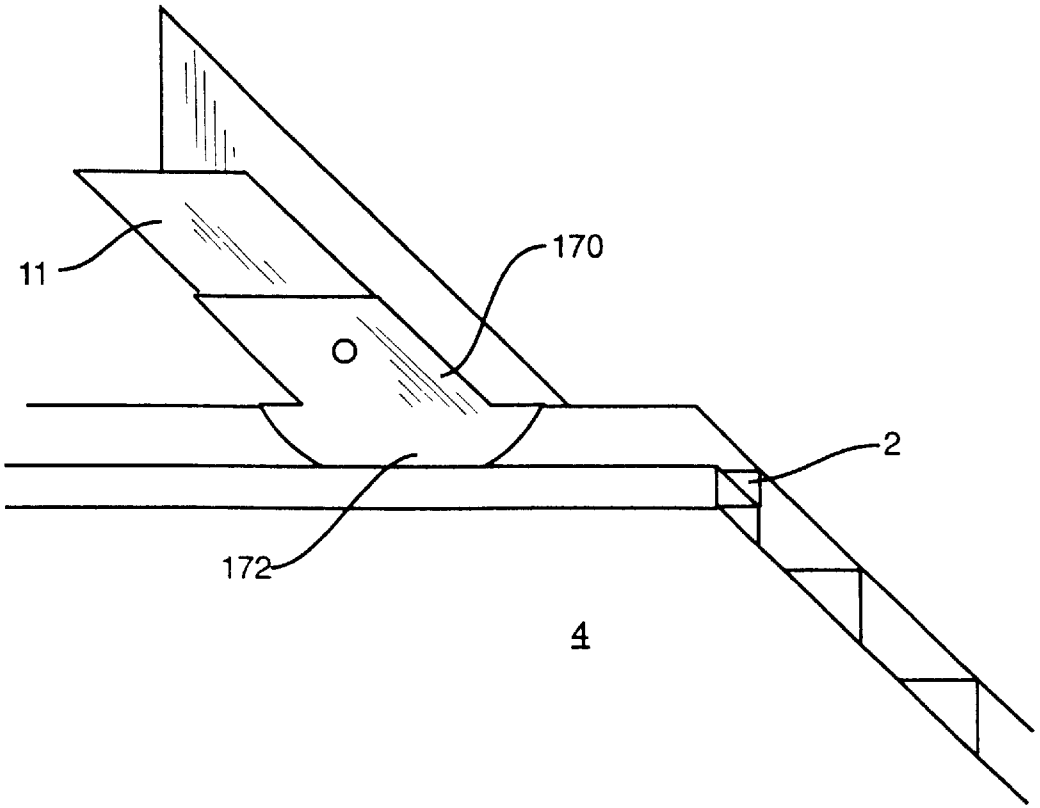
Figure 17:
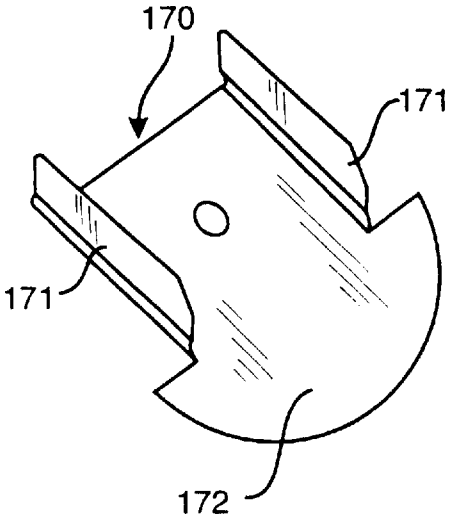
Figure 18:
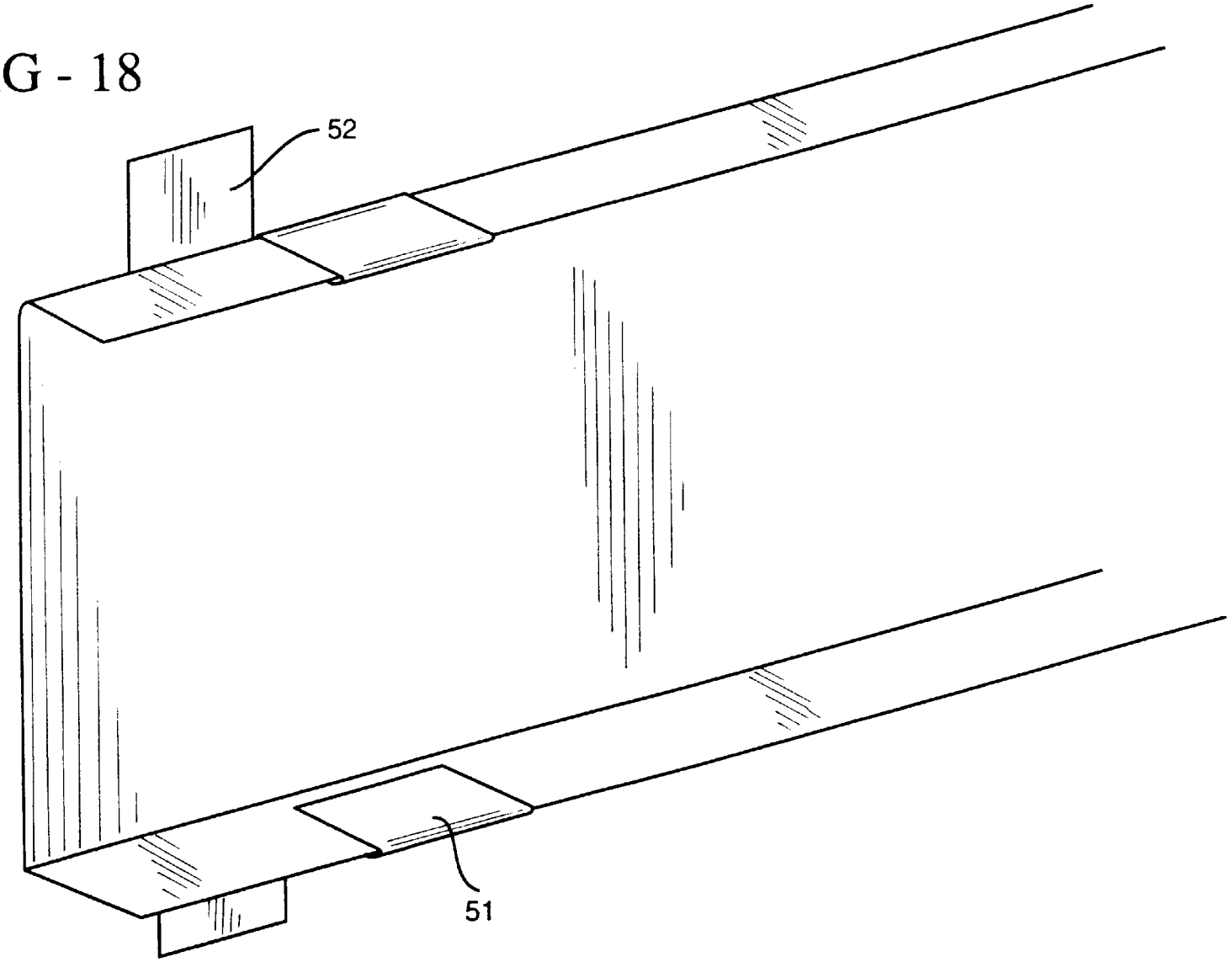
Figure 19:
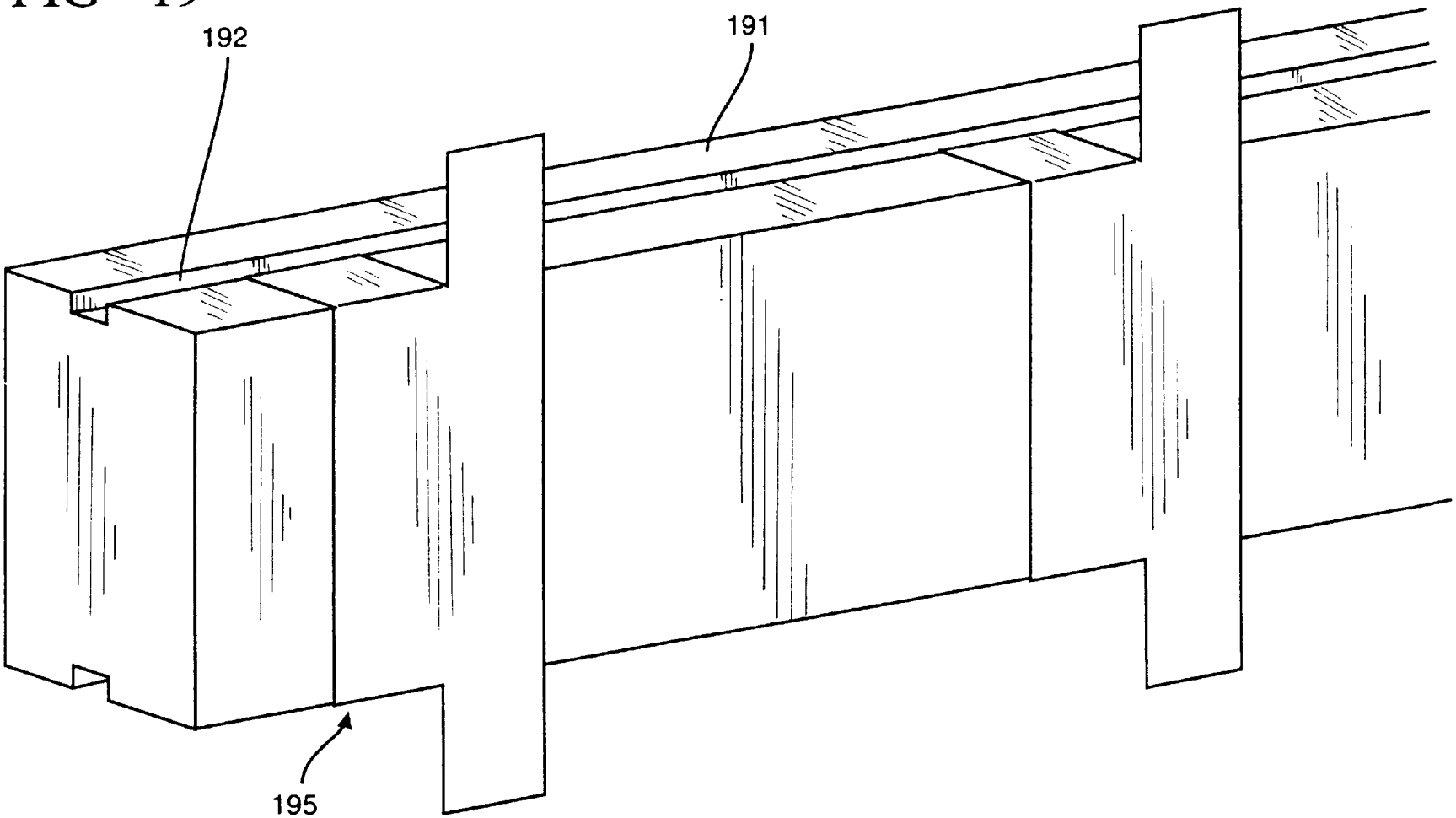
Figure 20:
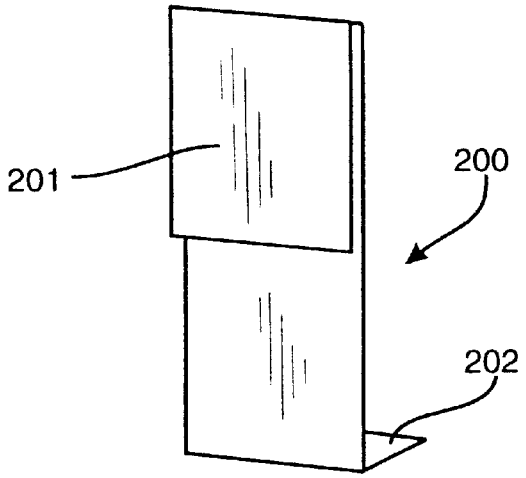
Figure 21:
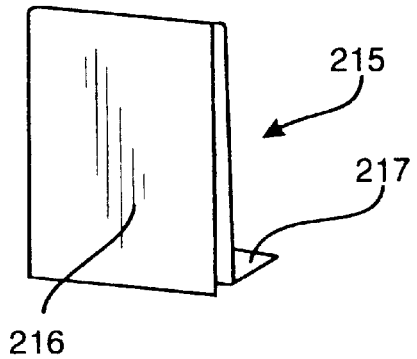
Figure 22A:
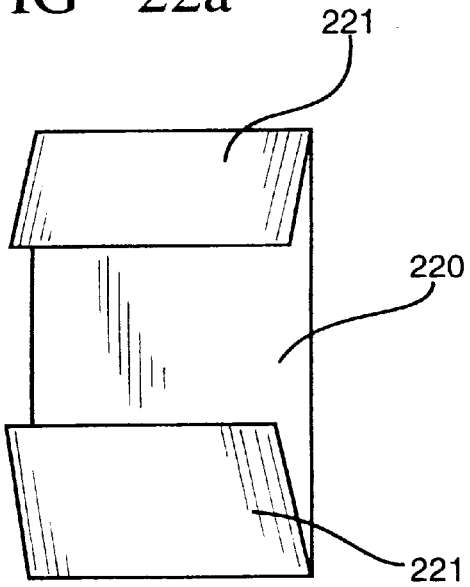
Figure 22B:
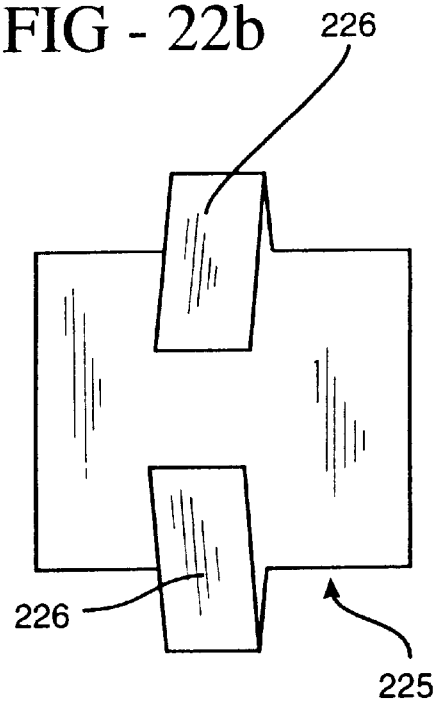
Figure 22C:
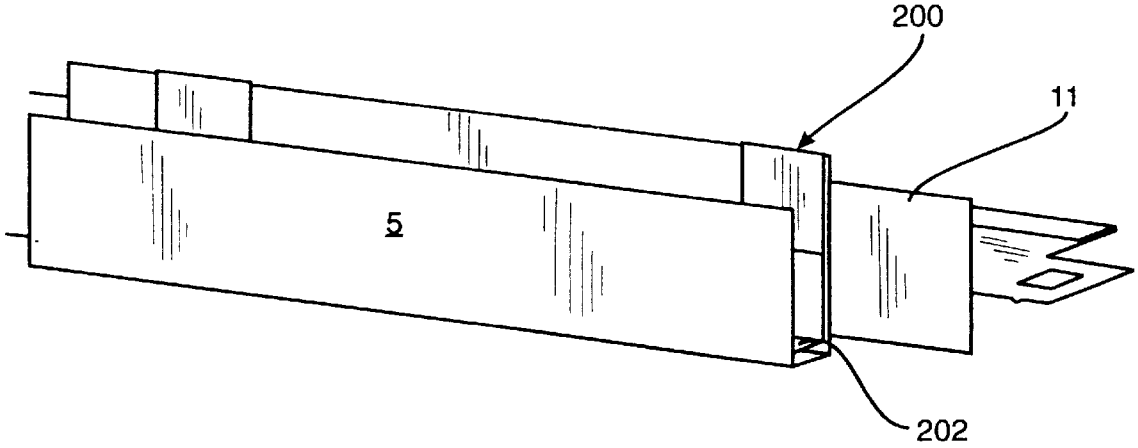
Figure 22D:
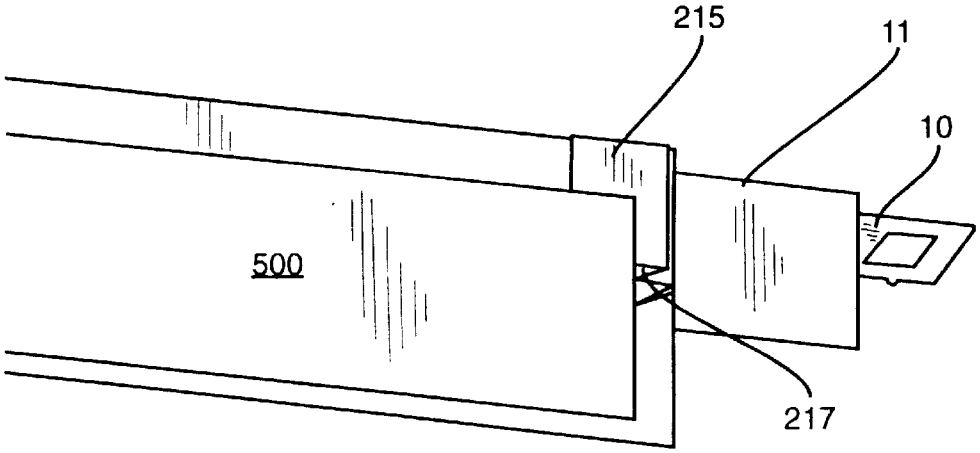
Figure 23:
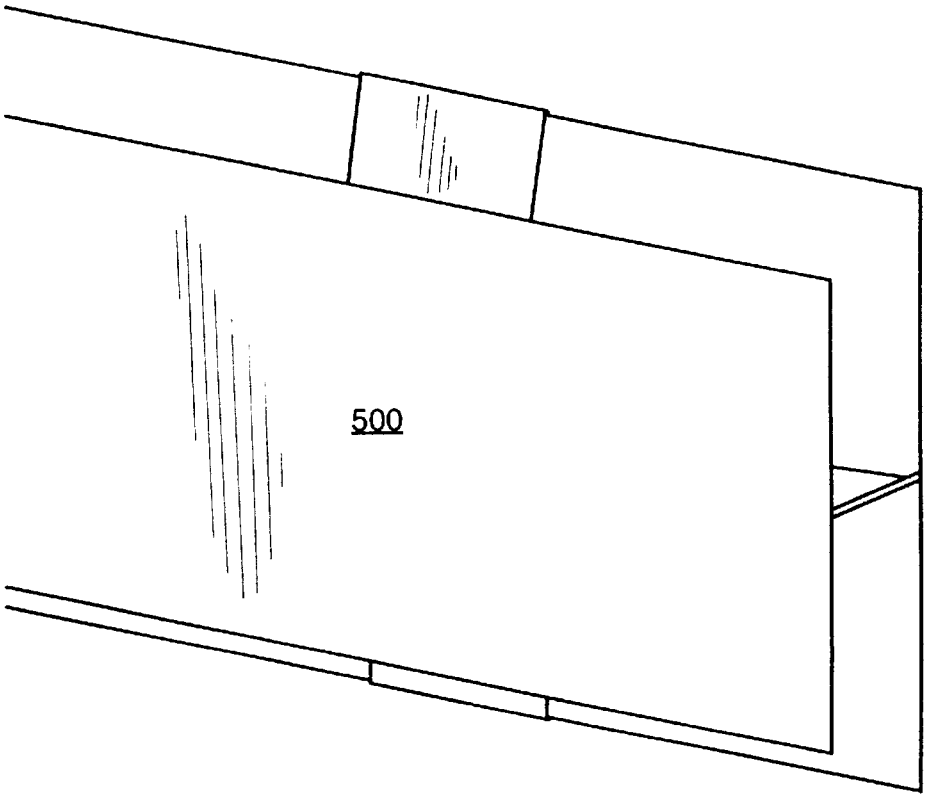
Figure 24:
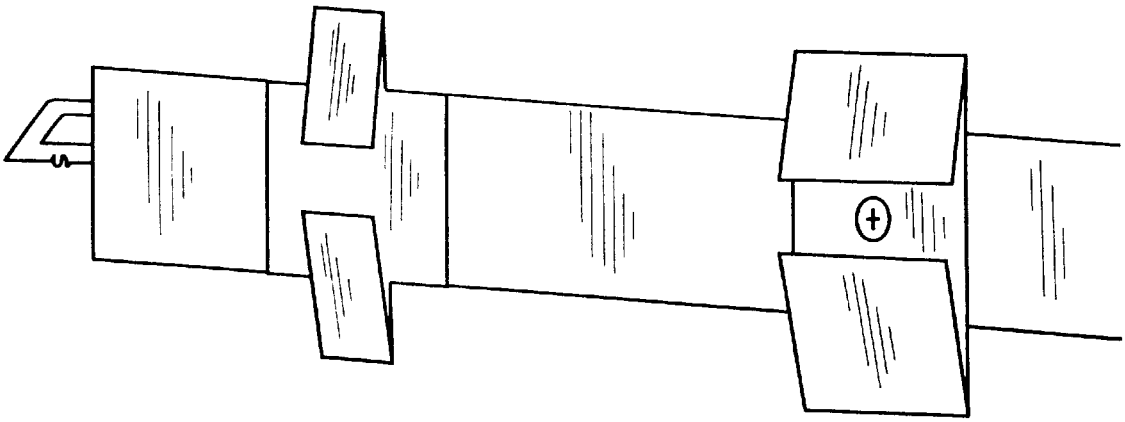
Figure 25A:
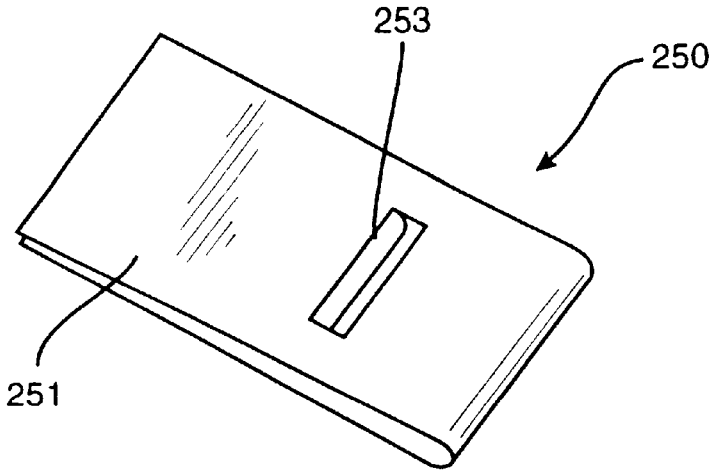
Figure 25B:
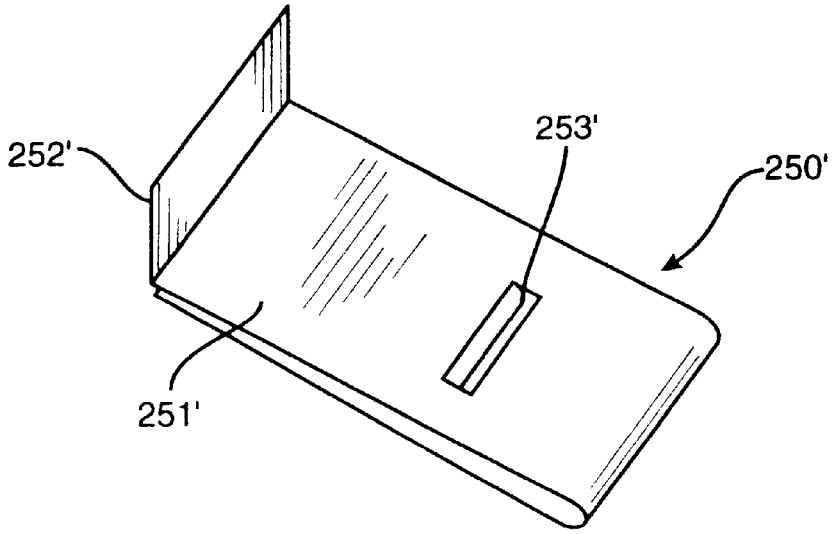
Figure 25C:
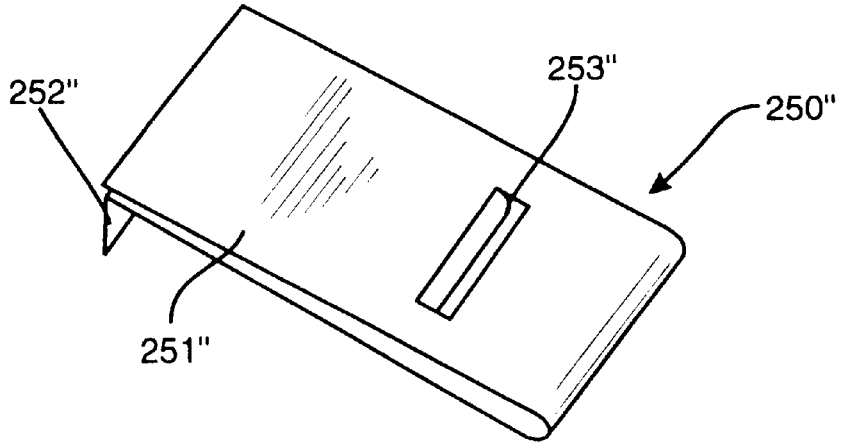
Figure 25D:
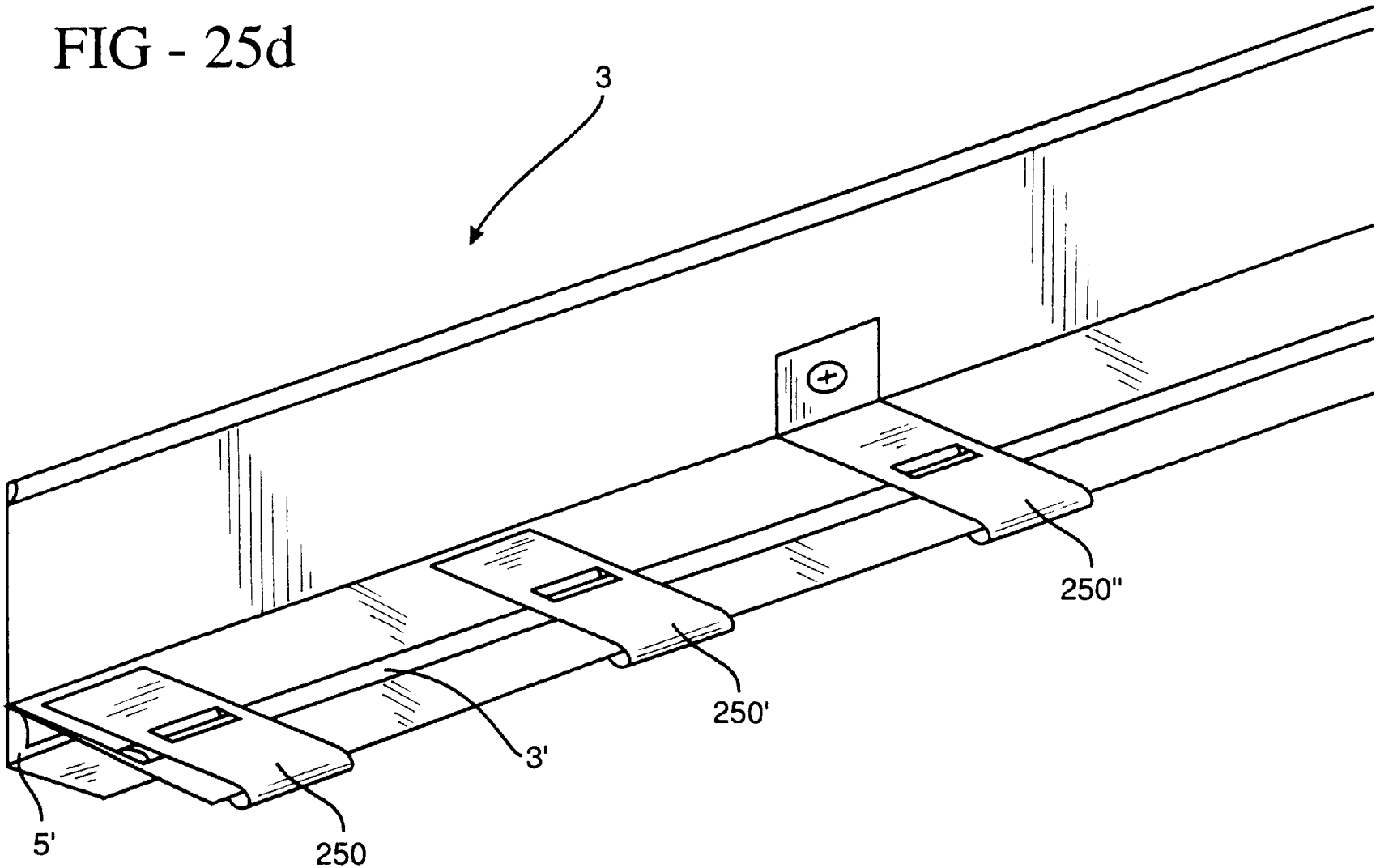
Figure 25E:
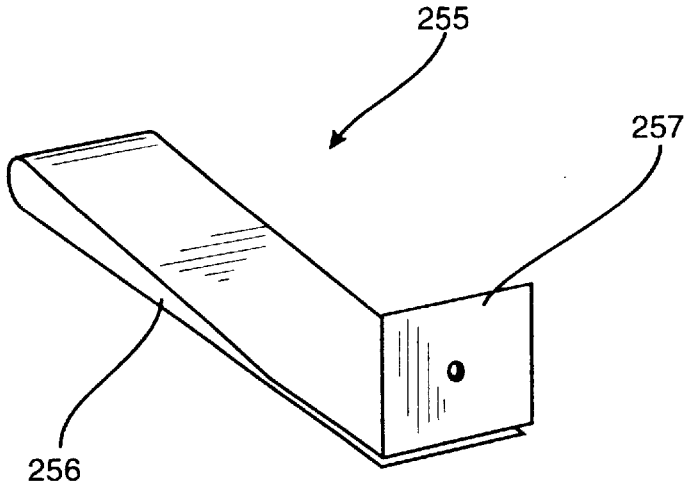
Figure 25F:
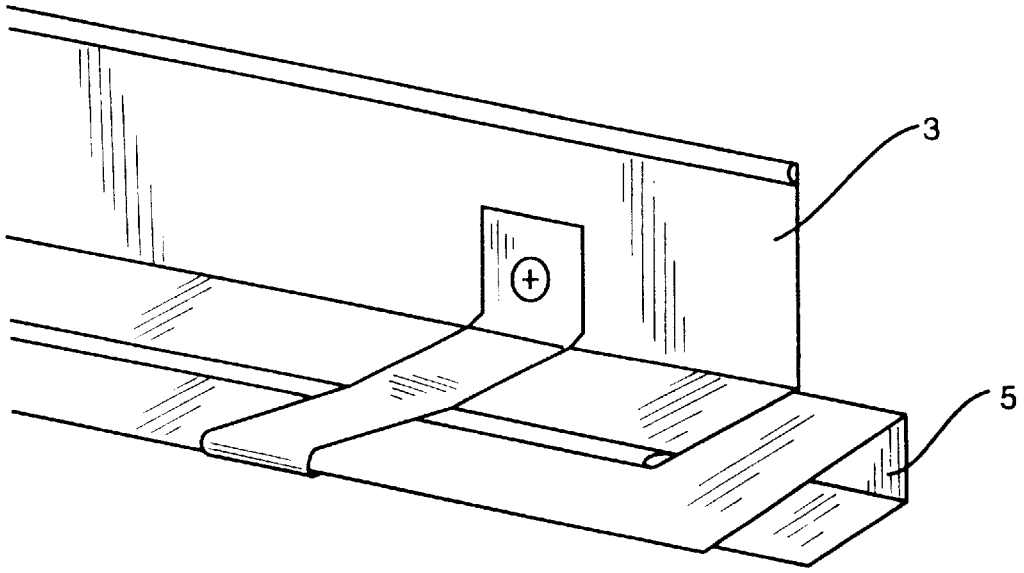
Figure 26:
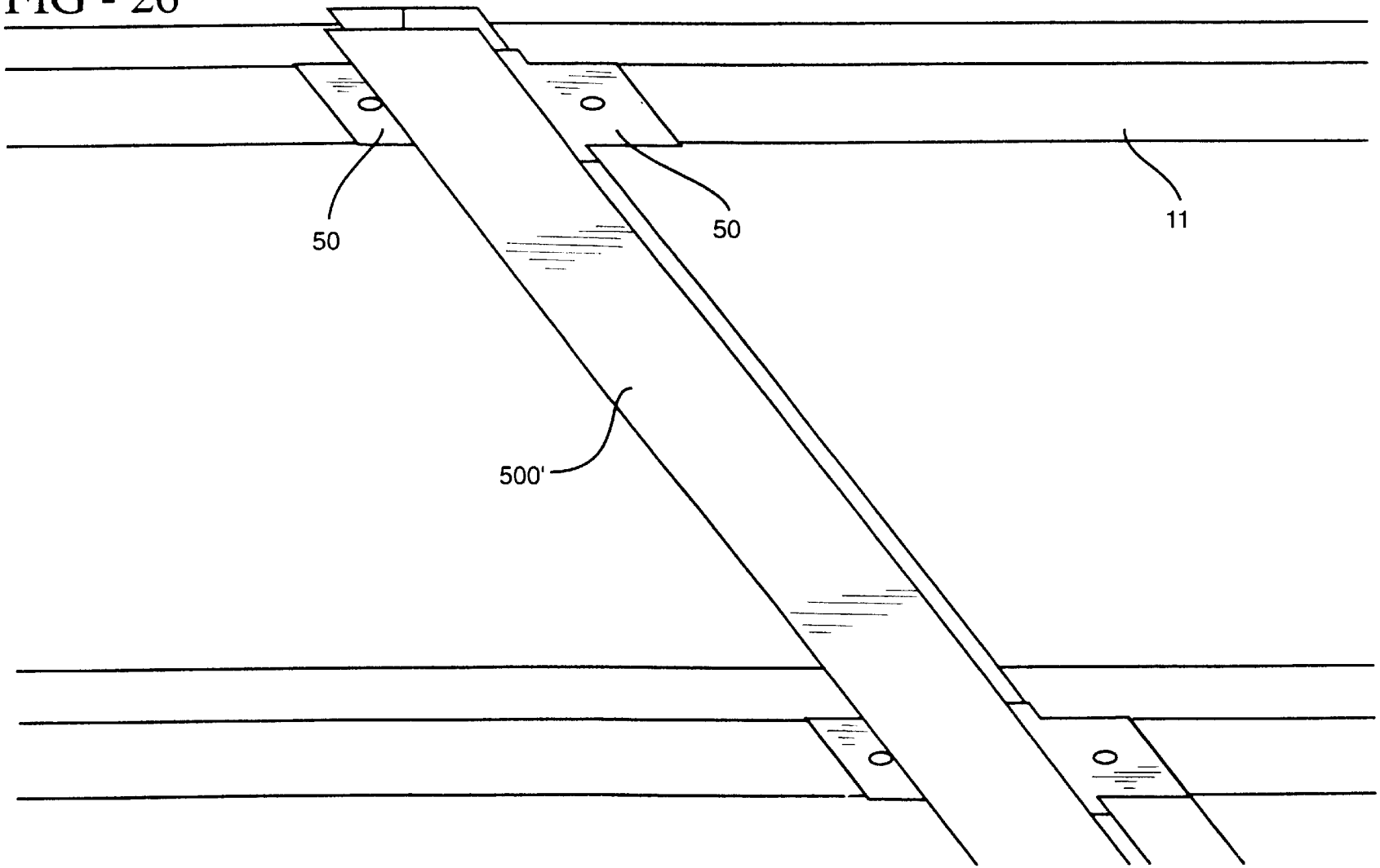
Figure 27:
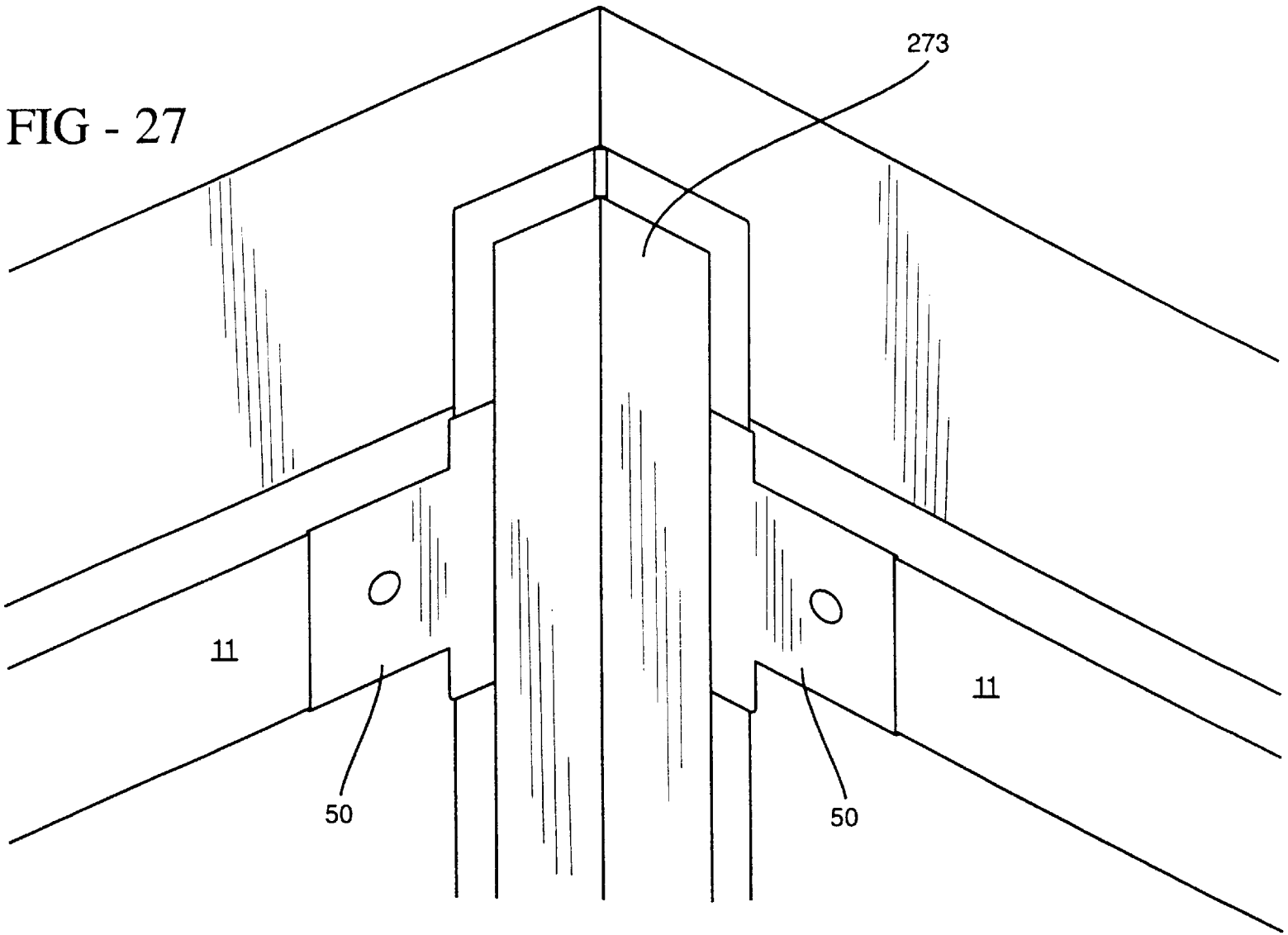
Figure 28:
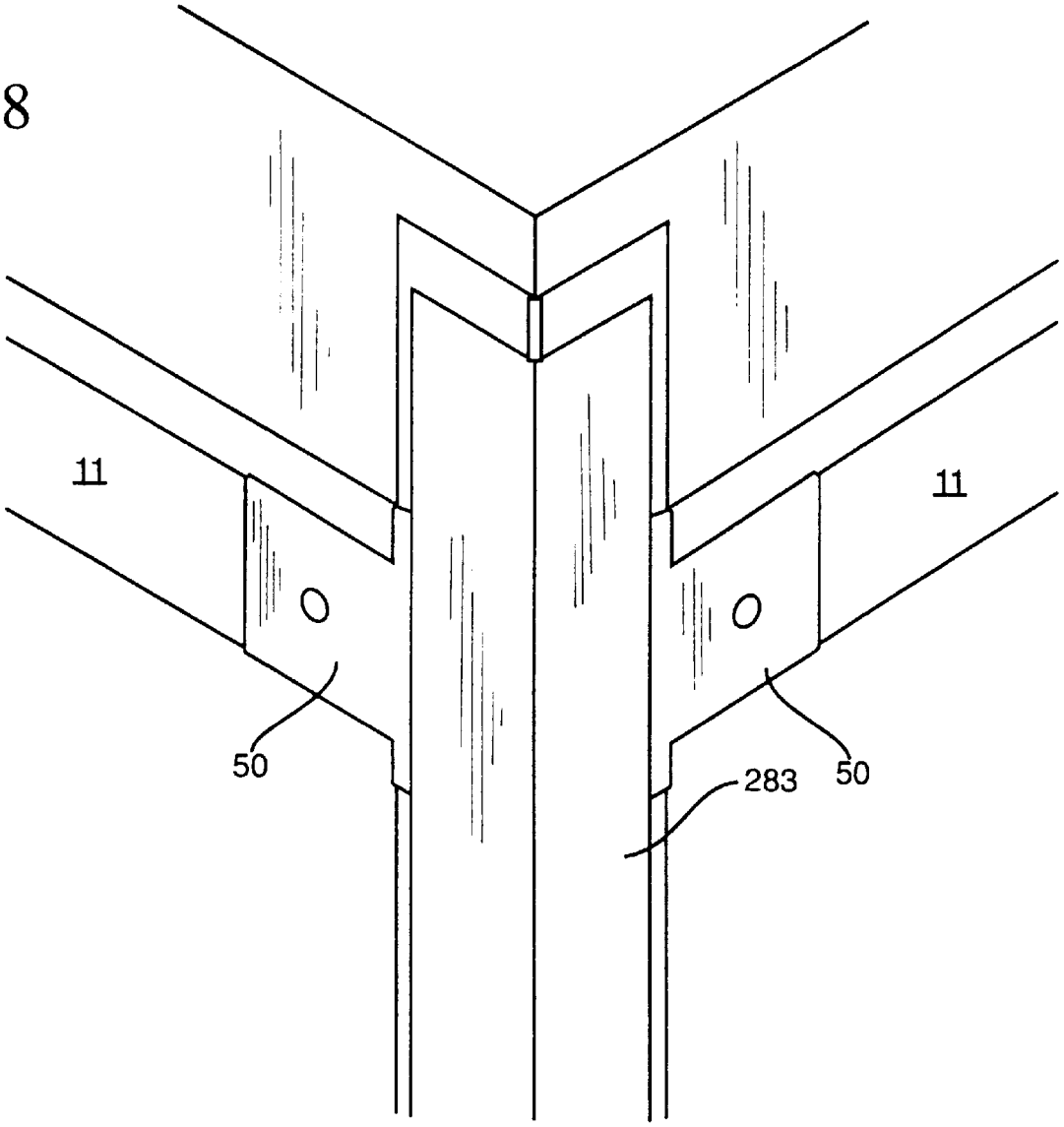
Figure 29:
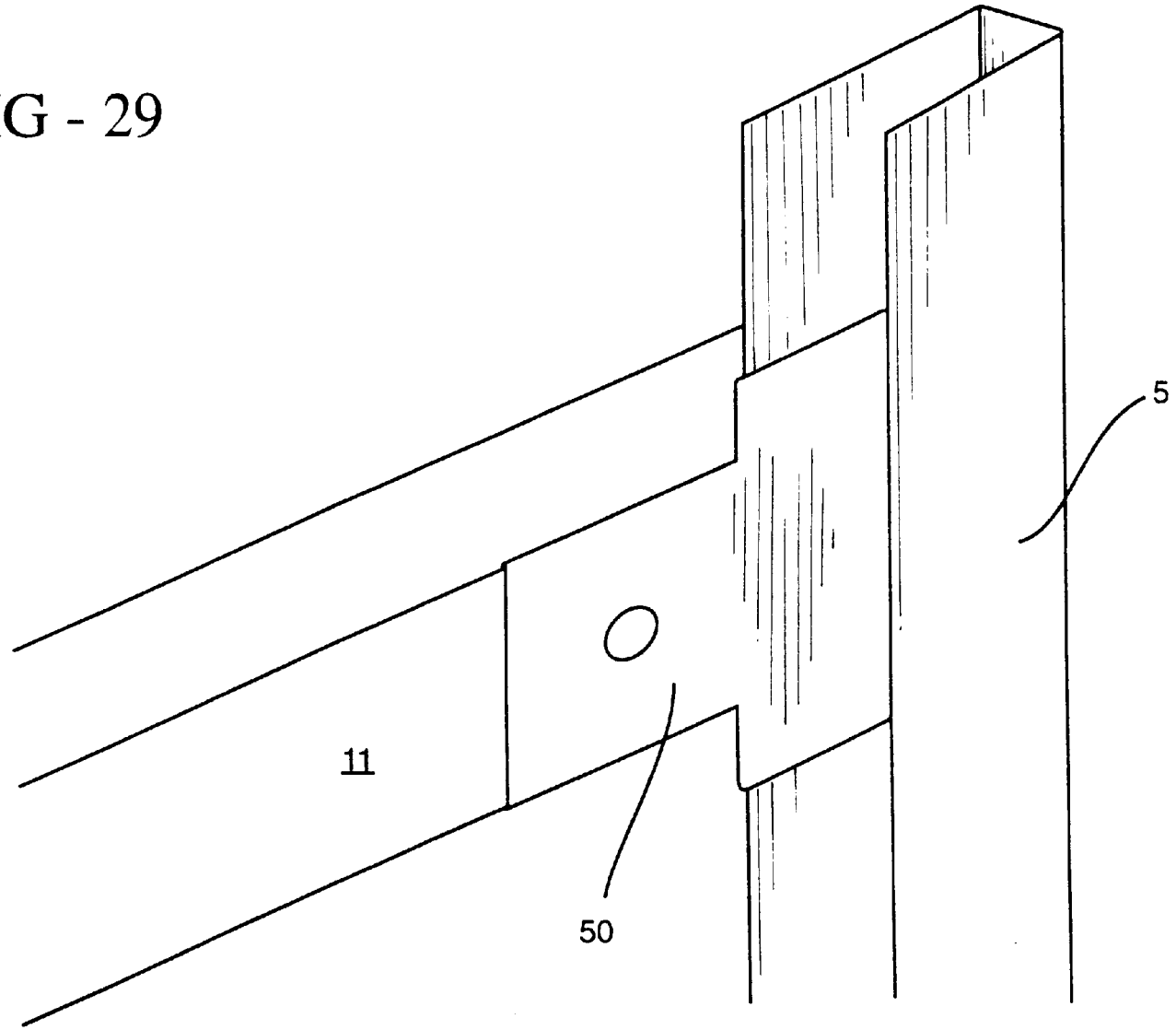
Figure 30A:
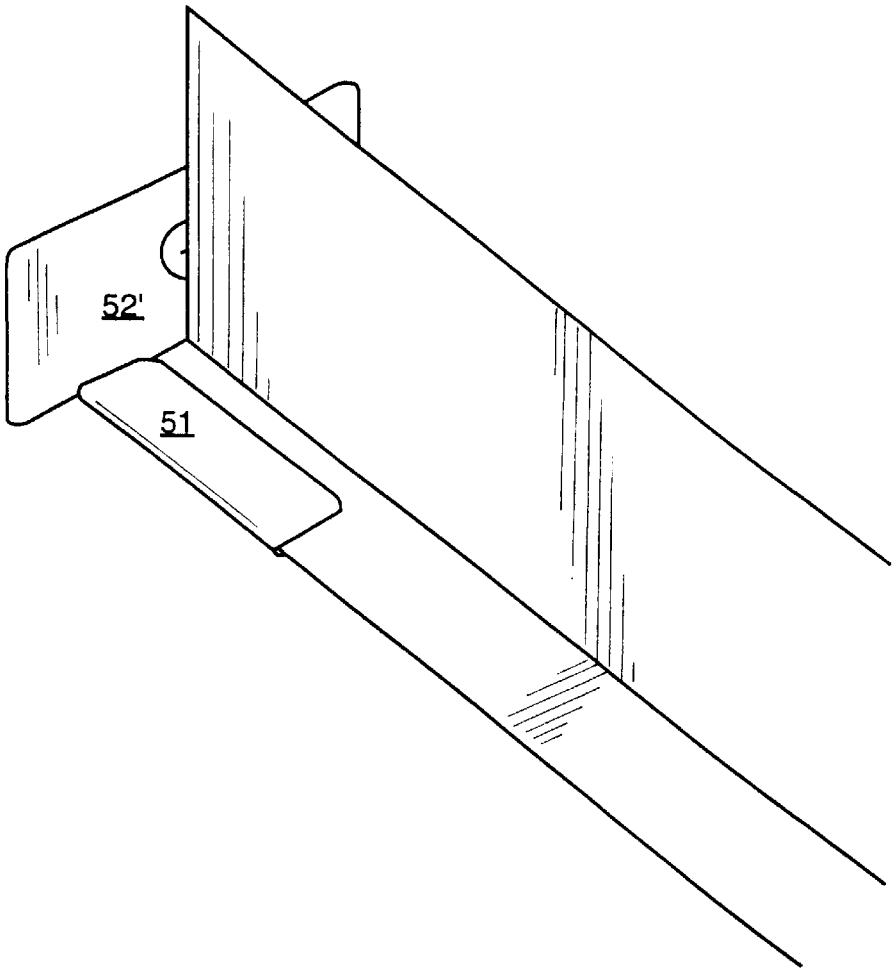
Figure 30:
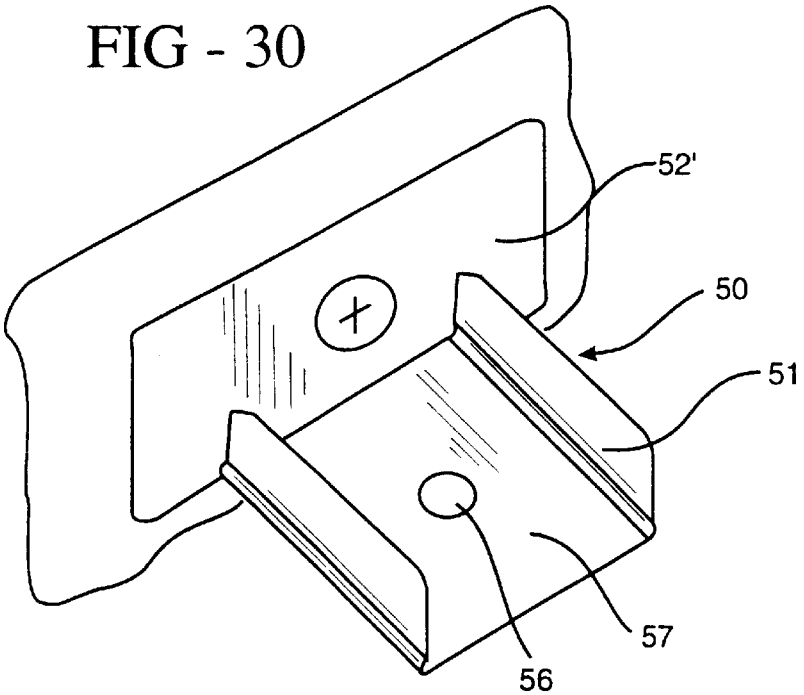
Figure 31A:
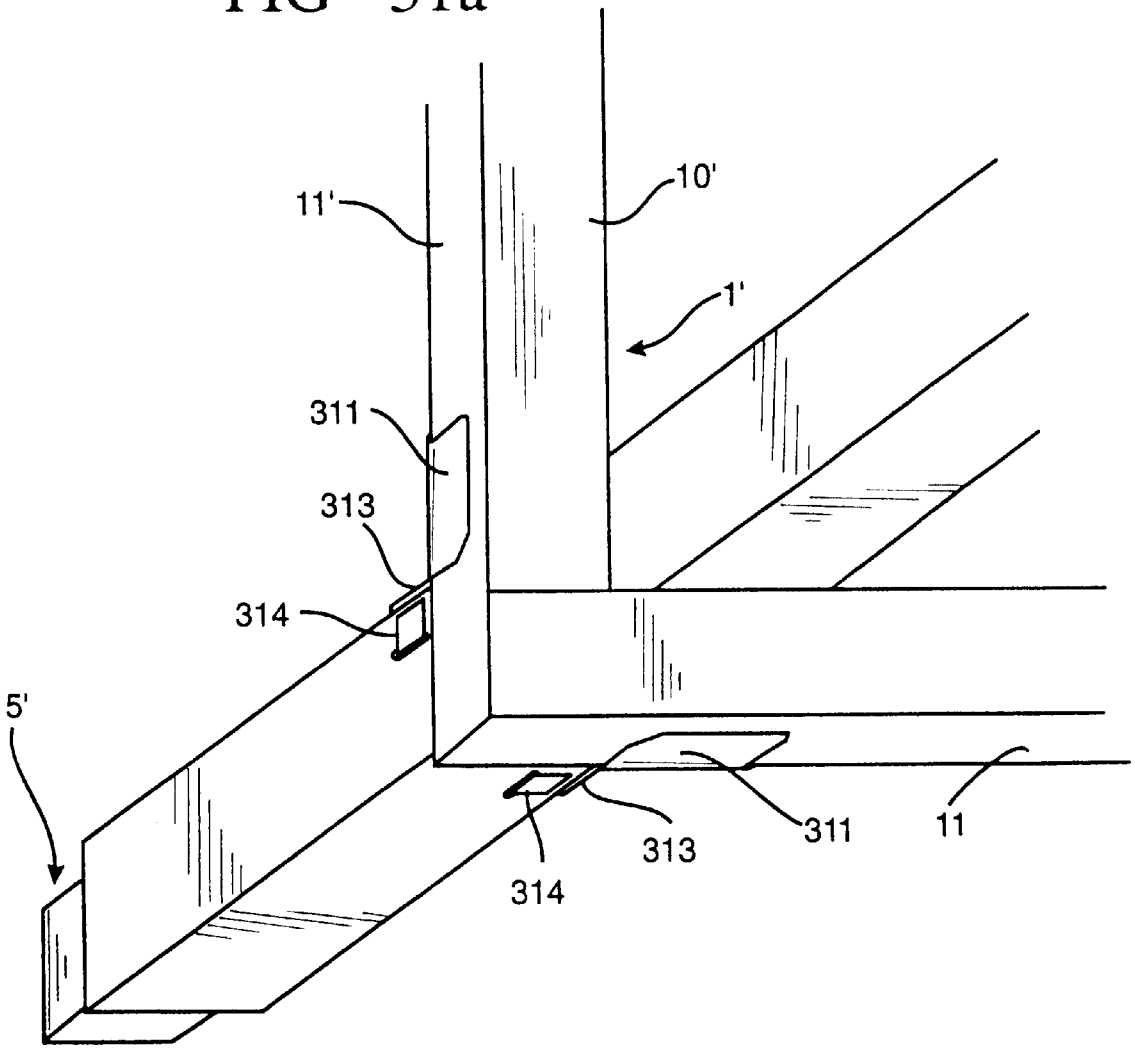
Figure 31:
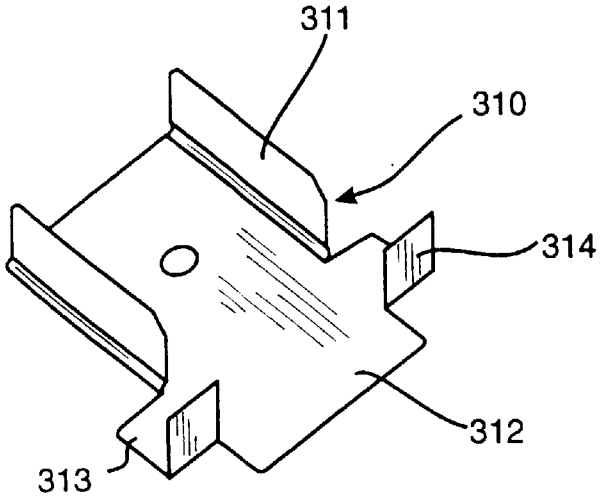
Figure 32A:
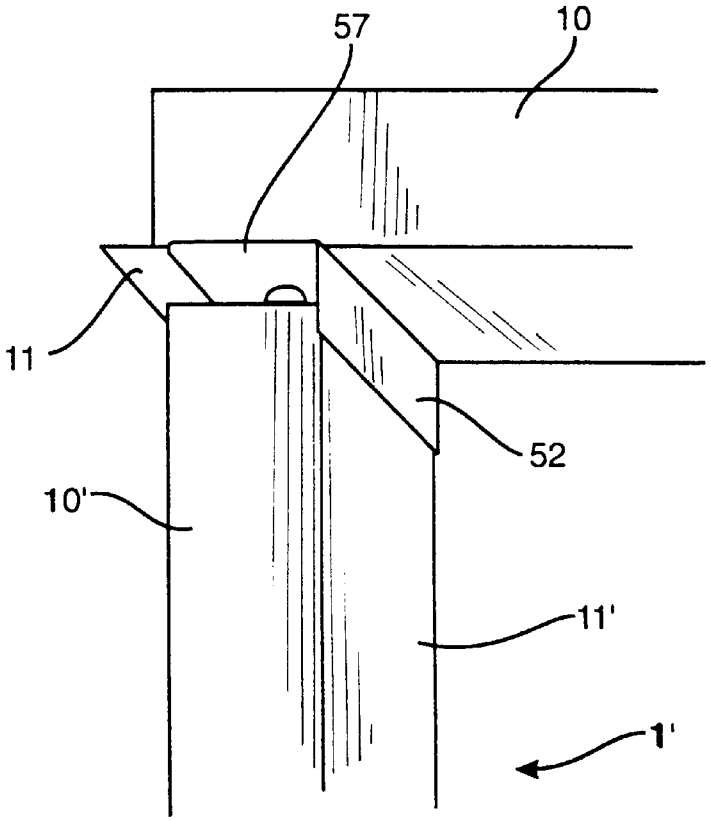
Figure 32:
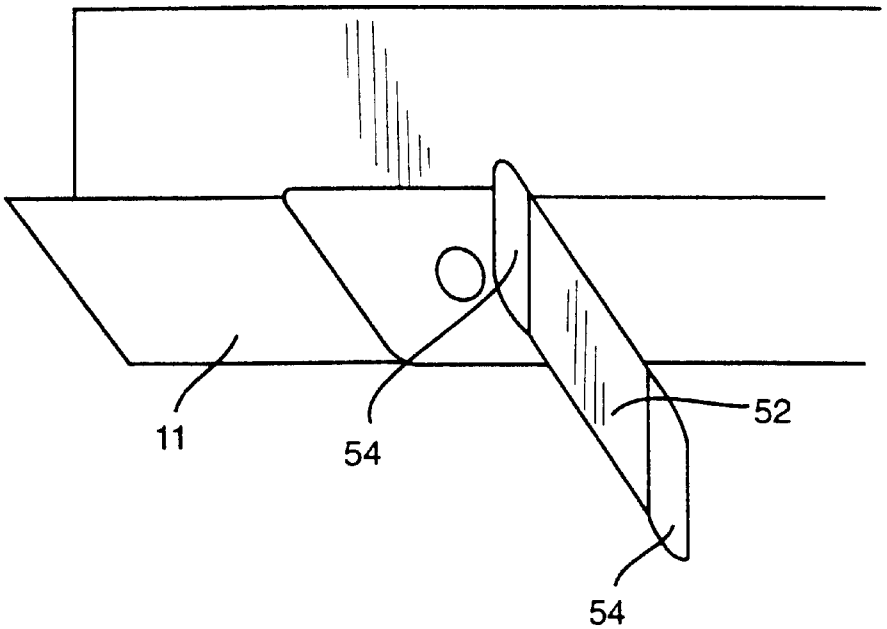
Figure 33:
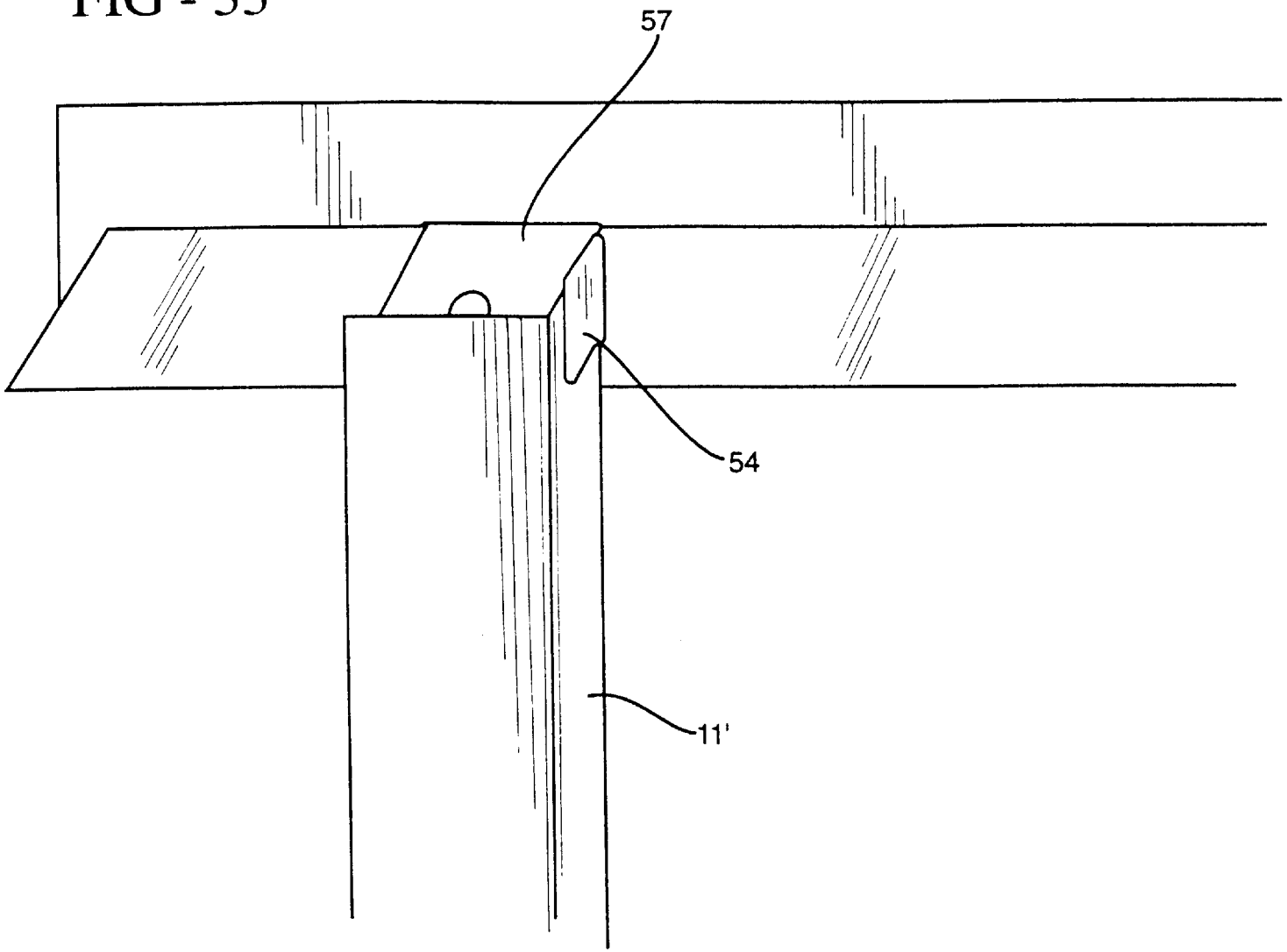

FIG. 15*a* is a top plan view, of the connector shown in FIG. 15;

FIG. 15*b* is a perspective view of the connector of FIGS. 15 and 15*a* in use illustrating the "herring-bone" effect;

FIG. 16 is a perspective view, of a thirteenth embodiment of connector for location on a T-bar;

FIG. 16*a* is a perspective view, of the connector of FIG. 16 in use holding a UPVC panel to a T-bar;

FIG. 17 is a perspective view of a fourteenth embodiment of connector similar to that of FIG. 16;

FIG. 17*a* is a perspective view from below of the connector of FIG. 17 in use;

FIG. 18 is a perspective view of the first connector clipped onto a C-channel which may be supplied with the connector;

FIG. 19 is a perspective view of a baton system adapted for use with the first connector;

FIG. 20 is a perspective view of a profile connector for use with perimeter profiles in accordance with a further aspect of the present invention;

FIG. 21 is a perspective view of an alternative embodiment of profile connector;

FIGS. 22*a* and 22*b* is a perspective view of a pair of further alternative embodiments of profile connectors;

FIGS. 22*c* and 22*d* are perspective views of the profile connector in use with two alternative types of starting profiles;

FIG. 23 is a perspective view of either of the profile connectors of FIGS. 22*a* and 22*b* in use with an intermediate or centre join section profile;

FIG. 24 shows the profile connectors of FIGS. 22*a* and 22*b* fixed to a T-bar for connecting to a profile such as that shown in FIG. 23;

FIGS. 25*a* to 25*c* are perspective views of perimeter profile connectors;

FIG. 25*d* shows the perimeter profile connectors of FIGS. 25*a* to 25*c* in use, holding a profile in place;

FIG. 25*c* and FIG. 25*f* shows another embodiment of perimeter profile connector in use with an angle trim;

FIG. 26 is a perspective view from below of a first connector inserted in a joint profile and holding the joint profile in place across a ceiling grid;

FIG. 27 is a perspective view of a first connector holding an internal profile in place;

FIG. 28 is a perspective view of the first connector holding an external corner profile in place;

FIG. 29 is a perspective view showing the connector of FIG. 1 holding an end or perimeter profile in place on a T-bar;

FIGS. 30 and 30*a* shows the use of a modified first connector in an alternative arrangement in which the connector tongue is pushed upwardly and can perform the function of a perimeter profile;

FIG. 31 is a perspective view of a further modification of the connector in an alternative arrangement for supporting a bulkhead on the ceiling grid network;

FIG. 31*a* is a perspective view of the connector of FIG. 31 in use;

FIG. 32 is a perspective view from below of a first connector attached to a first element of a bulkhead;

FIG. 32*a* is a perspective view similar to that of FIG. 32 in which the connector is further attached to a second element of a bulkhead;

FIG. 33 is an alternative perspective view of the arrangement of FIG. 32*a;*

Figure 34:
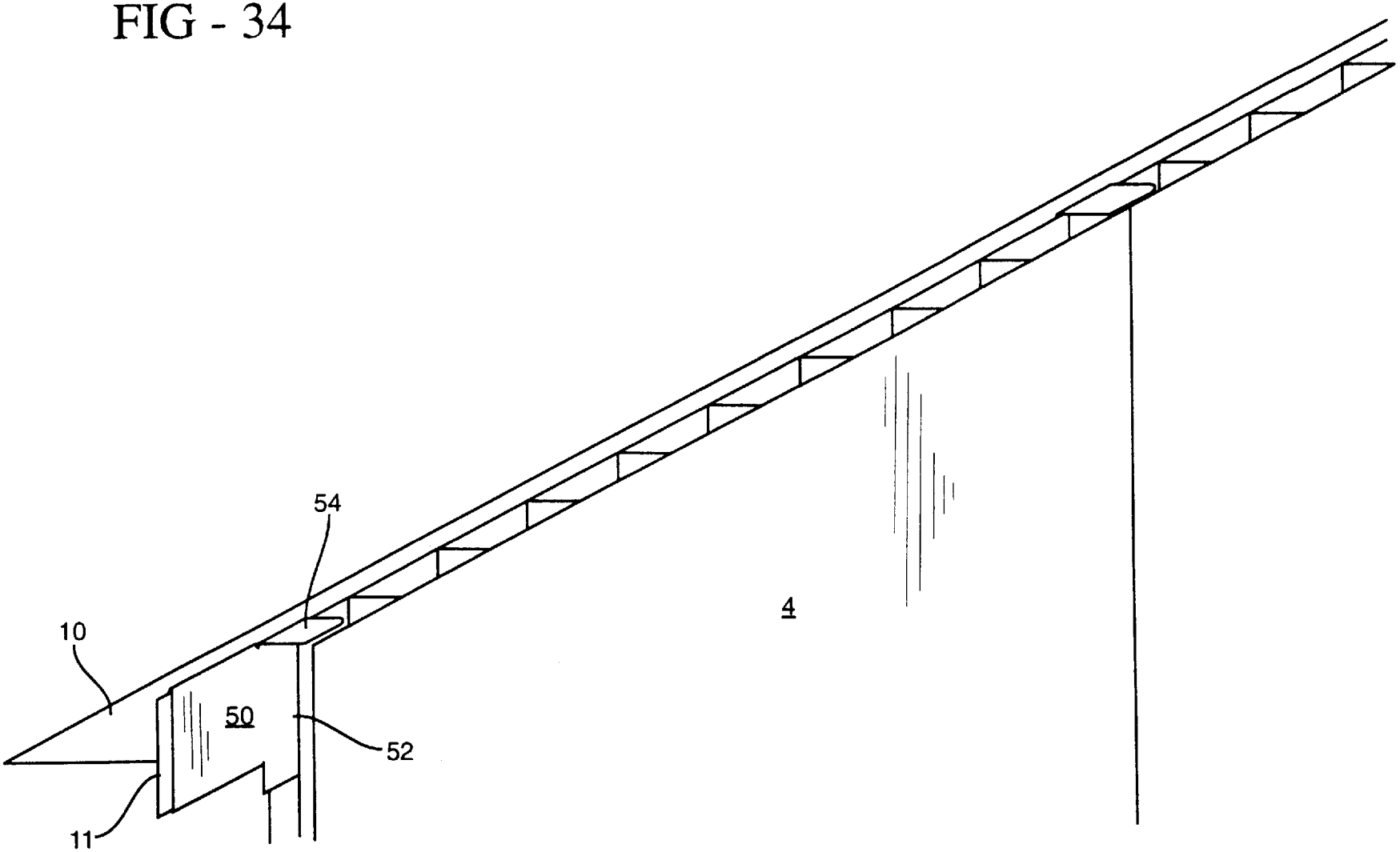
Figure 35:
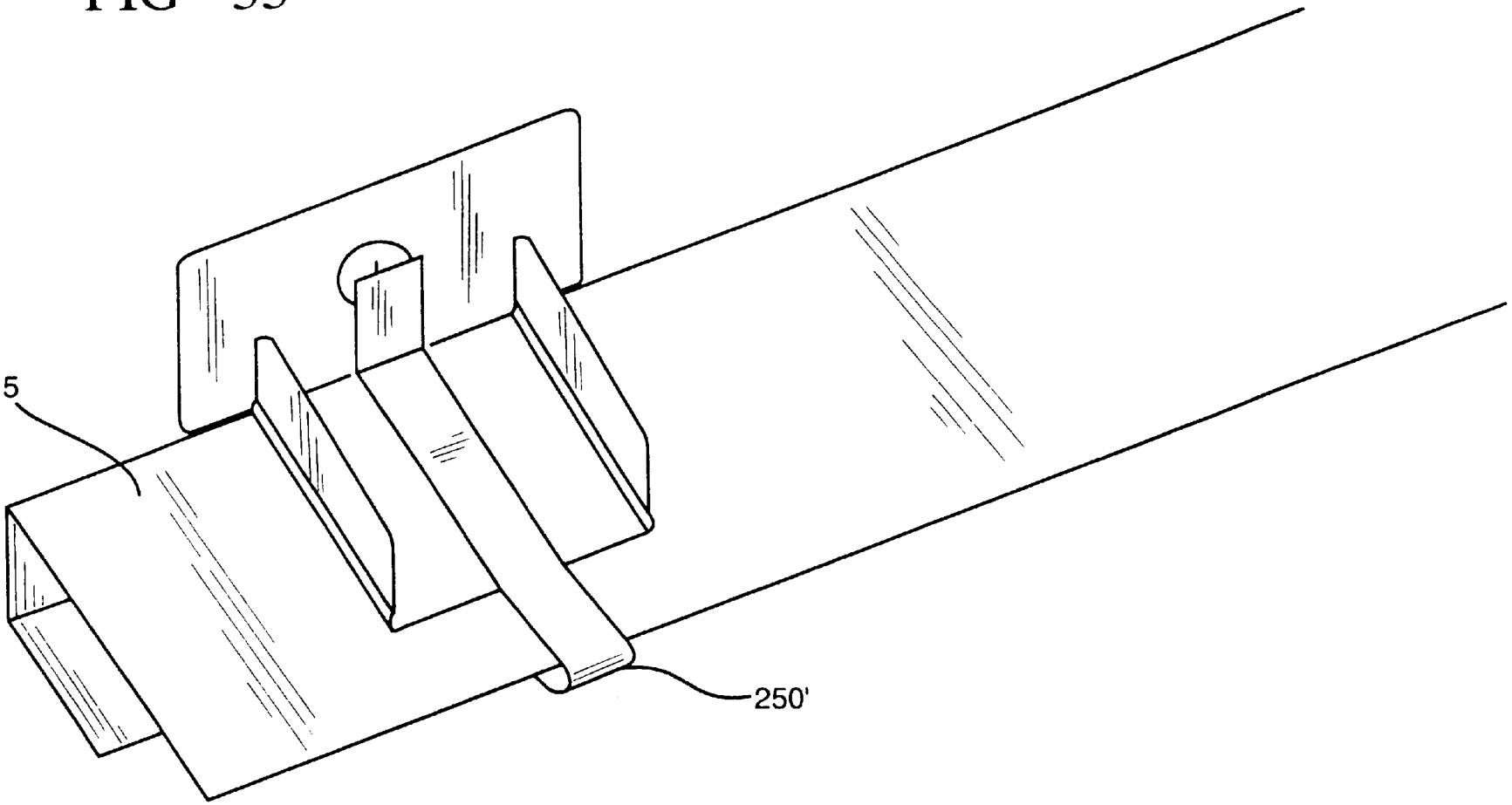
Figure 36:
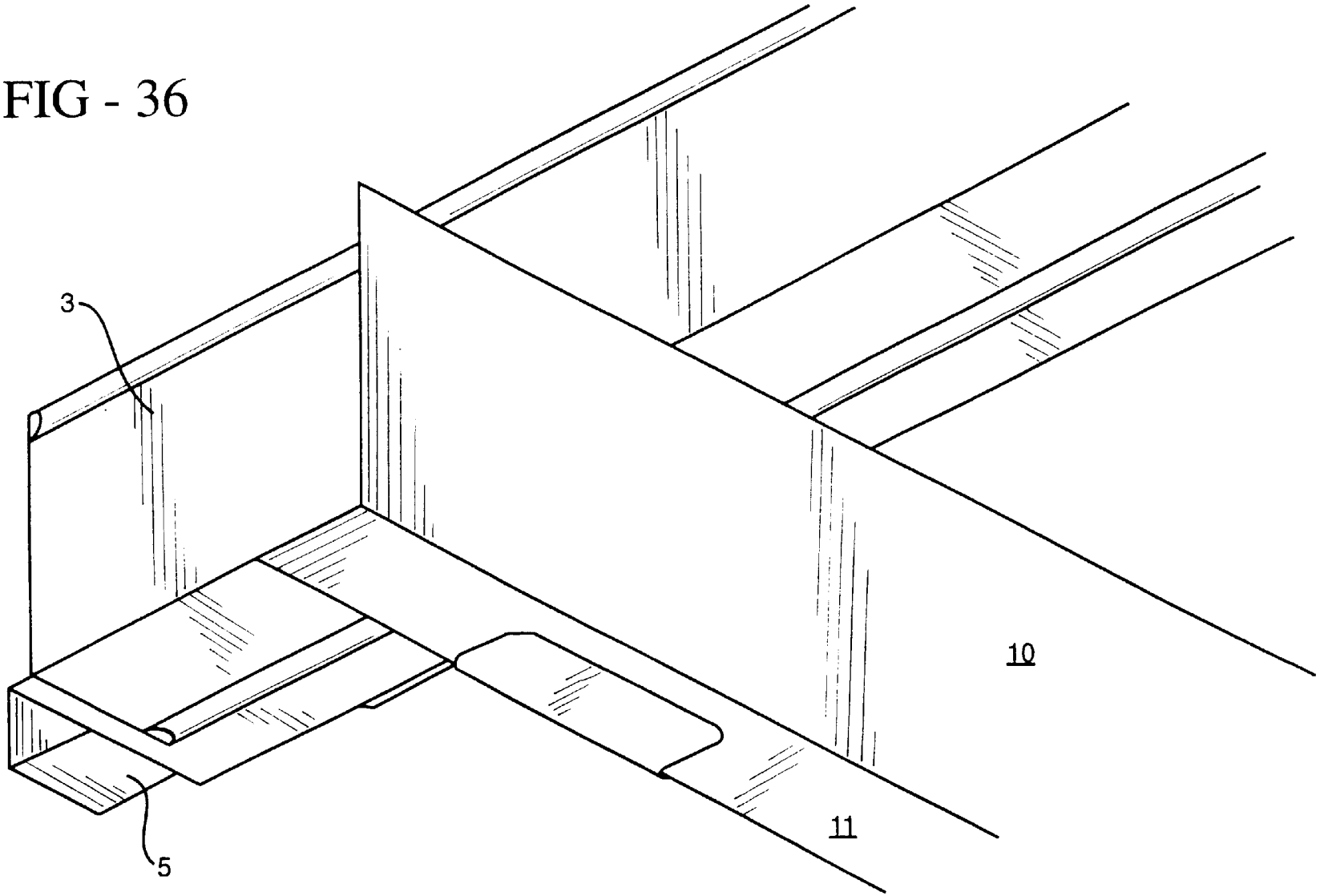
Figure 37:
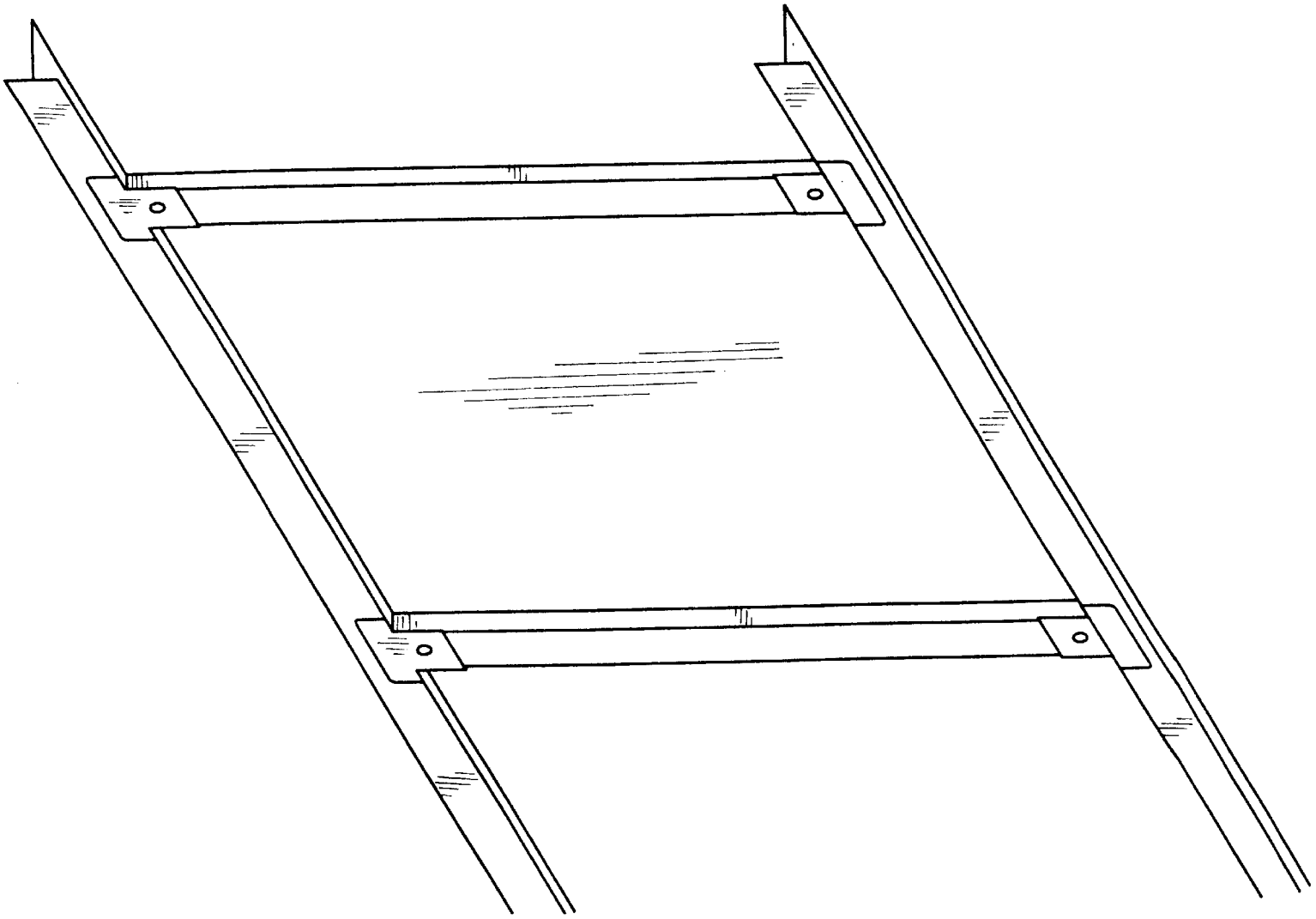
Figure 38:
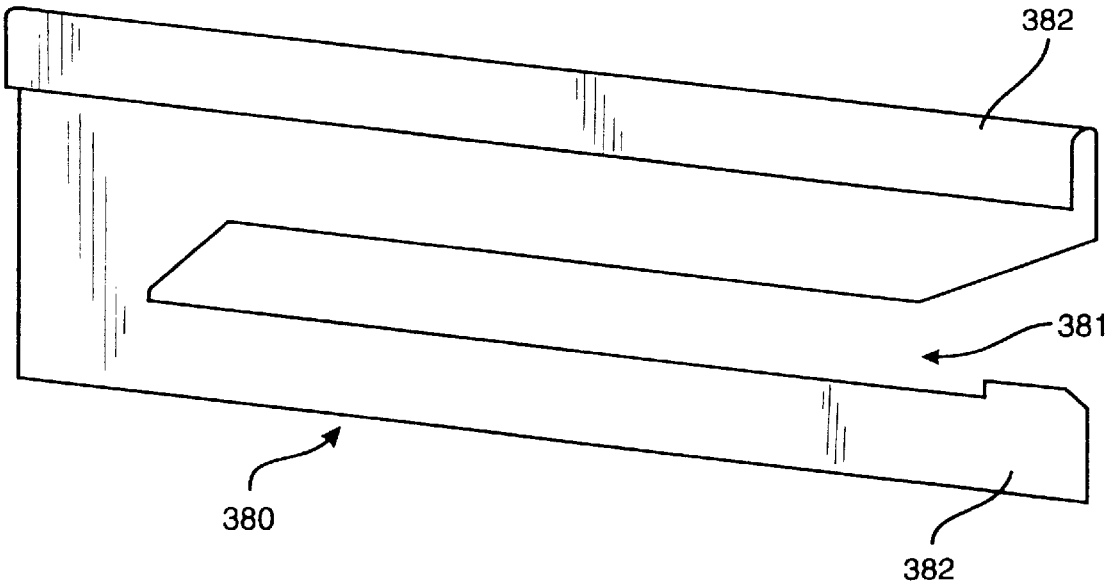
Figure 38A:
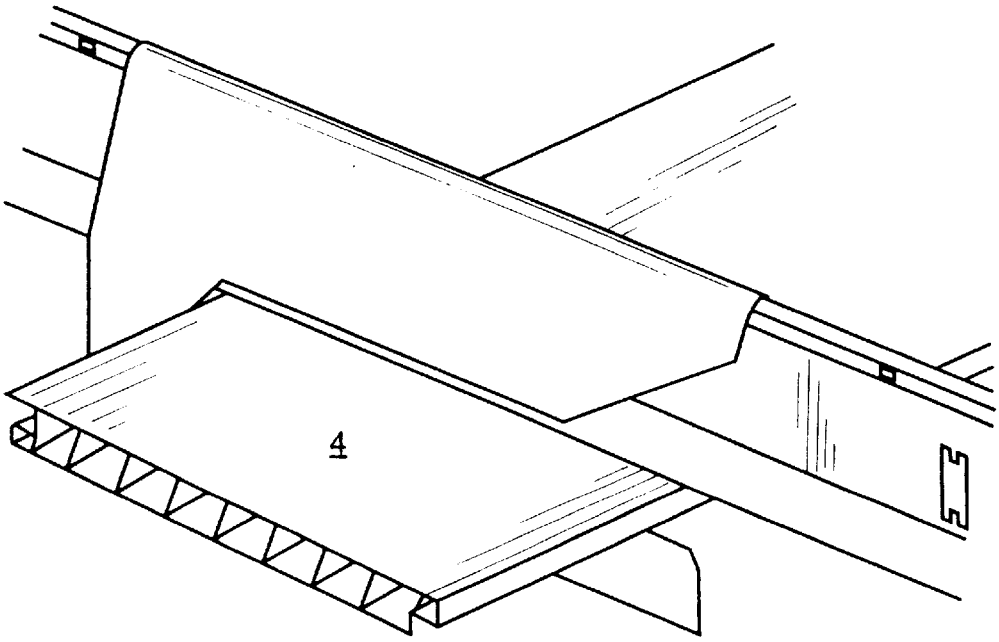
Figure 39:
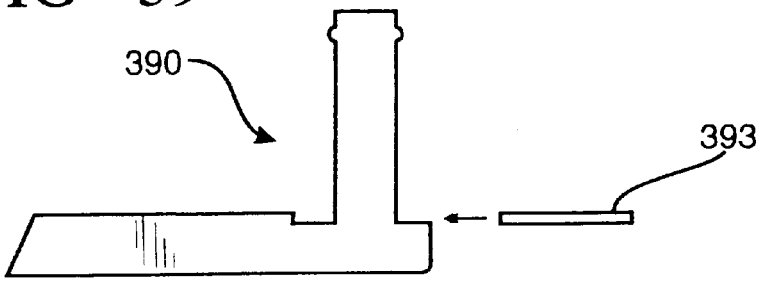
Figure 39A:
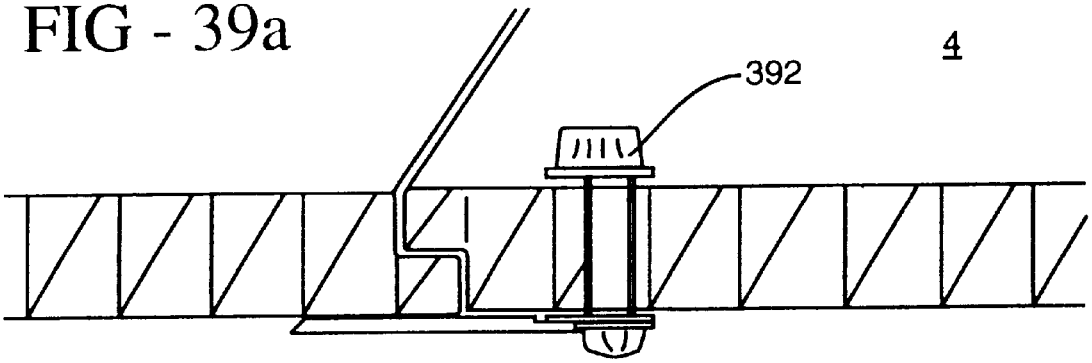
Figure 39B:
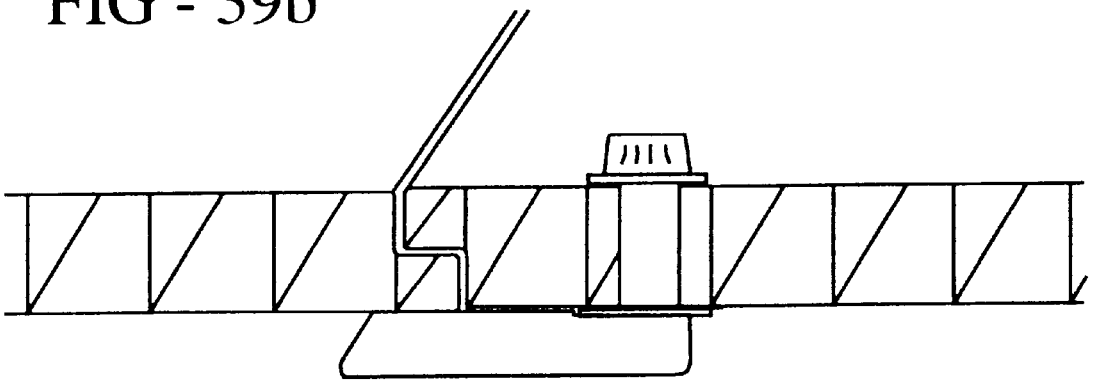
Figure 39C:
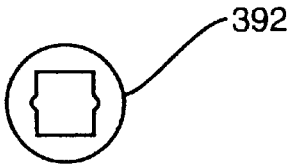
Figure 40:
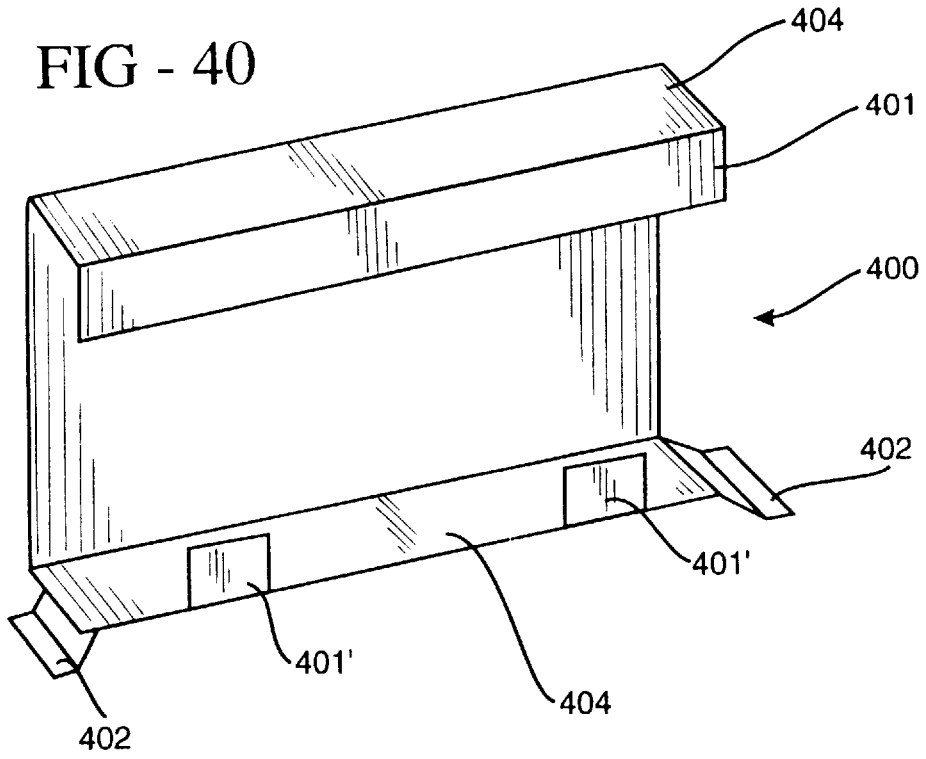
Figure 40A:
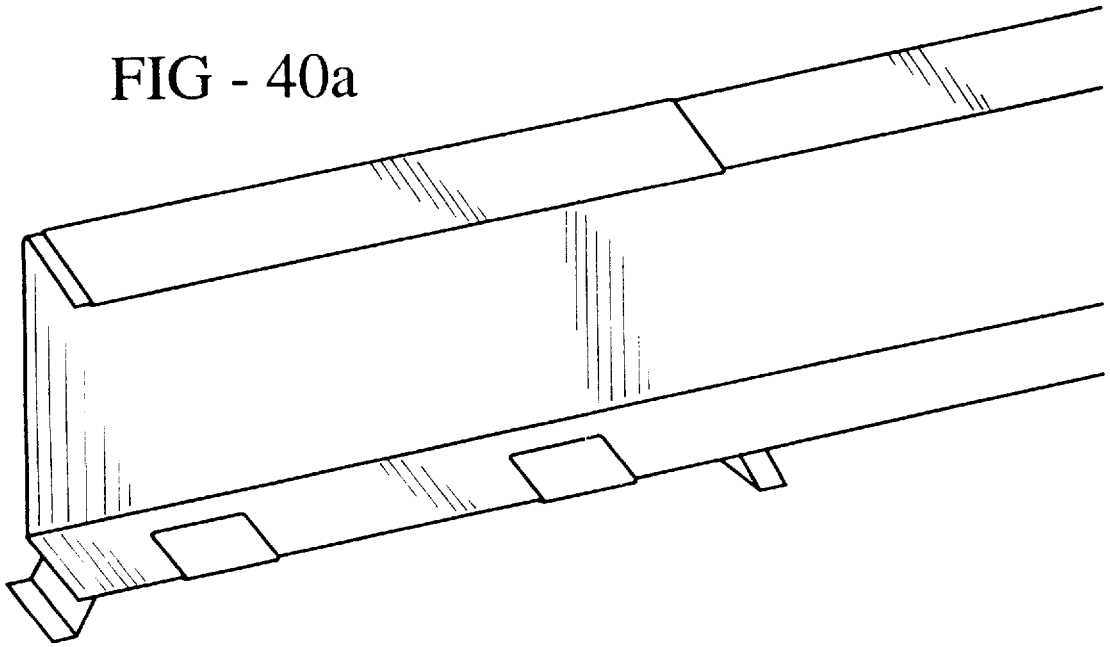
Figure 40B:
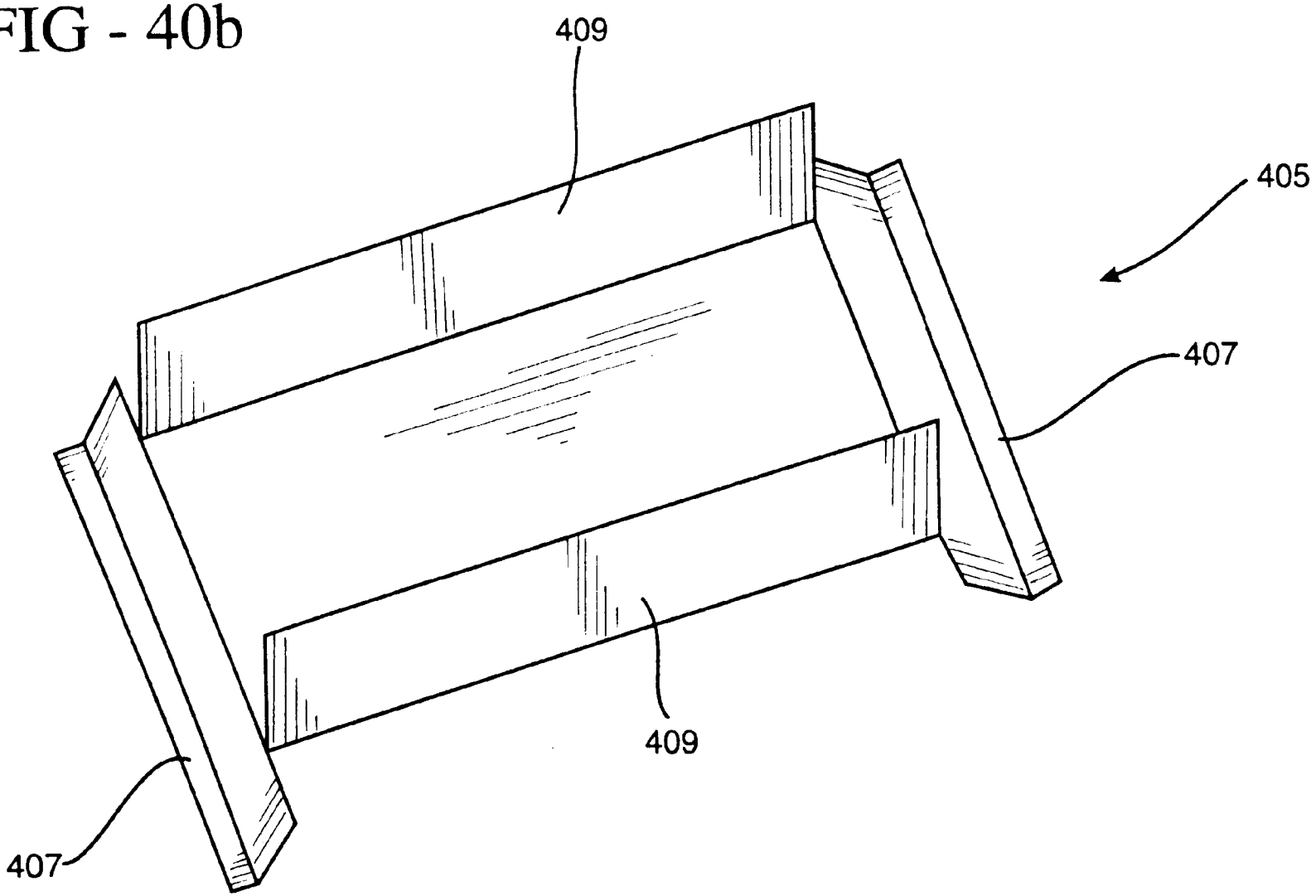
Figure 40C:
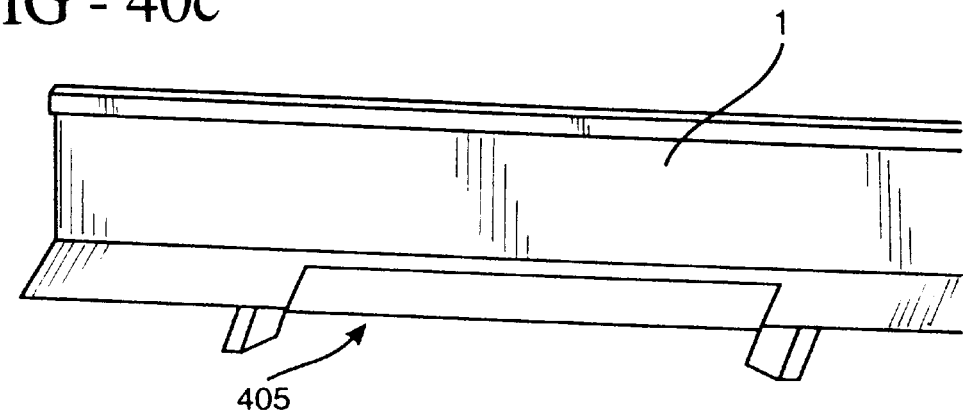
Figure 40D:
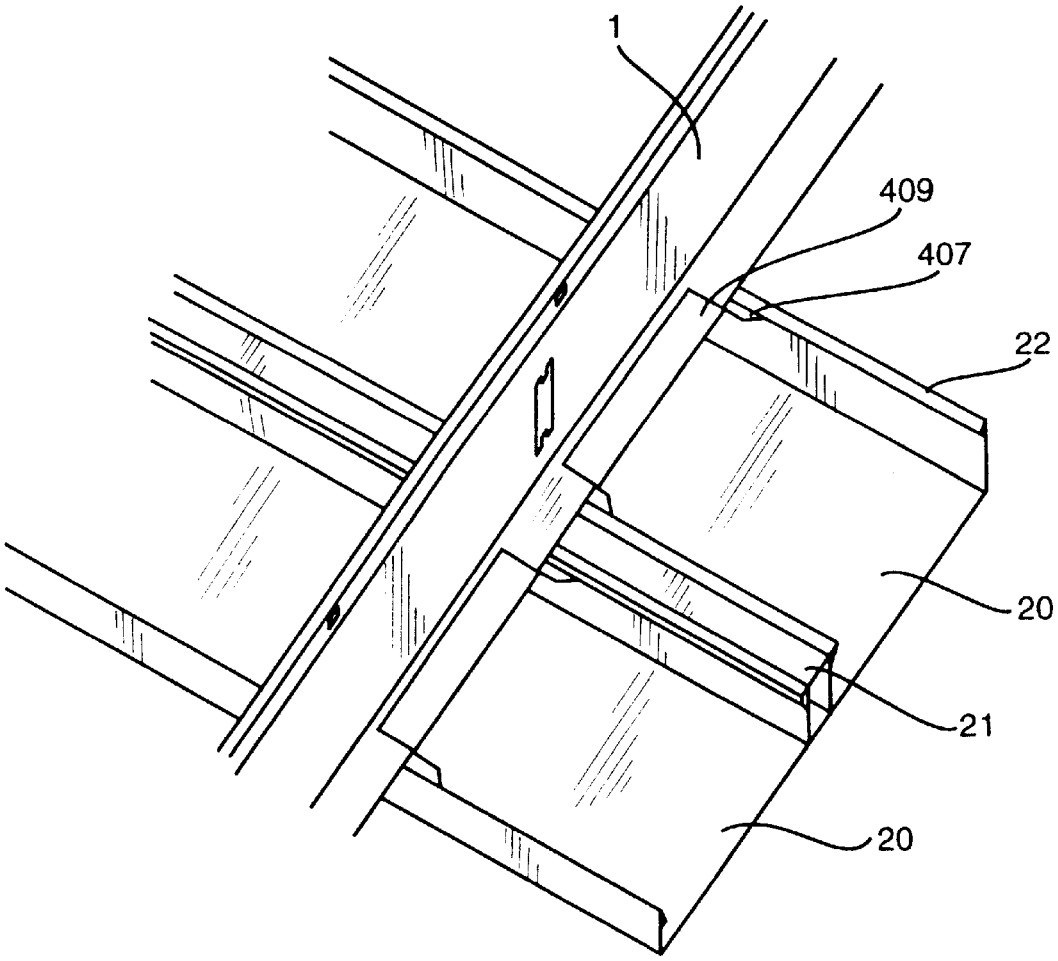
Figure 41:
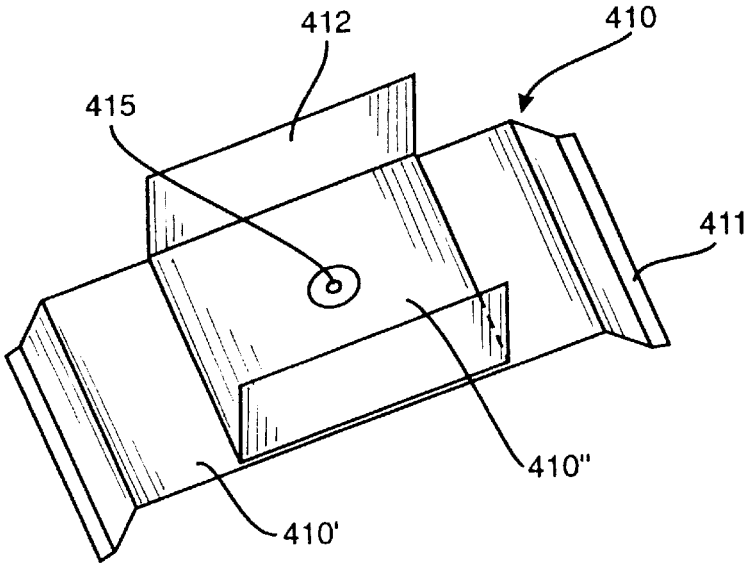
Figure 41A:
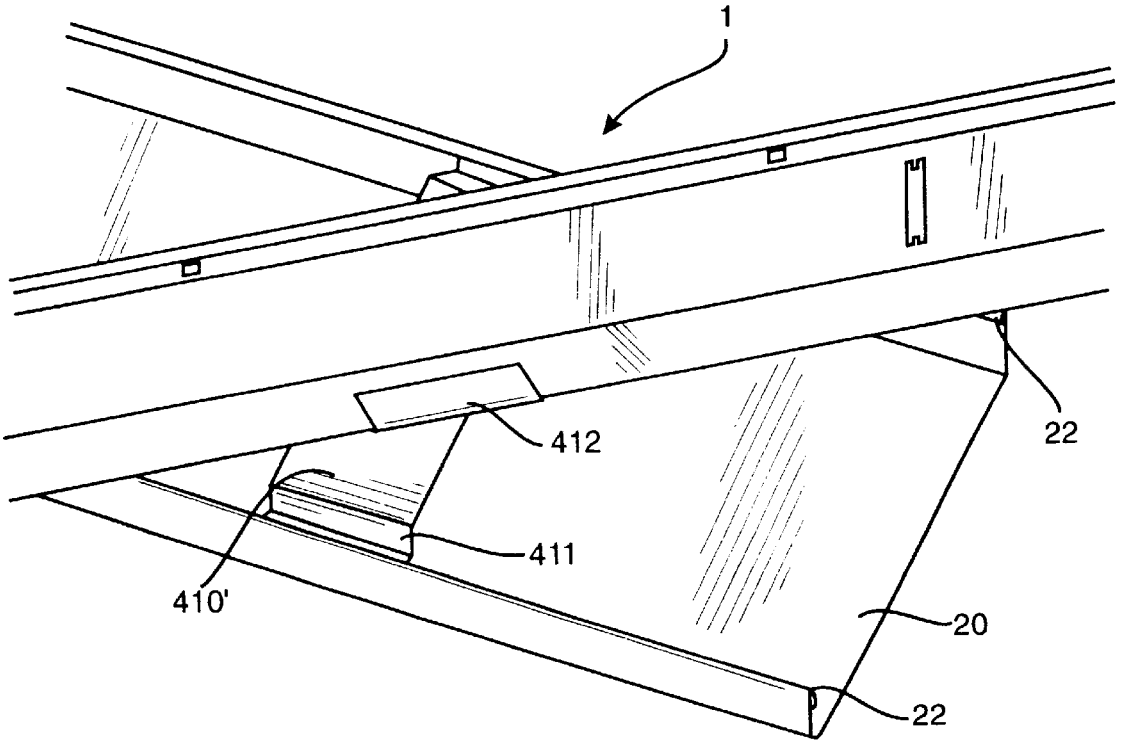
Figure 42A:
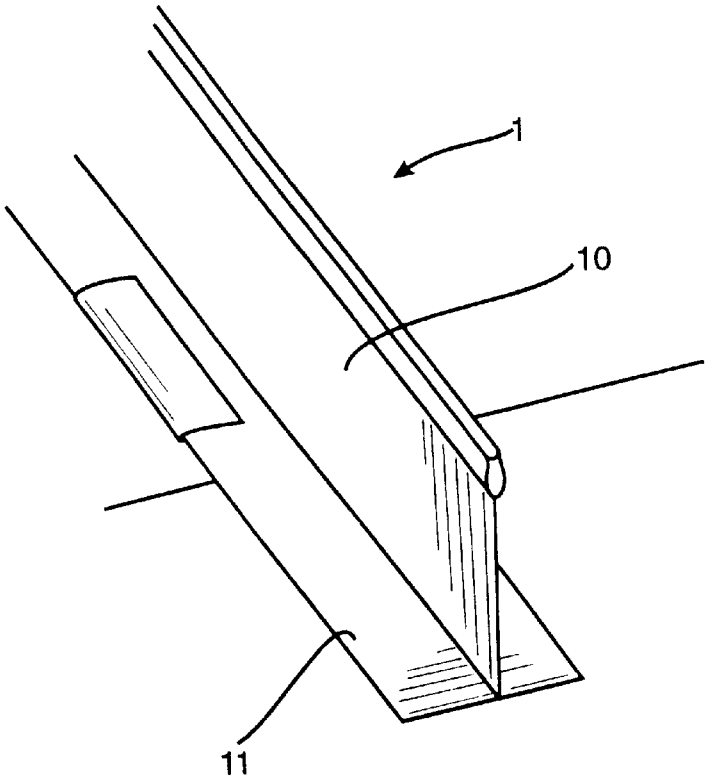
Figure 42:
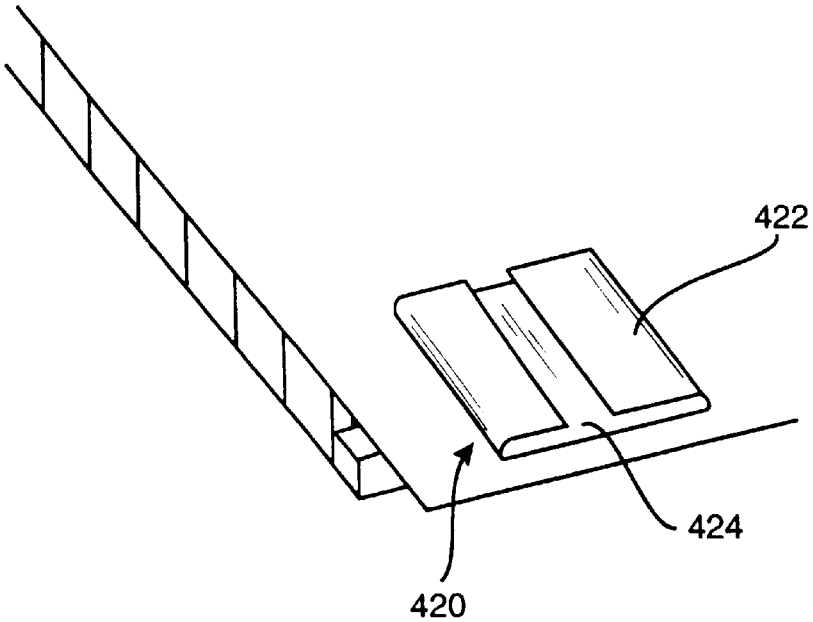
Figure 43:
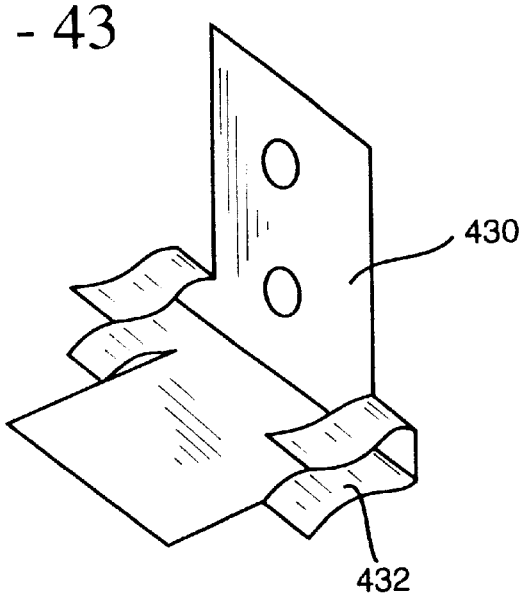
Figure 43A:
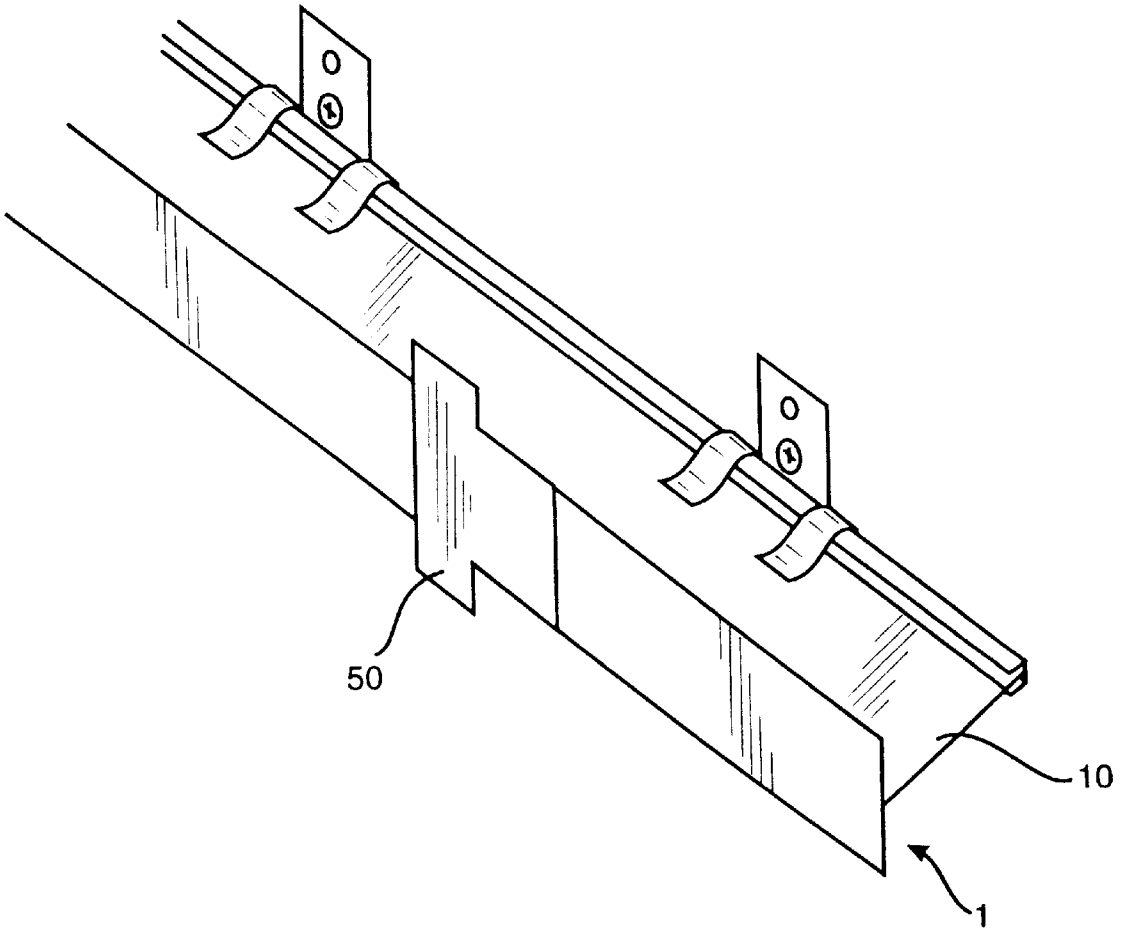
Figure 44:
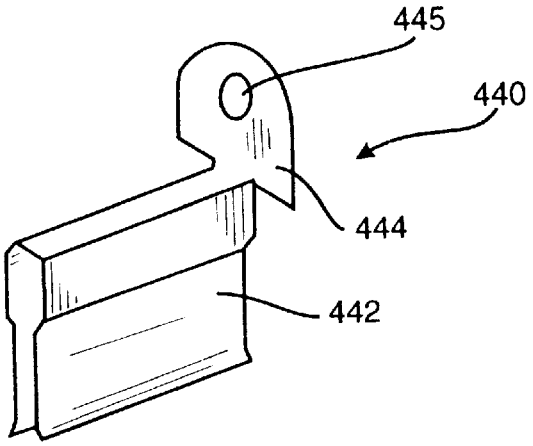
Figure 44A:
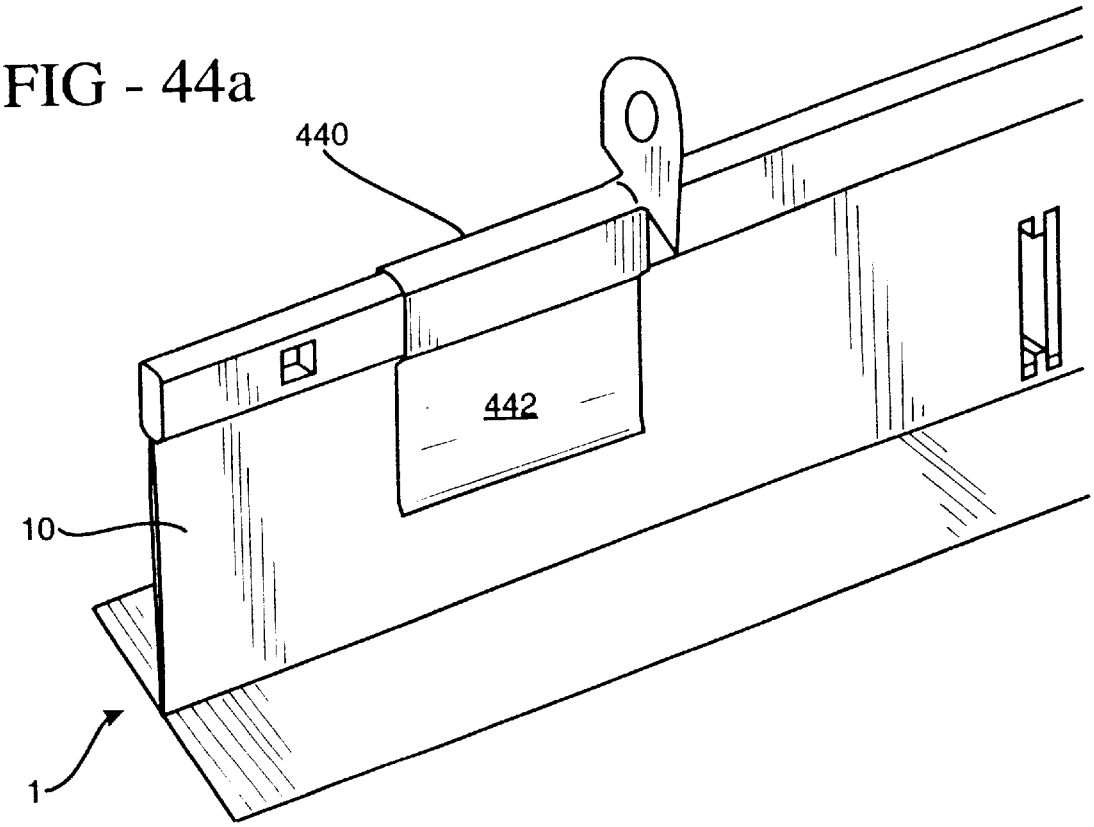
Figure 45A:
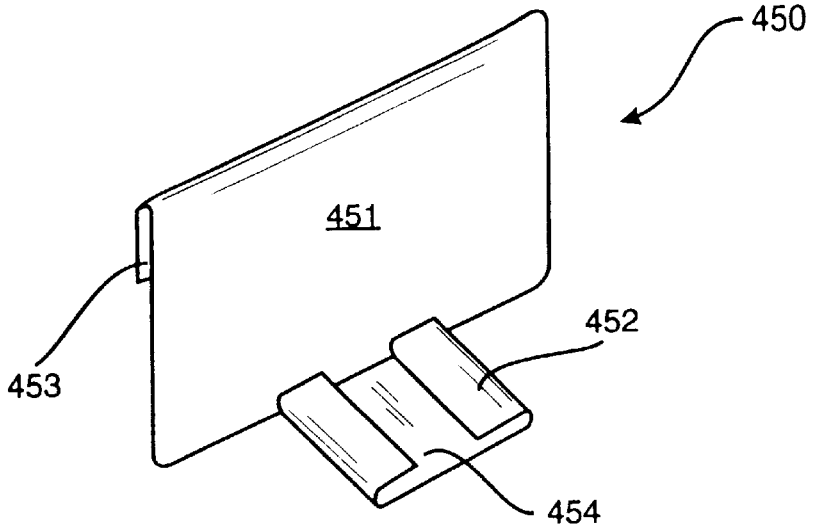
Figure 45B:
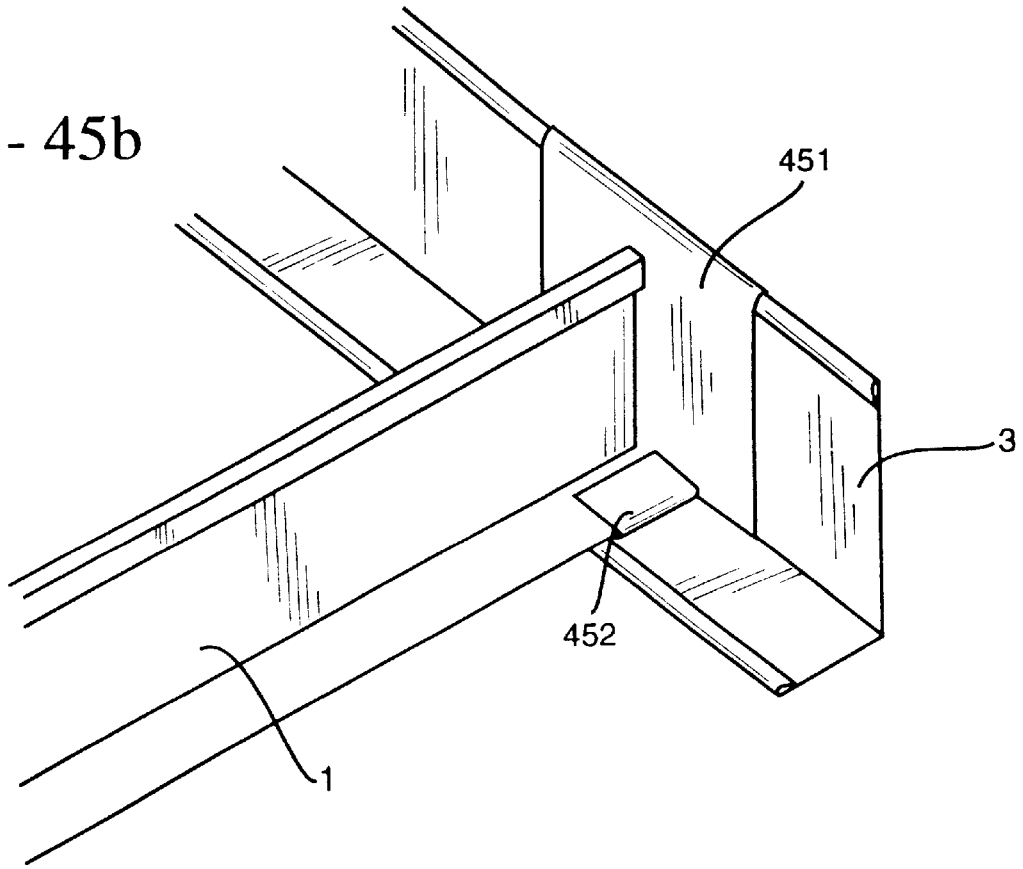
Figure 45C:
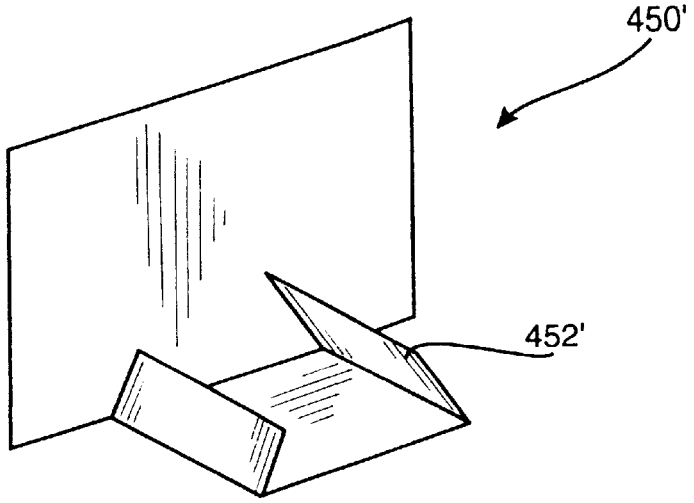
Figure 45D:
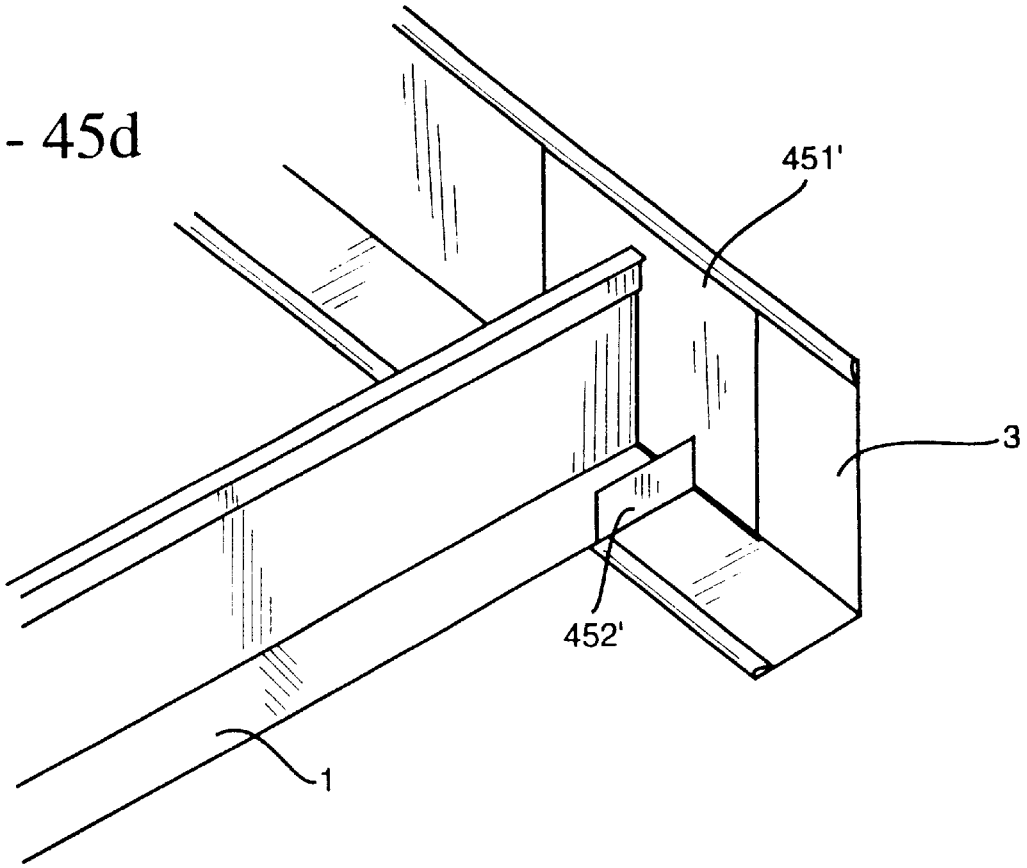
Figure 46:
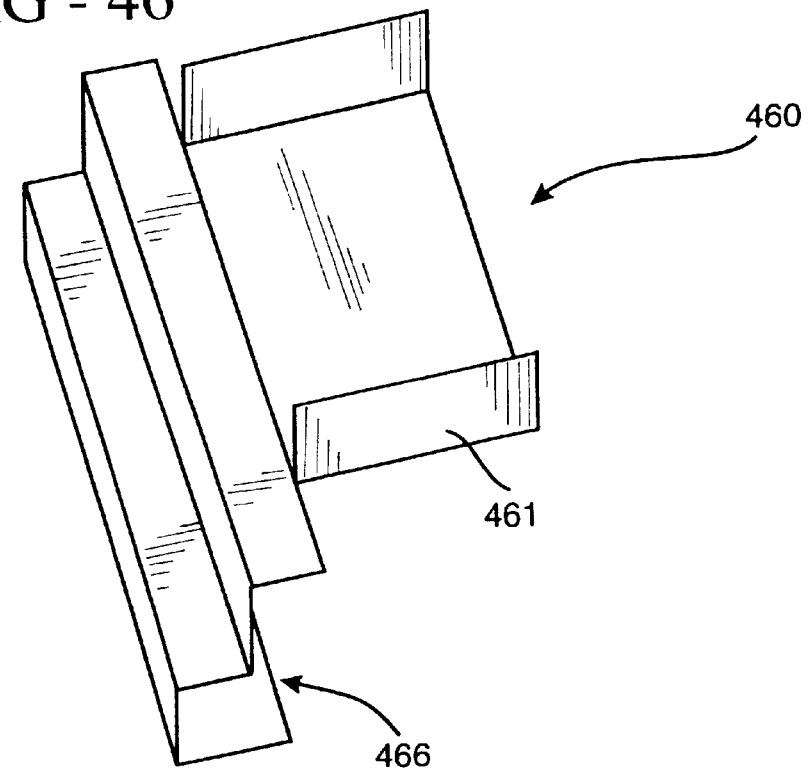
Figure 46A:
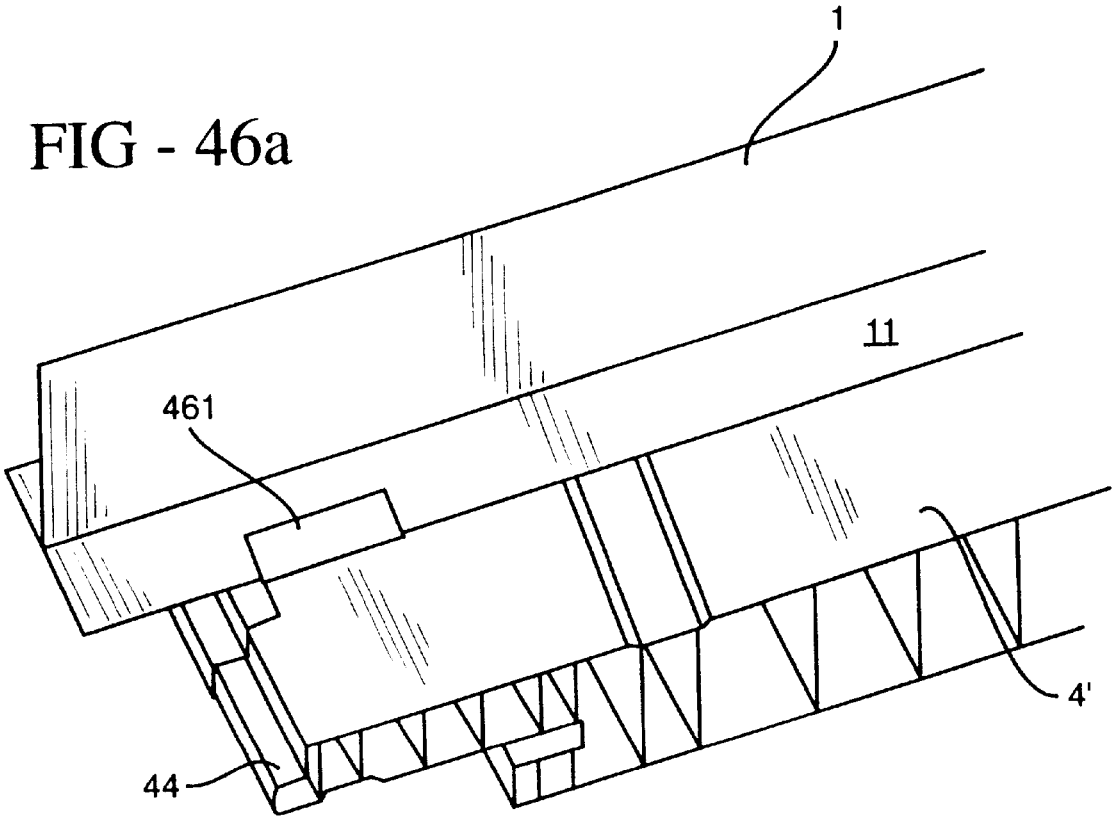
Figure 47:
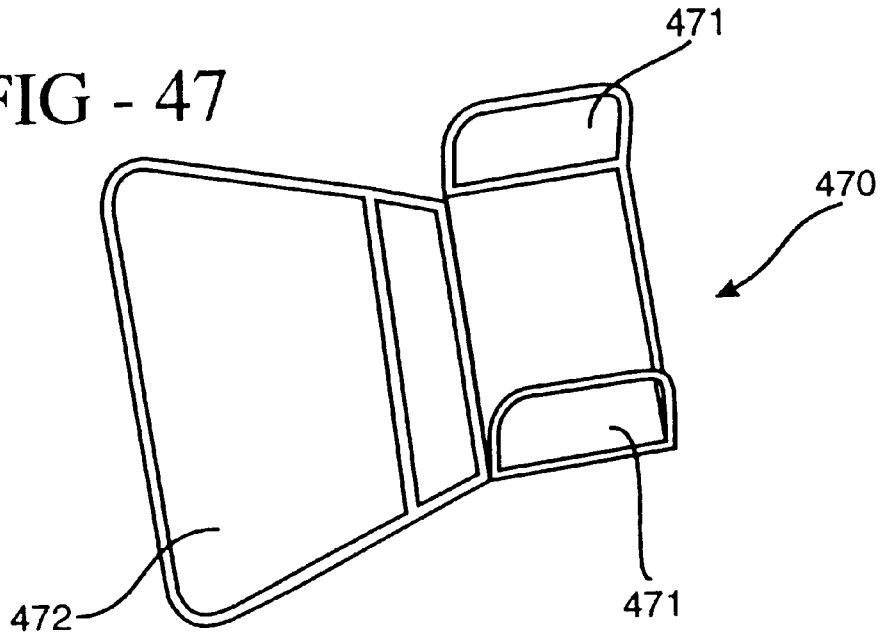
Figure 47A:
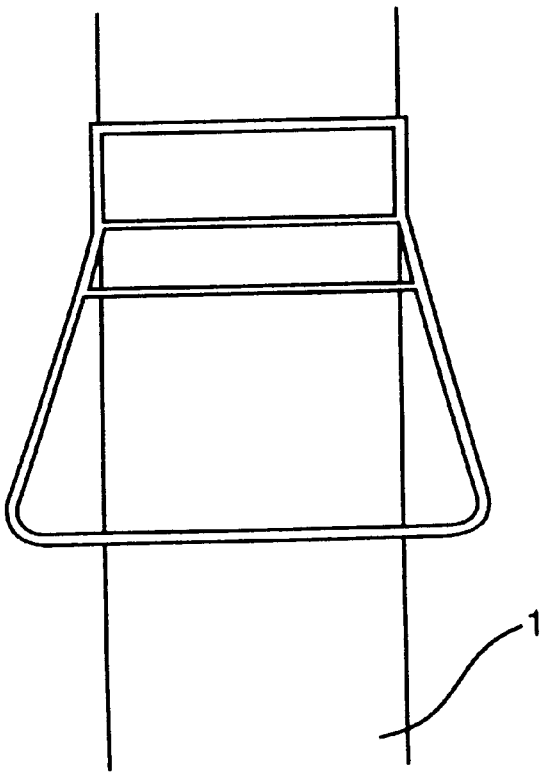
Figure 48:
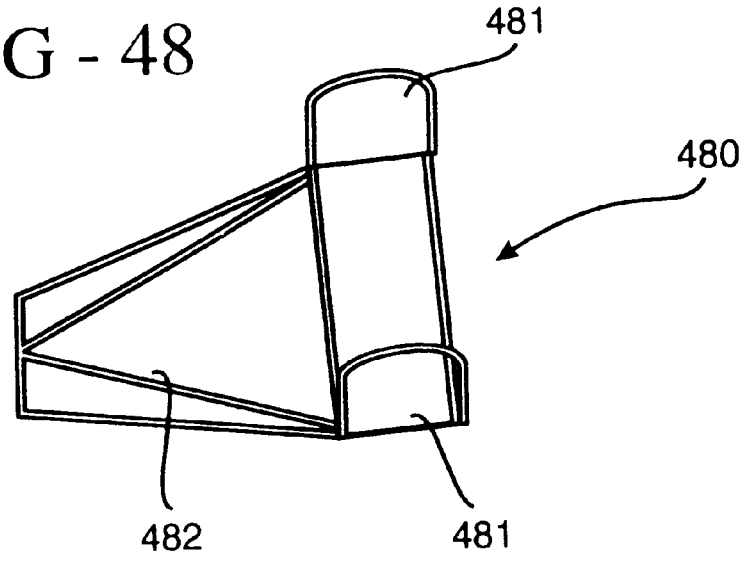
Figure 48A:
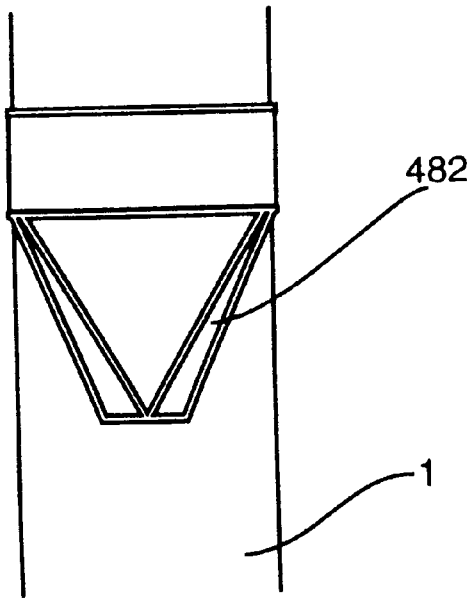
Figure 49:
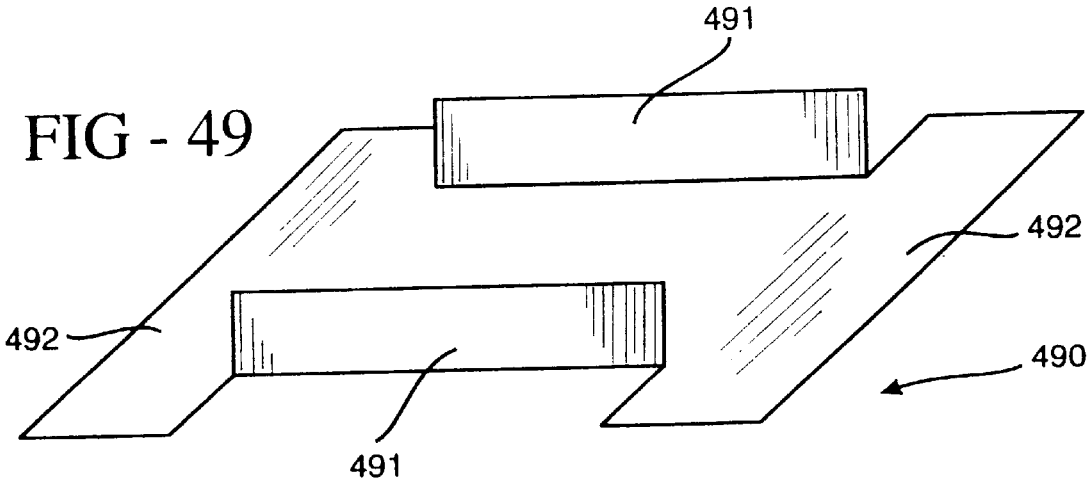
Figure 49A:
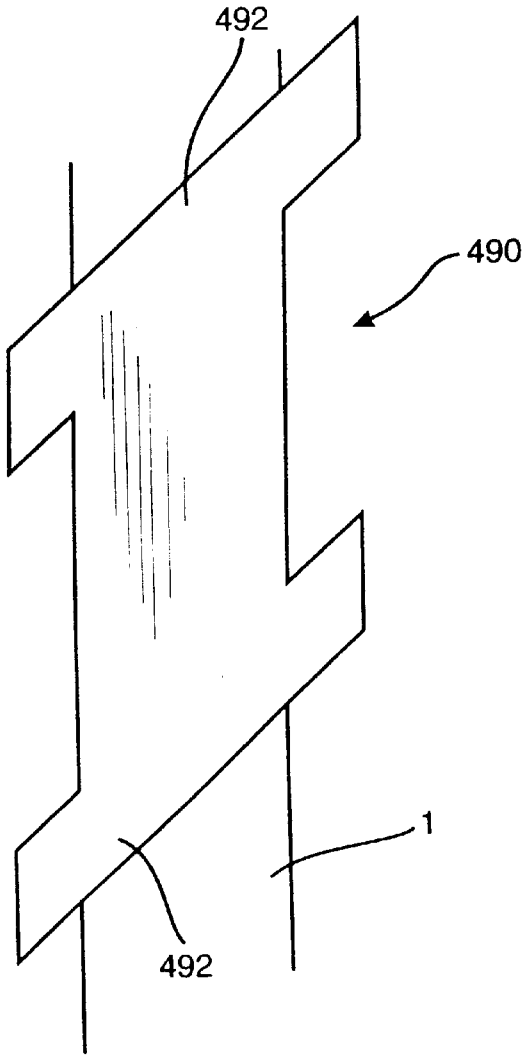
Figure 50:
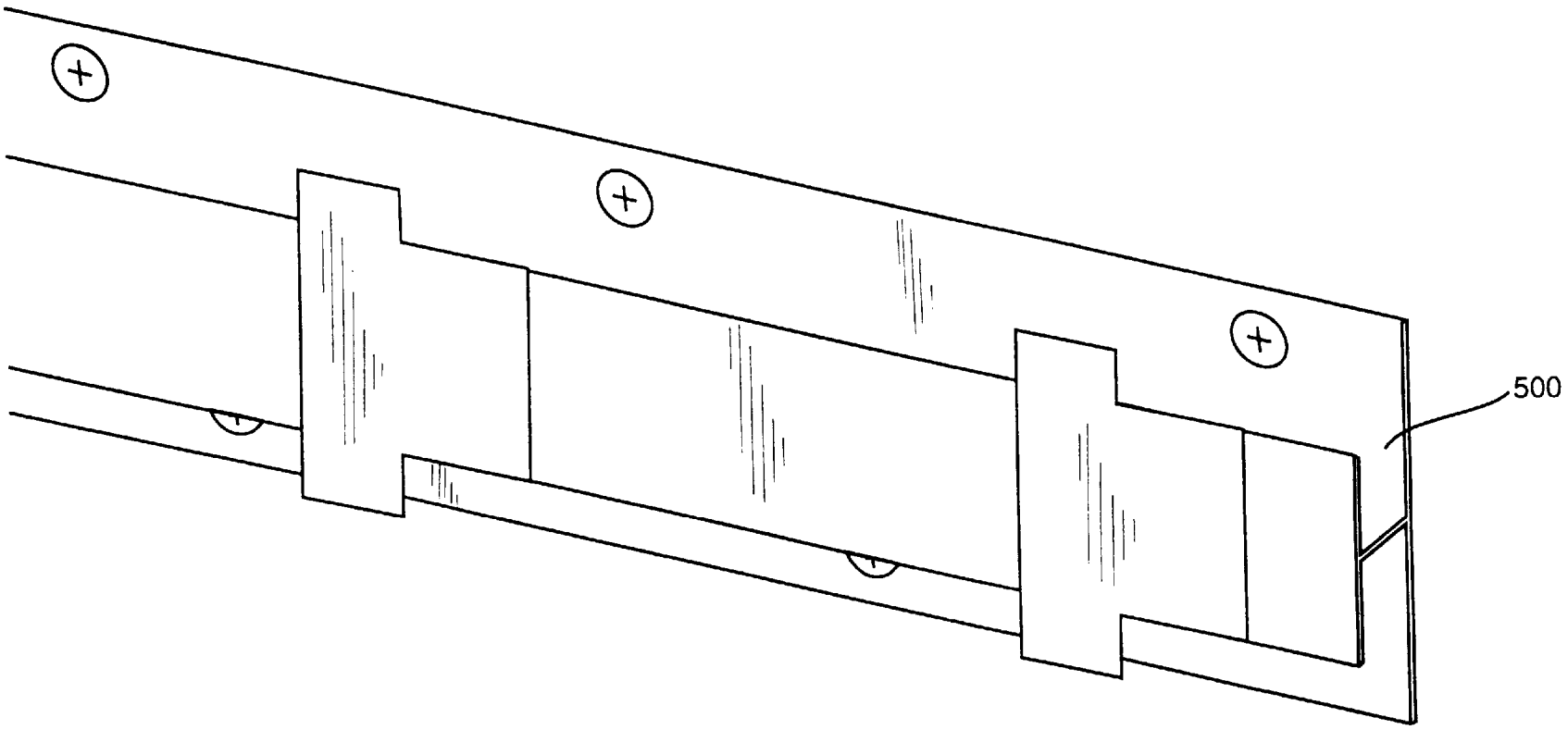
Figure 51:
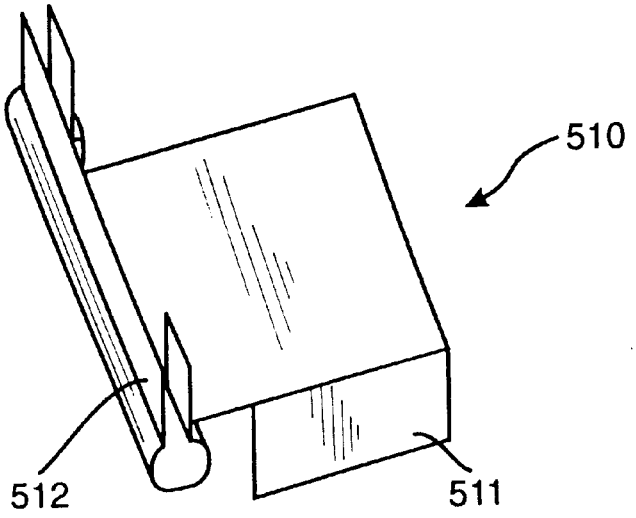
Figure 51A:
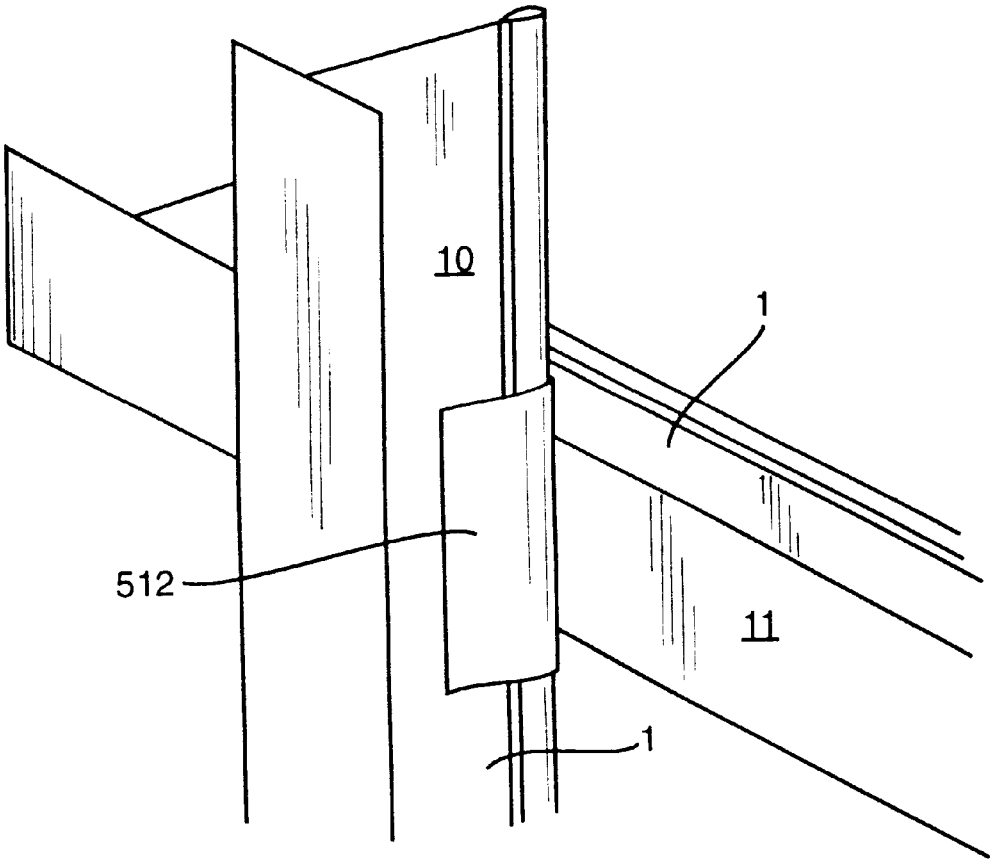
Figure 52:
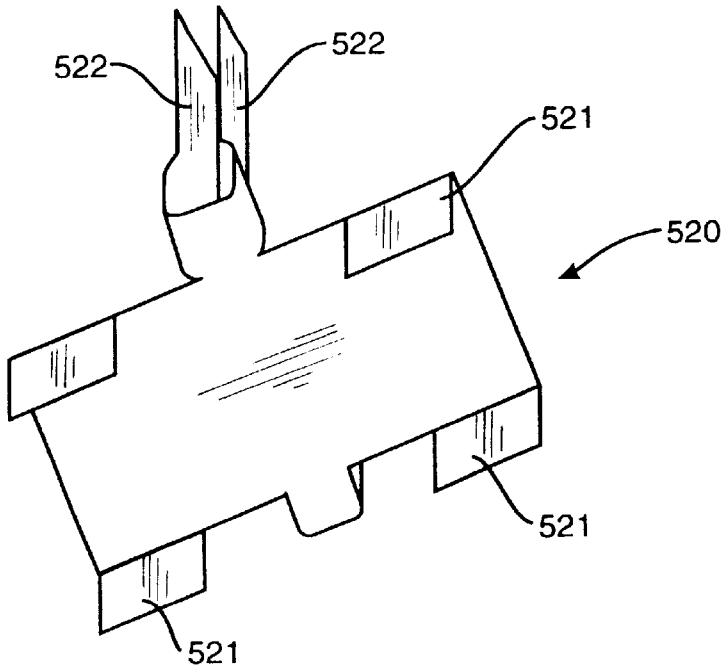
Figure 52A:
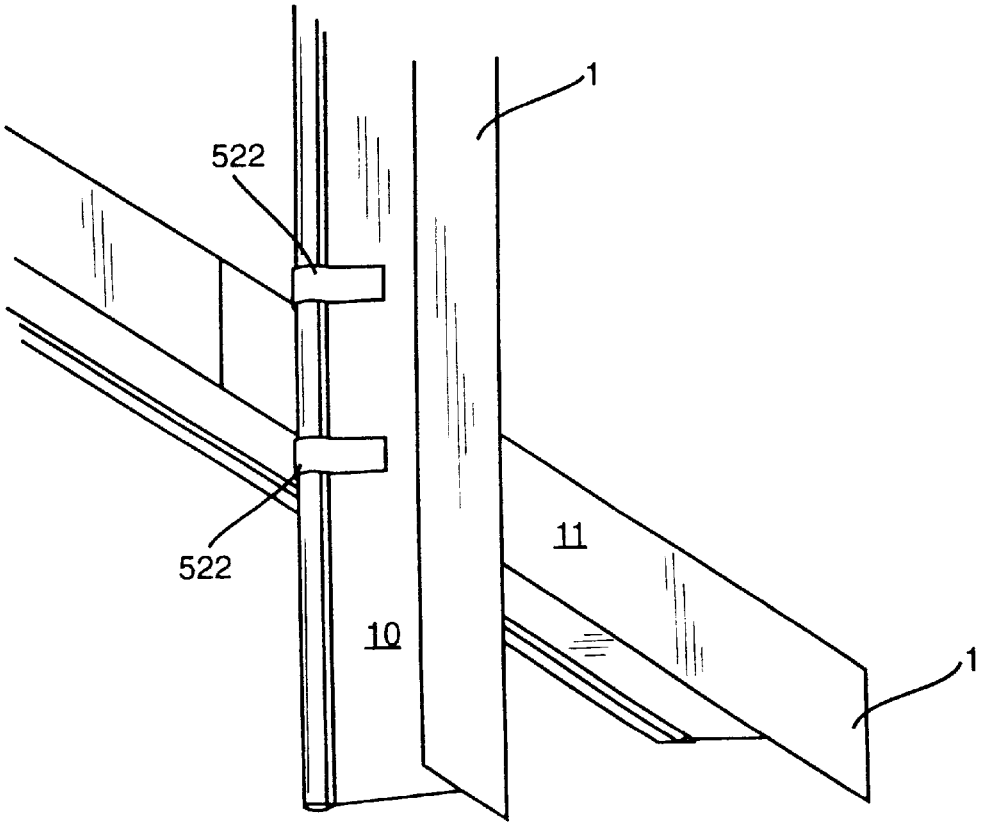
Figure 53:
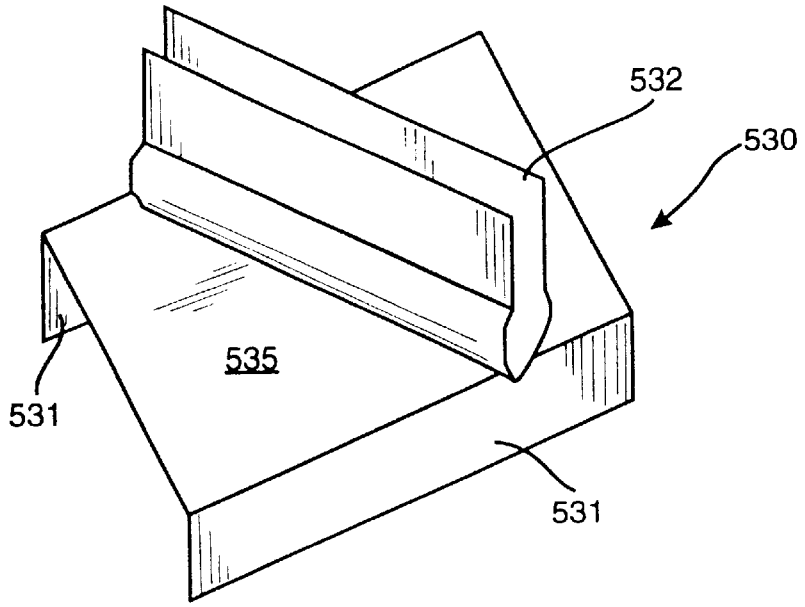
Figure 53A:
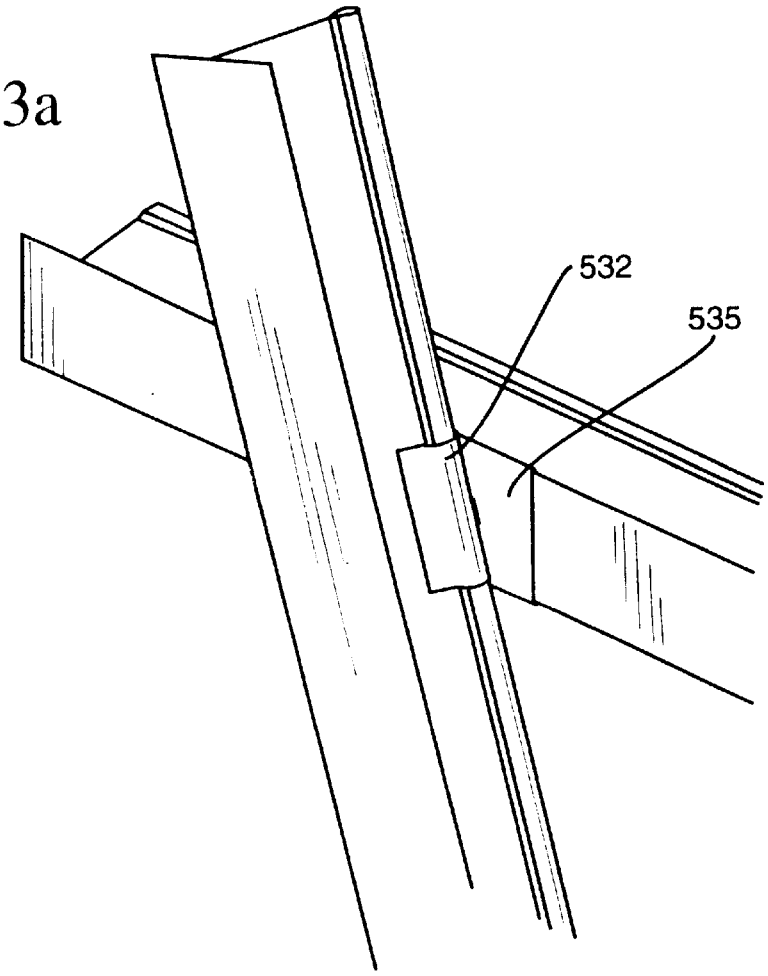
Figure 54A:
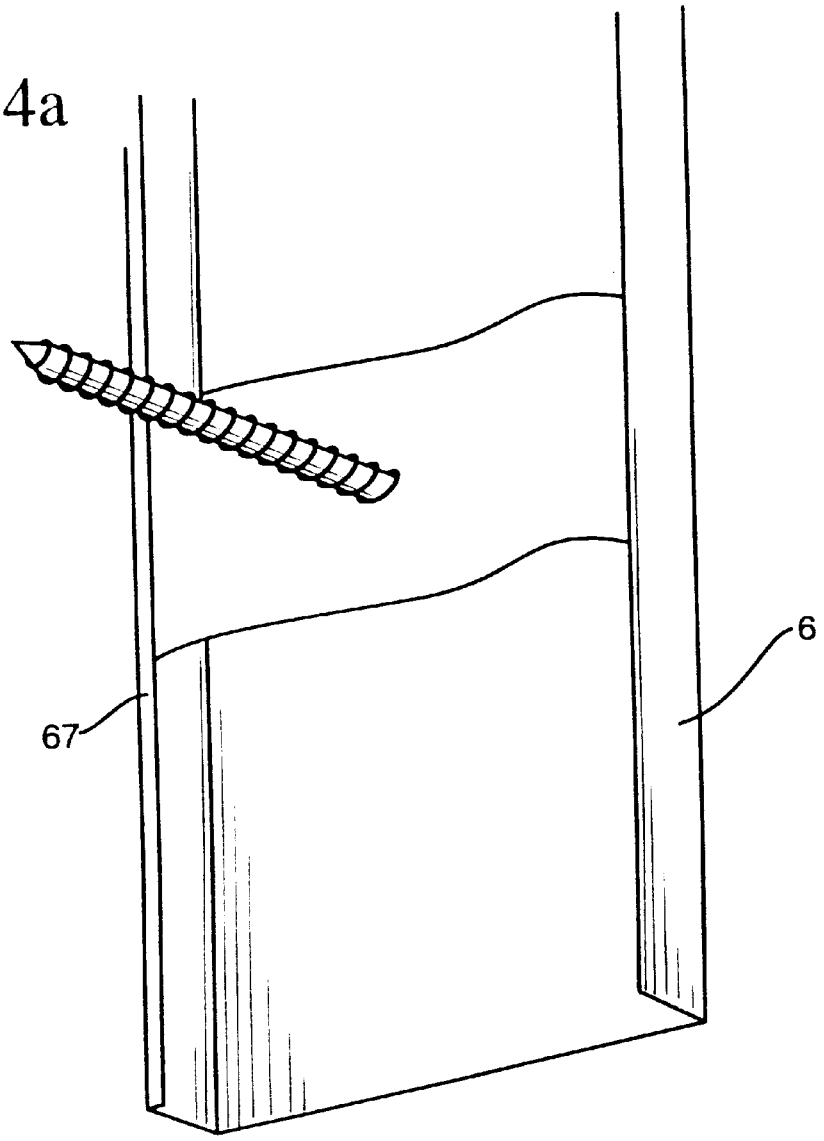
Figure 54B:
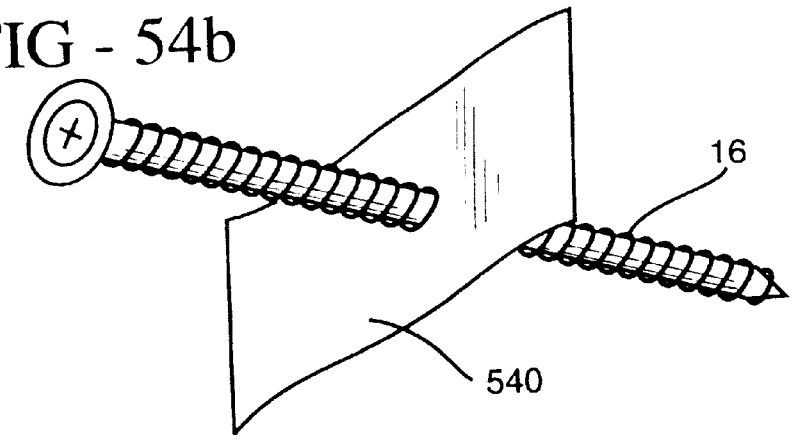

FIG. 34 shows the first connector located on a T-bar and connecting a UPVC panel to the T-bar;

FIG. 35 is a perspective view of modified first connector as shown in FIG. 30 together with a profile connector as shown in FIG. 25*a* in use for fixing a perimeter profile;

FIG. 36 is a perspective view of a first connector linking a T-bar to a perimeter profile and an angle trim;

FIG. 37 is a perspective view from below of a plurality of first connectors linking a matrix of T-bars to a grid into which UPVC panels may be placed;

FIG. 38 is a perspective view of a panel or plank rest connector;

FIG. 38*a* is a perspective view of the panel or plank rest connector in use;

FIG. 39 is a side view of a key for use with ceiling panels;

FIGS. 39*a* and 39*c* are perspective views of such keys in use;

FIG. 39*b* is a top view of the key of the present invention;

FIG. 40 is a perspective view of a further embodiment of connector for use with clip-on panels and blades using a main C-shaped channel;

FIG. 40*a* is a perspective view of the connector of FIG. 40 in use;

FIG. 40*b* is a perspective view of an alternative embodiment of that of FIG. 40;

FIGS. 40*c* and 40*d* are perspective views of the connector of FIG. 40*b* in use with a T-bar and C-shaped channel assembly;

FIG. 41 is a perspective view of a swivel connector for use with clip-on panels and blades;

FIG. 41*a* is a perspective view of the connector of FIG. 41 in use connected between a T-bar and a C-shaped channel;

FIG. 42 is a perspective view of a connector for connecting a T-bar to a panel for use in constructing a suspended ceiling or wall;

FIG. 42*a* is a perspective view of a T-bar connected to the connector shown in FIG. 42 in use;

FIG. 43 is a perspective view of a first bracket for mounting a T-bar to a wall;

FIG. 43*a* is a perspective view of the bracket shown in FIG. 43 in use;

FIG. 44 is a perspective view of a second bracket for holding a T-bar to a ceiling in a suspended ceiling system;

FIG. 44*a* is a perspective view of the bracket of FIG. 44 attached to a T-bar of a ceiling grid;

FIG. 45*a* is a perspective view of a connector for connecting a T-bar to an angle trim;

FIG. 45*b* is a perspective view of the connector of FIG. 45 in use;

FIG. 45*c* is a perspective view of a modified connector, for connecting a T-bar to an angle trim;

FIG. 45*d* is a perspective view of the modified connector of FIG. 45*c* in use;

FIG. 46 is a perspective view of a connector for holding panels on a T-bar;

FIG. 46*a* is a perspective view of the connector shown in FIG. 46 in use;

FIG. 47 is a perspective view of a connector for holding tongue and groove panels on a T-bar;

FIG. 47*a* is a perspective view of the connector shown in FIG. 47 in use;

FIG. 48 is a perspective view of an alternative embodiment of connector;

FIG. 48*a* is a perspective view of the connector of FIG. 48 in use;

FIG. 49 is a perspective view of a further connector for holding a tongue and groove UPVC panel on a T-bar;

FIG. 49*a* is a perspective view of the connector shown in FIG. 49, in use;

FIG. 50 is a perspective view of a first connector in use with an edge or perimeter profile;

FIG. 51 is a perspective view of a combined bracket and connector for use in attaching a T-bar to a second T-bar;

FIG. 51*a* is a perspective view of the combined bracket and connector in use;

FIG. 52 is a perspective view of a combined bracket and connector, similar to that shown in FIG. 51 for connecting a T-bar to a second T-bar;

FIG. 52*a* shows the combined bracket and connector of FIG. 52 in use;

FIG. 53 is a perspective view of a further embodiment of combined bracket and connector which allows movement of one T-bar with respective to the second T-bar while pivotally attached;

FIG. 53*a* is a perspective view of the connector in this embodiment in use;

FIGS. 54*a* and 54*b* is a perspective view of a connector in an alternative embodiment for use with a C-shaped liner panel as shown therein;

FIG. 54*b* is a perspective view of the connector of FIG. 54*a;*

Figure 54C:
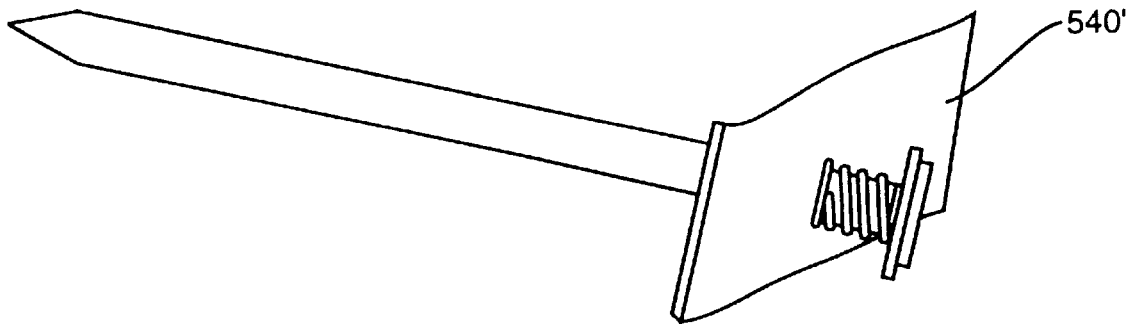

FIG. 54*c* is a perspective view of a further alternative embodiment of the connector shown in FIGS. 54*a* and 54*b;*

Figure 54D:
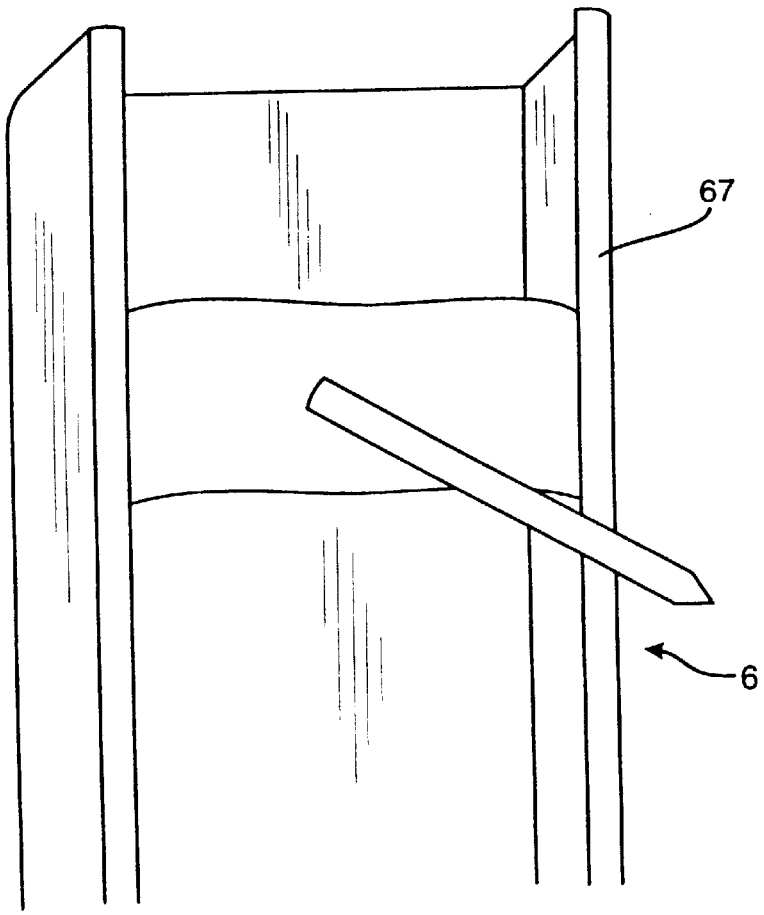
Figure 55:
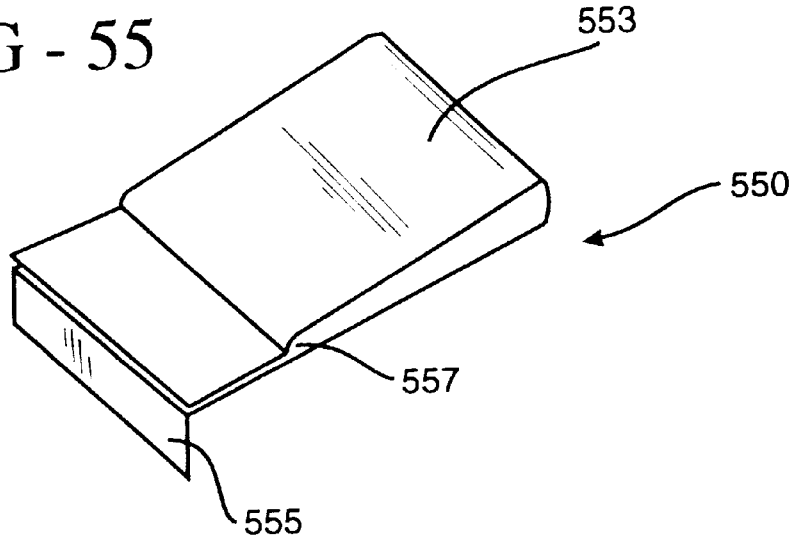
Figure 55A:
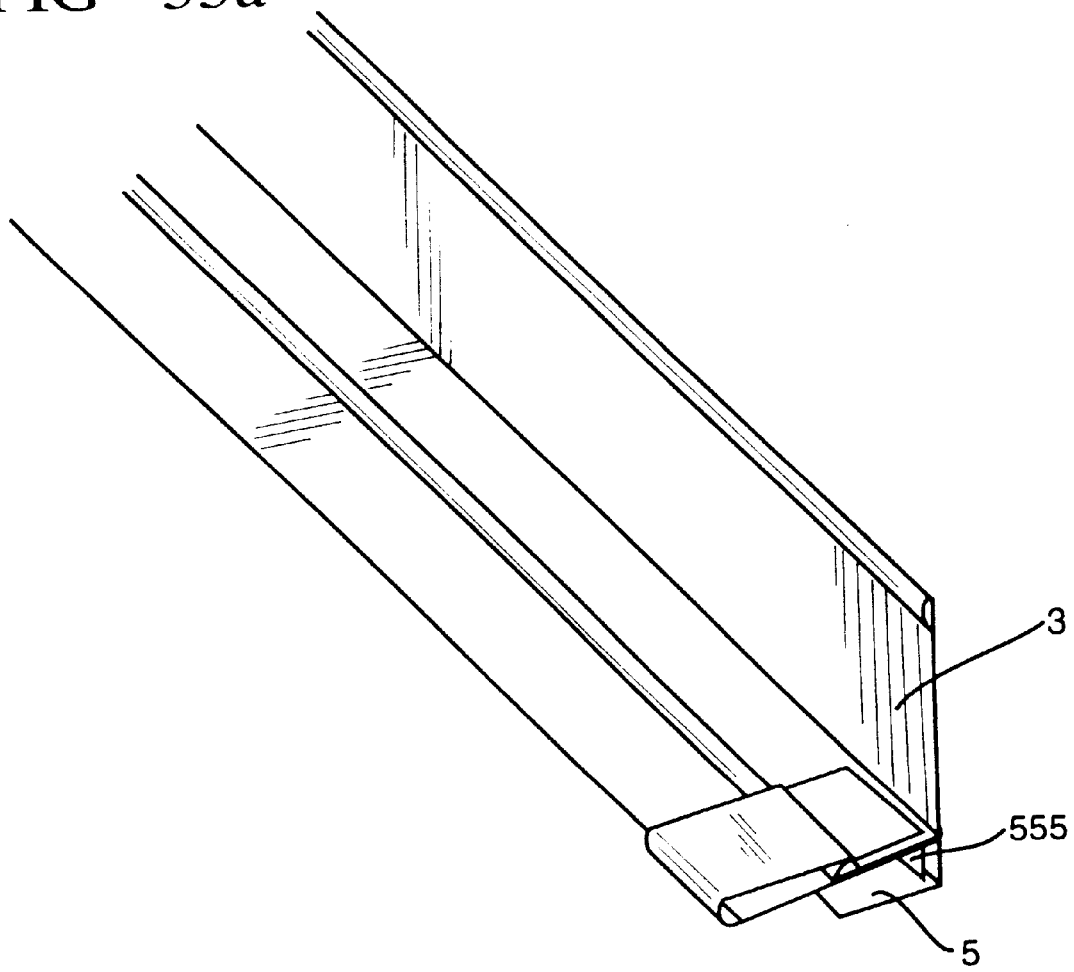
Figure 56:
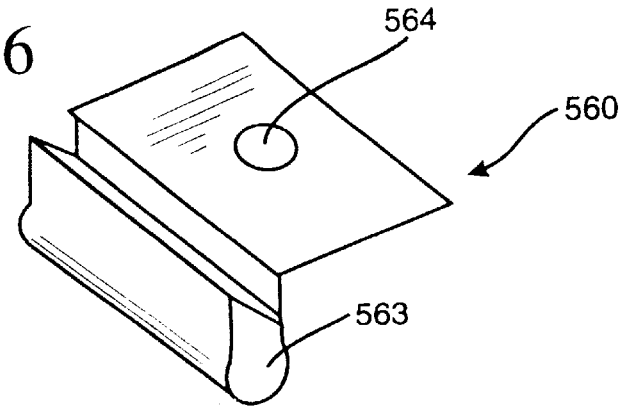
Figure 56A:
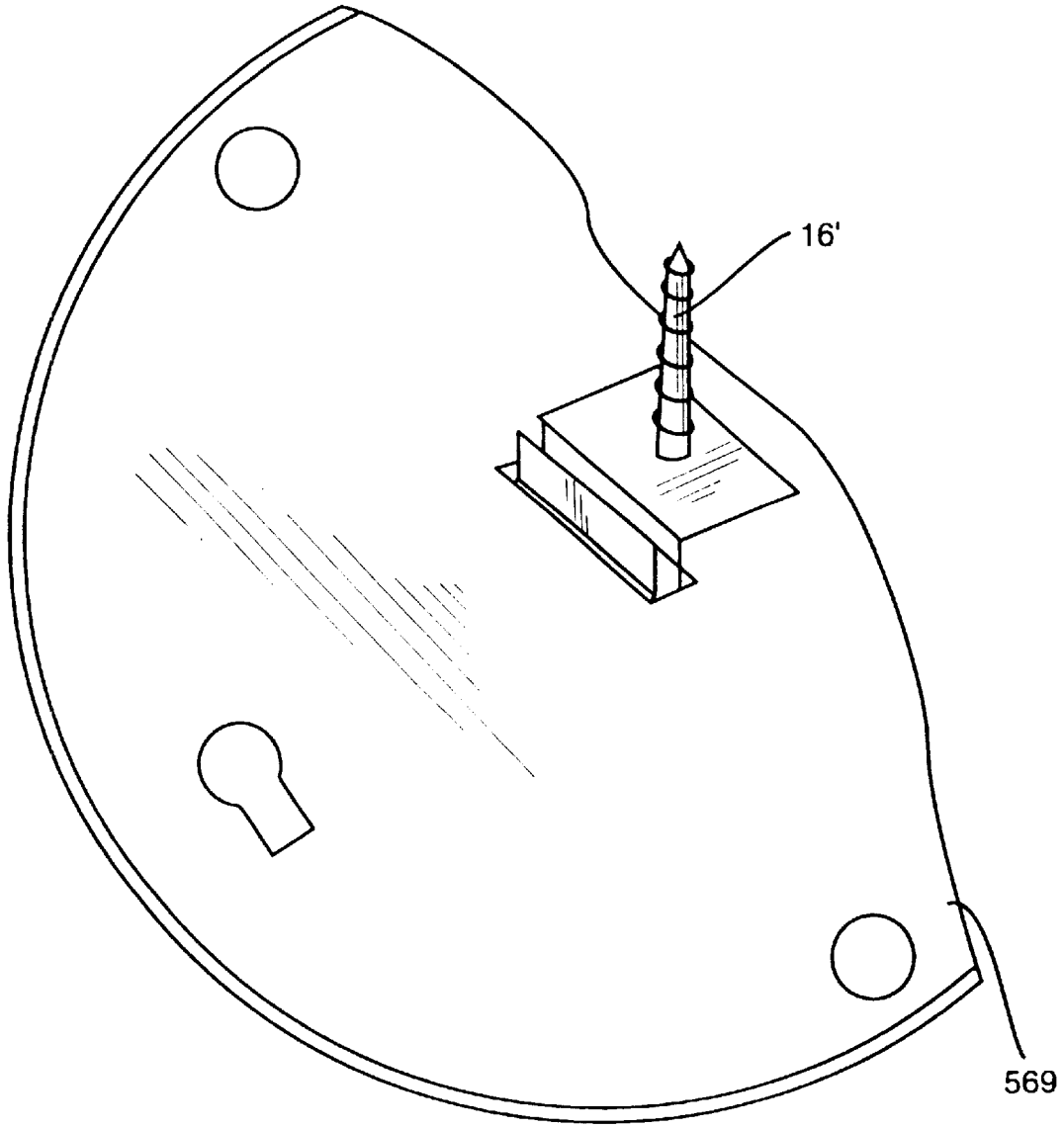
Figure 57:
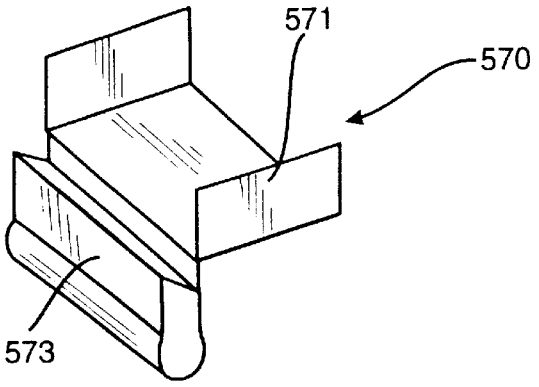
Figure 57A:
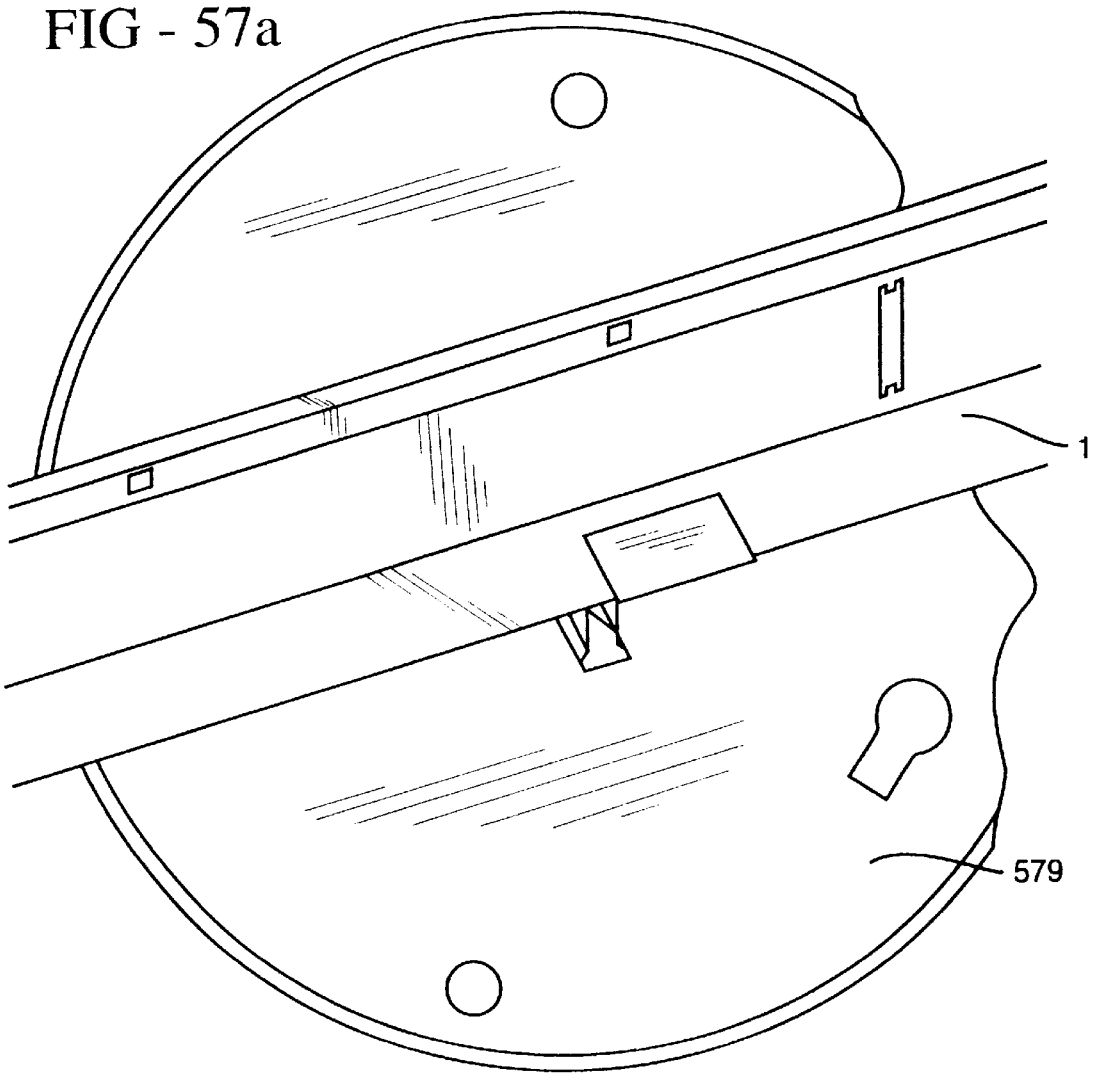
Figure 58:
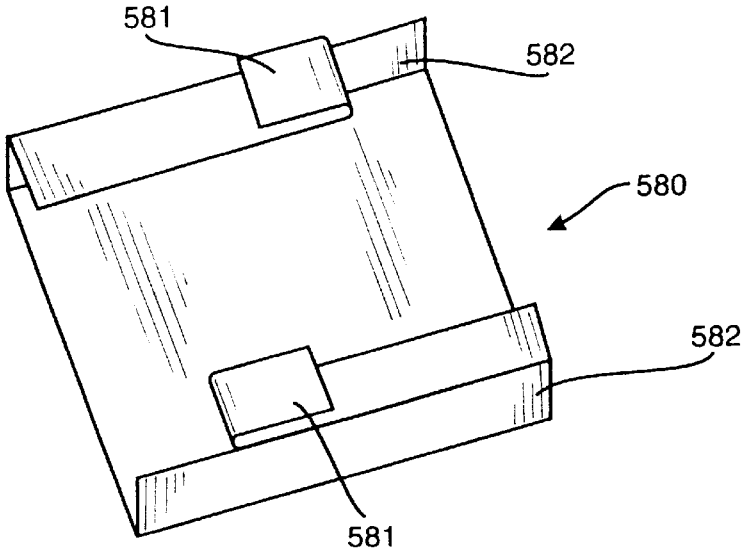
Figure 58A:
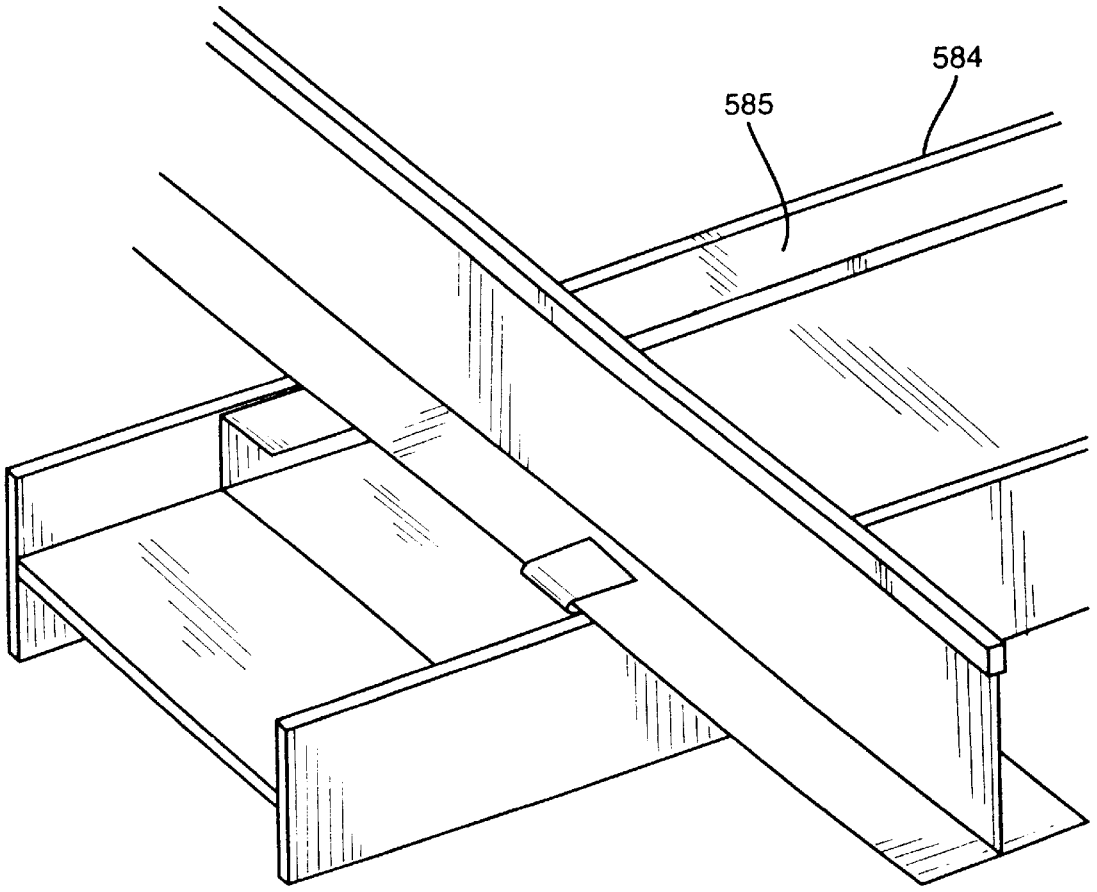
Figure 59:
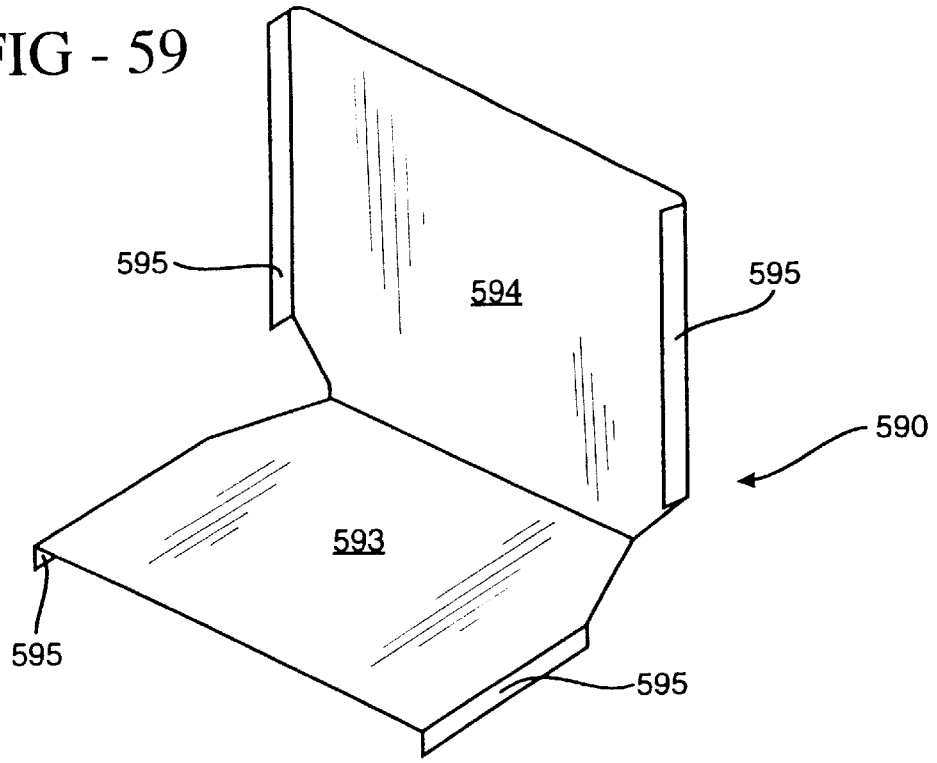
Figure 59A:
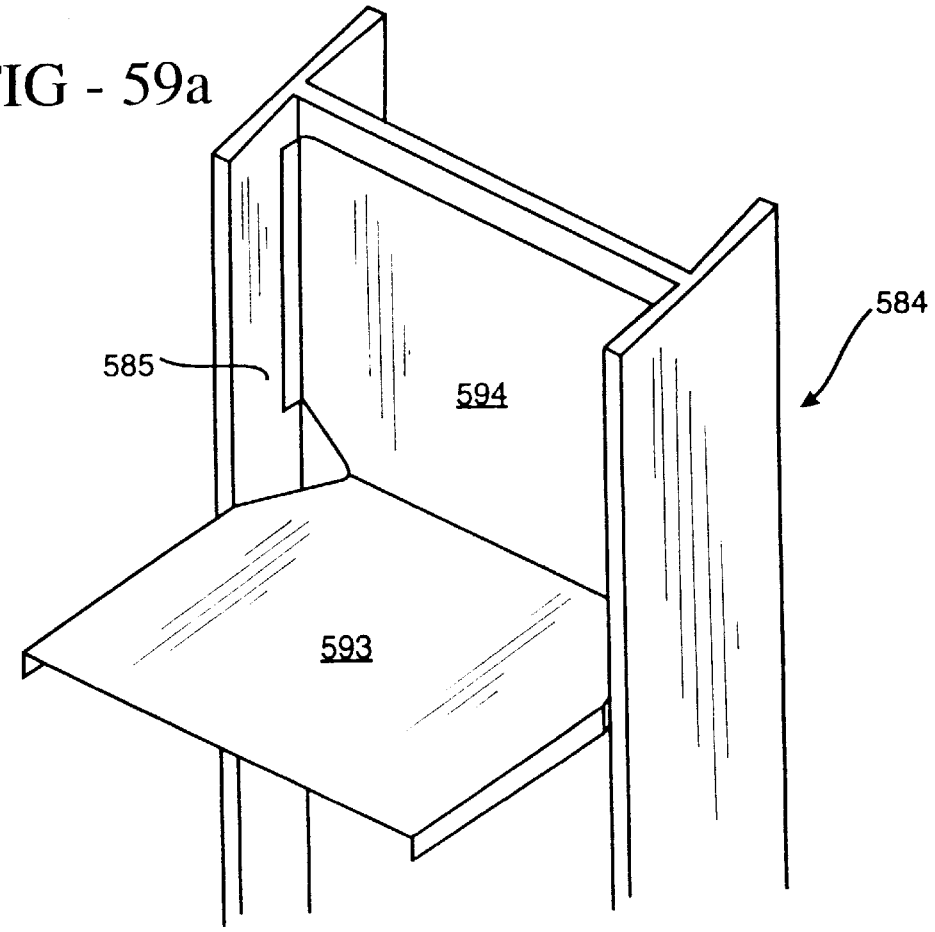
Figure 60:
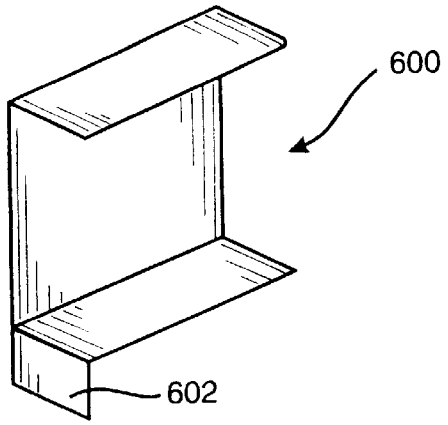
Figure 60A:
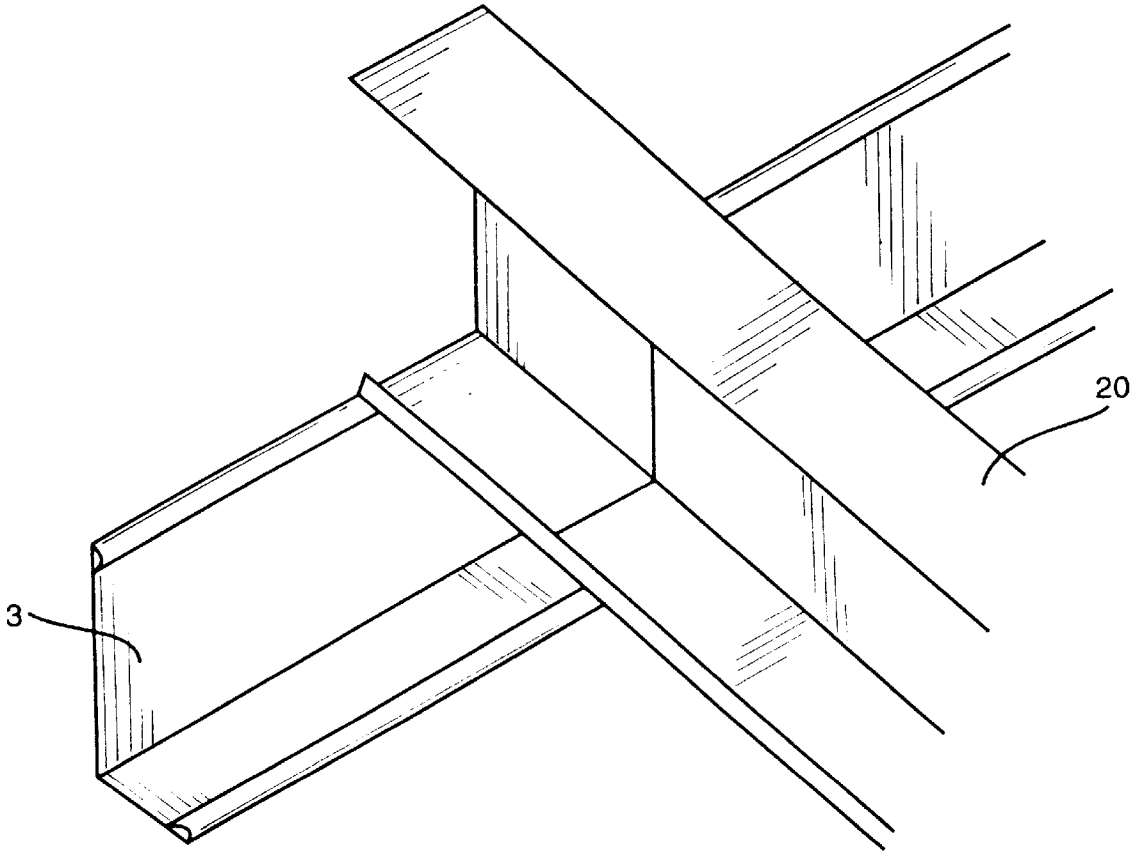
Figure 61A:
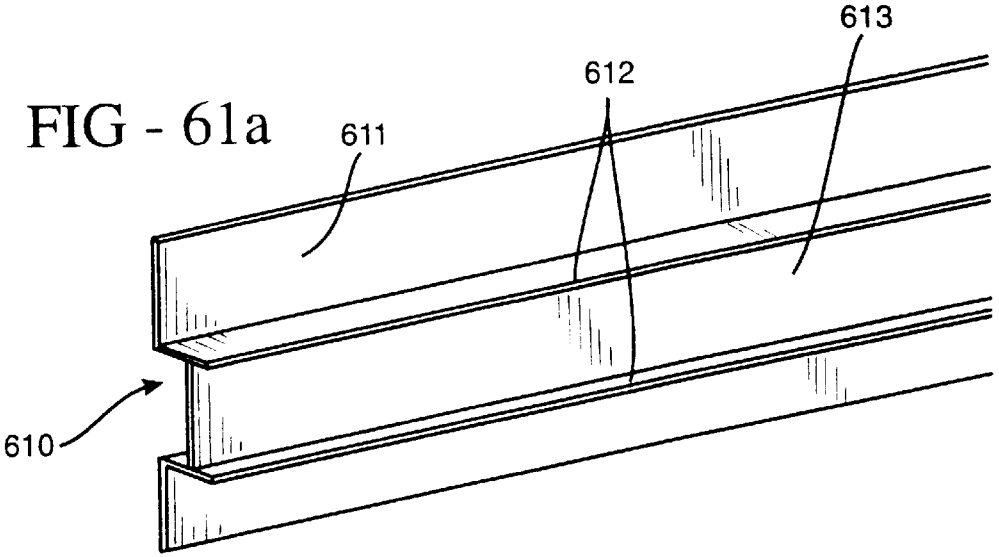
Figure 61B:
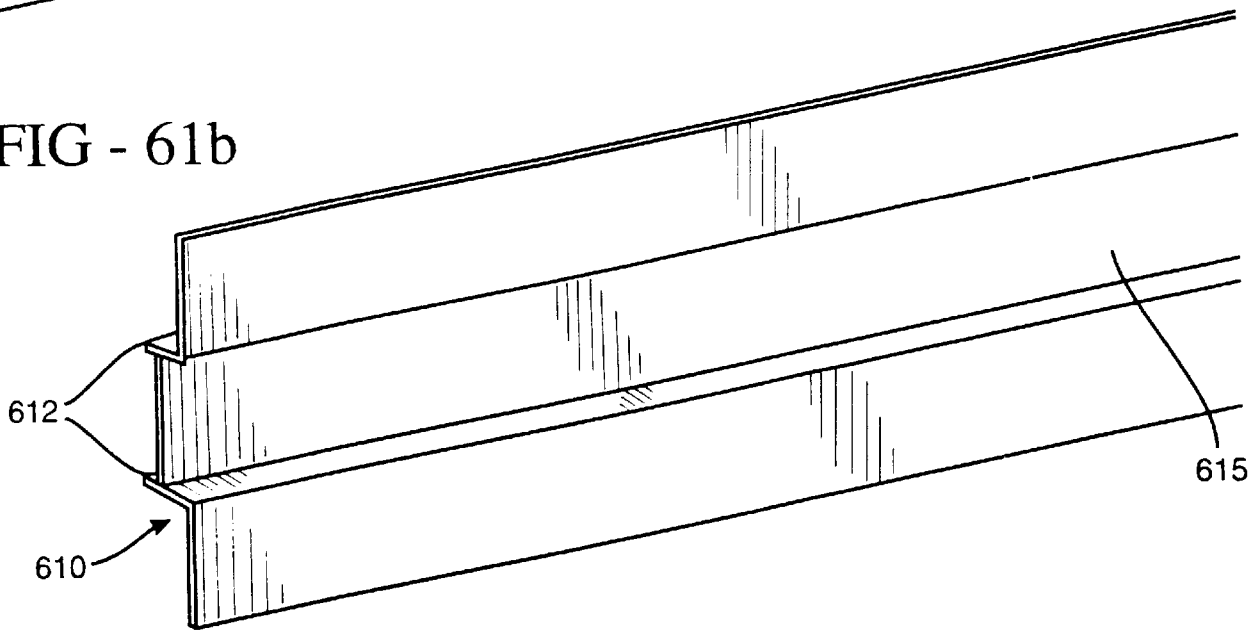
Figure 62:
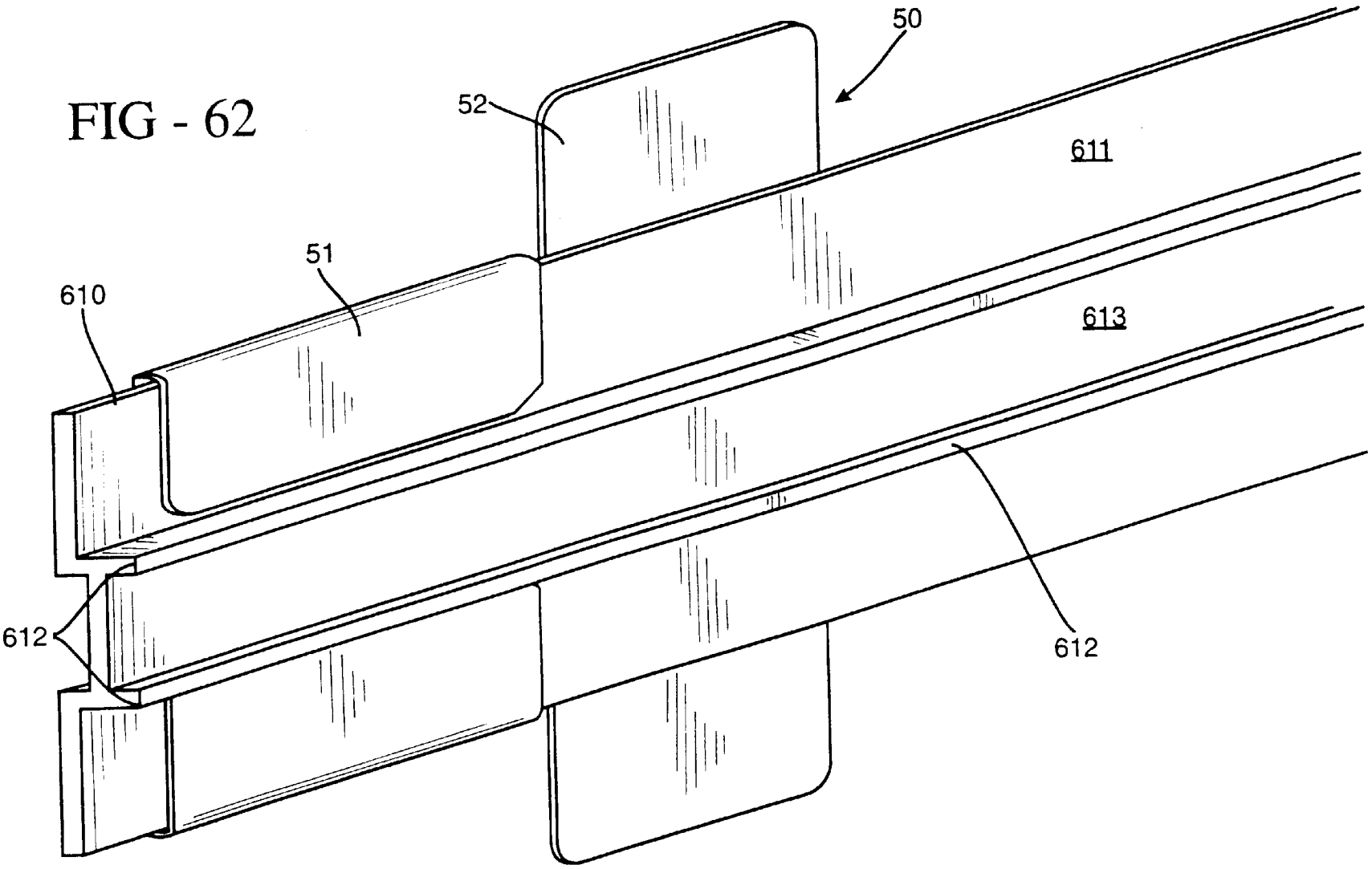
Figure 63:
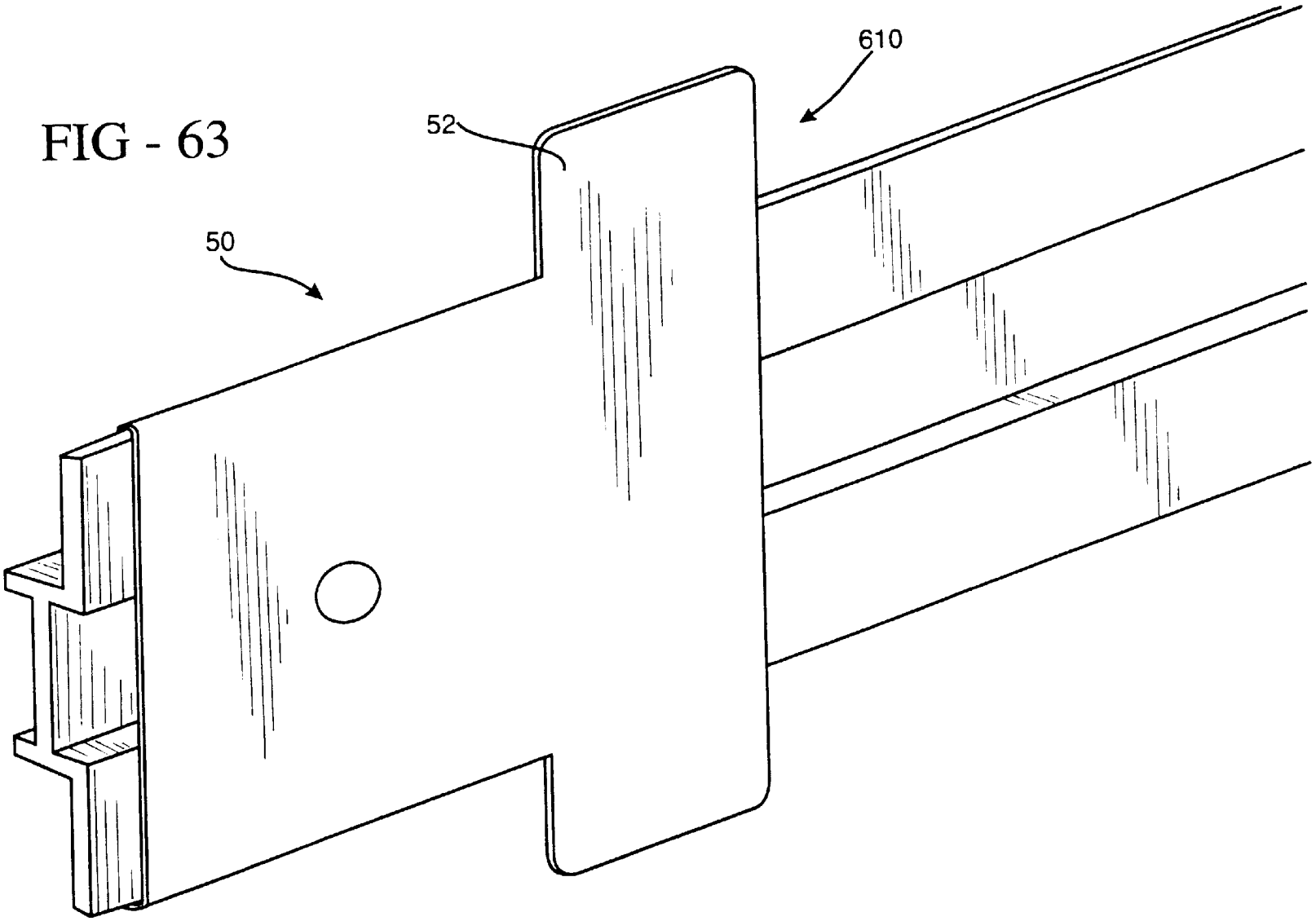
Figure 64A:
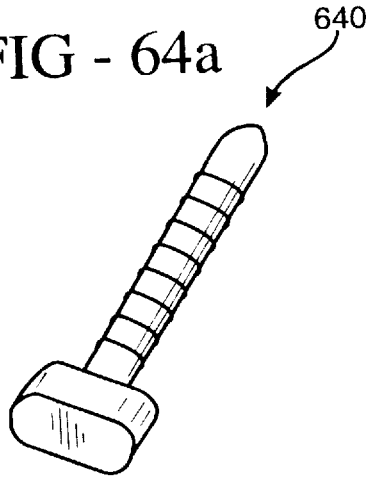
Figure 64B:
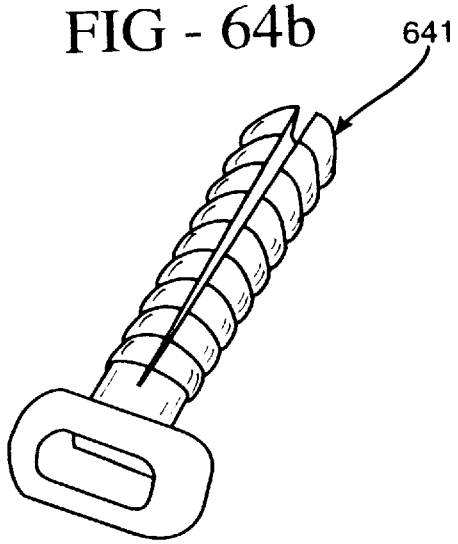
Figure 64C:
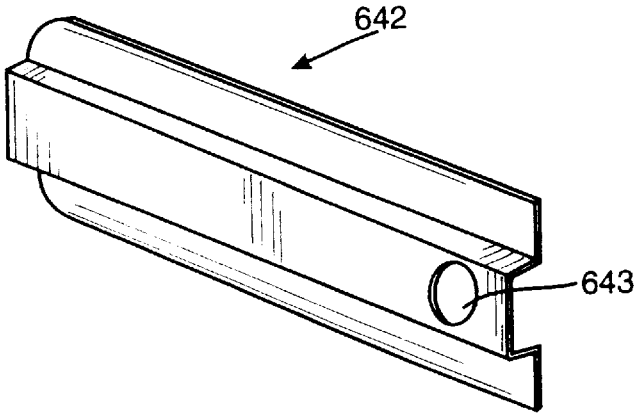
Figure 64D:
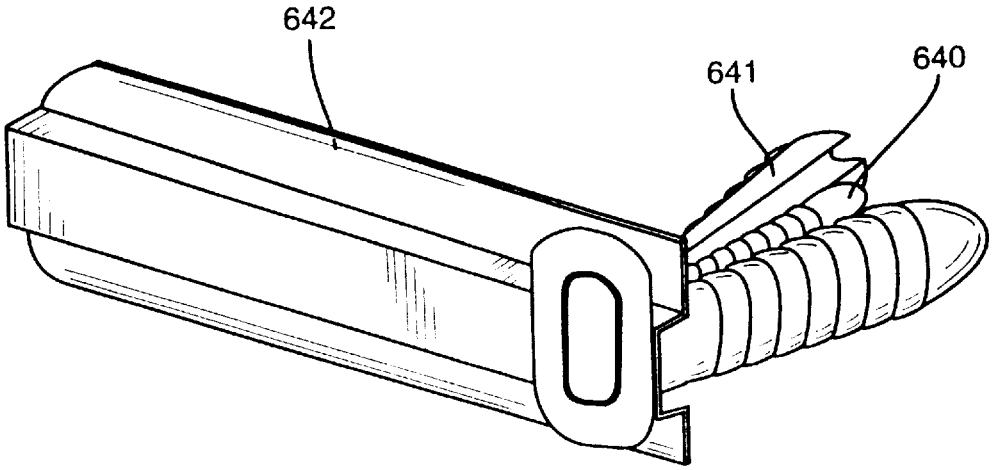
Figure 65:
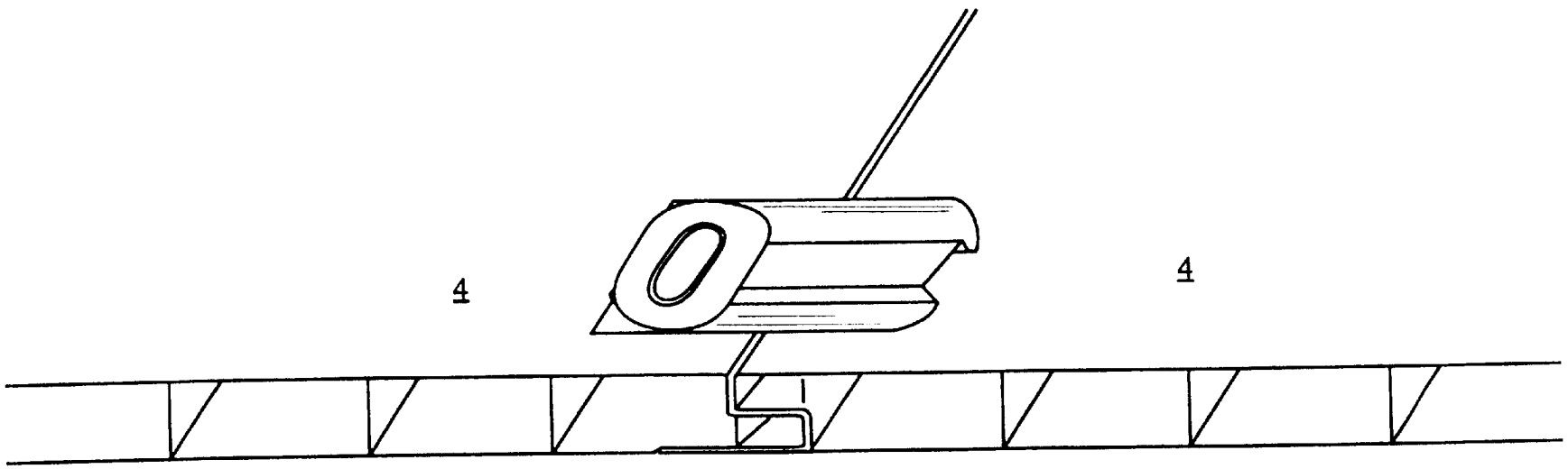
Figure 66:
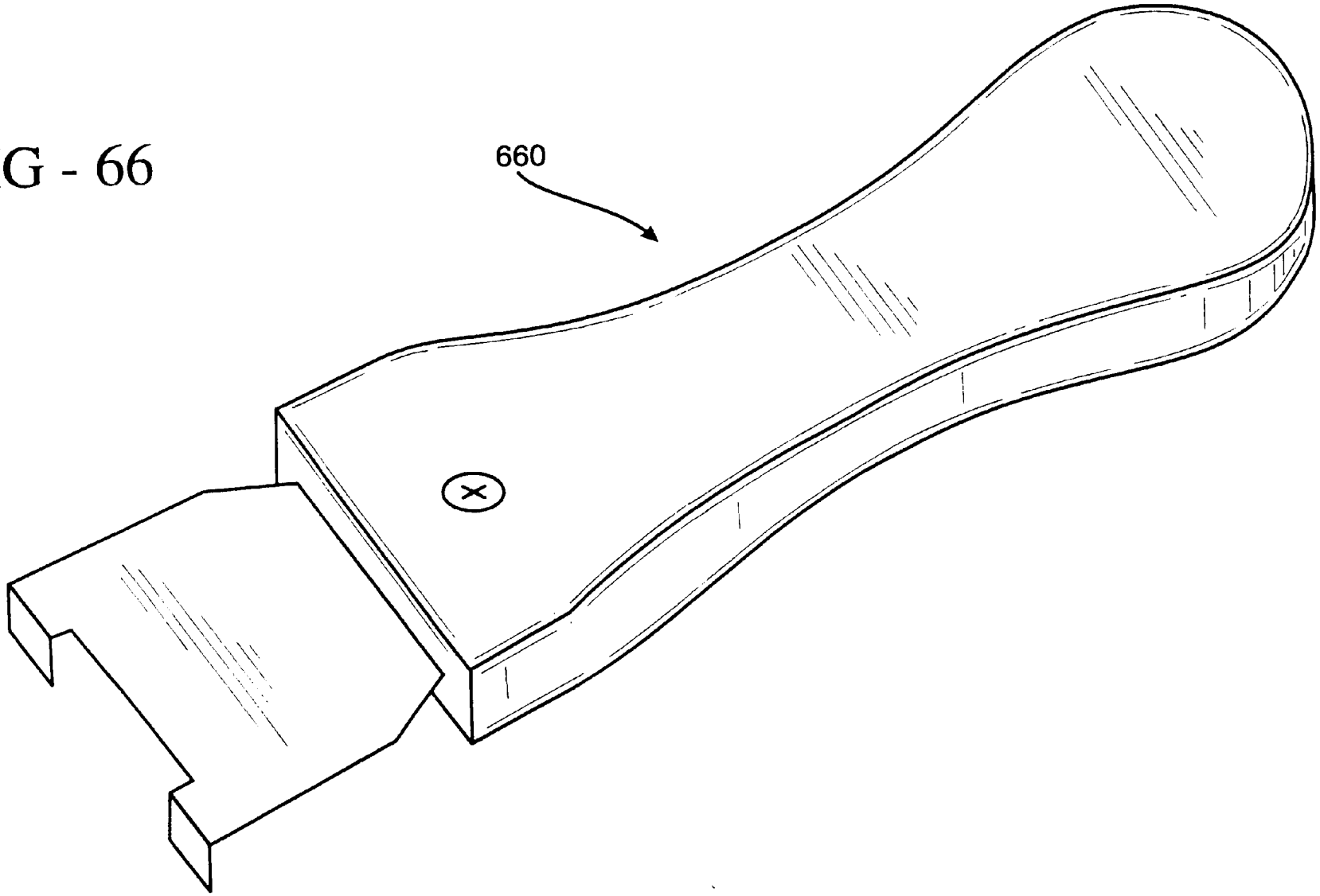
Figure 67A:
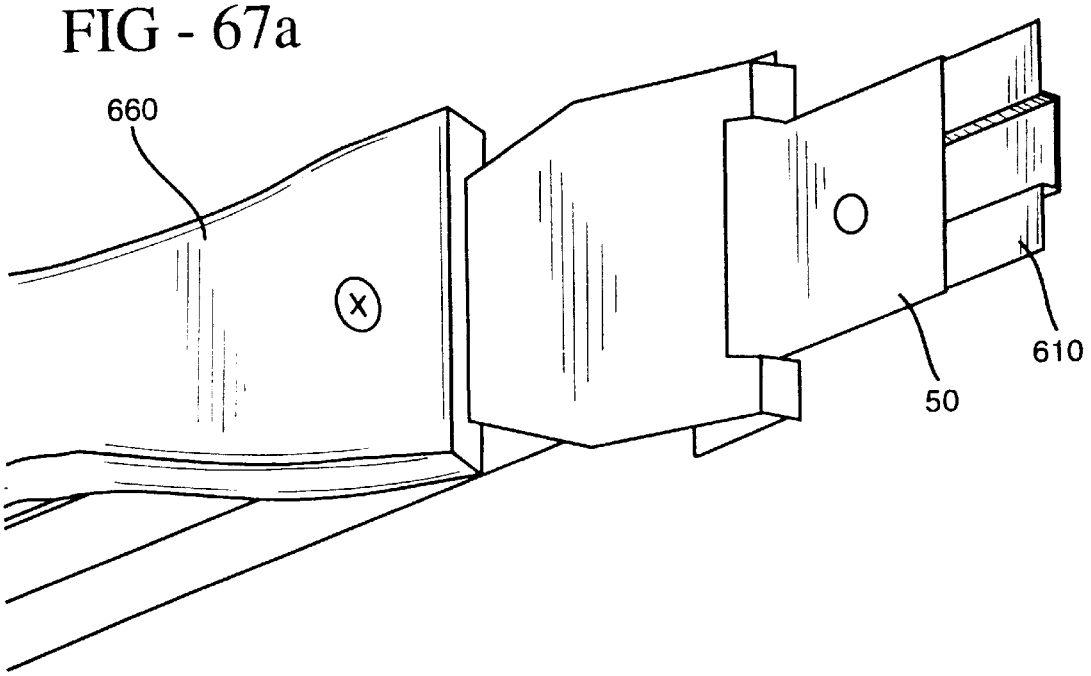
Figure 67B:
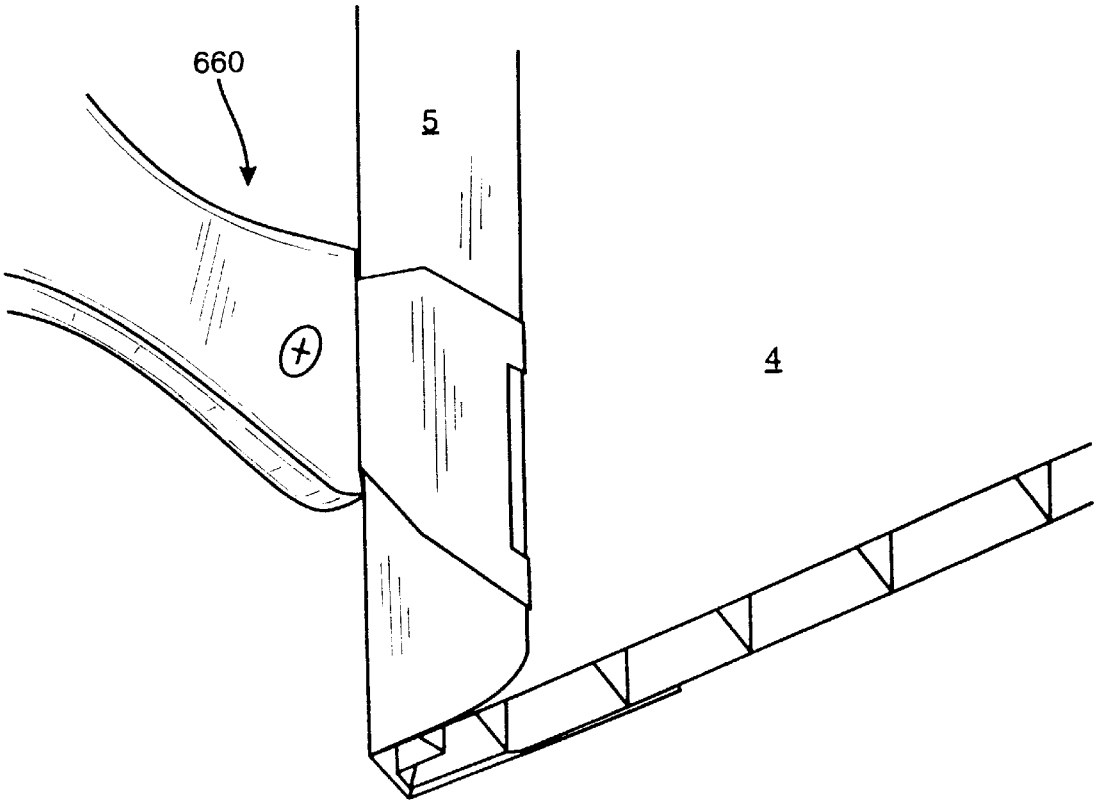
Figure 68A:
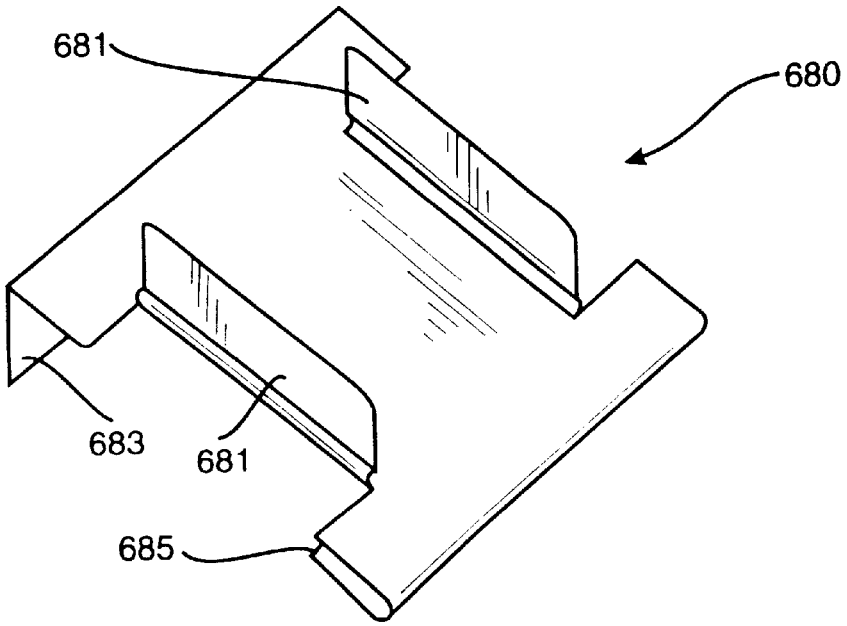
Figure 68B:
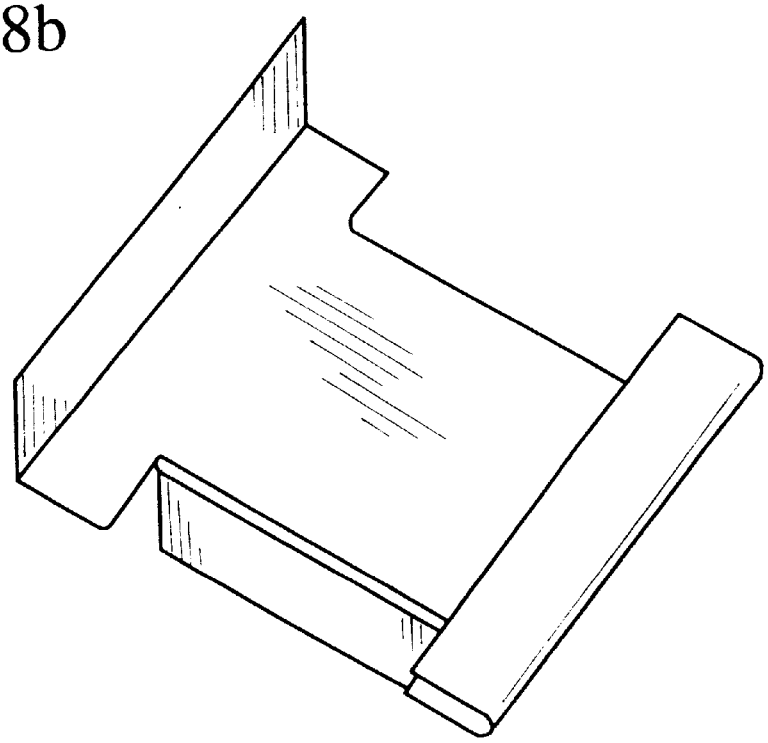

FIG. 54*d* is a perspective view of the connector shown in FIG. 54*c* in use;

FIG. 55 is a perspective view of a profile connector for clipping an angle trim to a perimeter profile;

FIG. 55*a* is a perspective view of the connector of FIG. 55 in use;

FIG. 56 is a perspective view of an alternative embodiment of connector for holding a smoke alarm to an existing ceiling structure;

FIG. 56*a* is a perspective view of the connector in this embodiment in use;

FIG. 57 is a perspective view of a connector similar to that of FIG. 56 for holding a smoke alarm onto a T-bar;

FIG. 57*a* is a perspective view of the connector in this embodiment in use;

FIG. 58 is a perspective view of a further embodiment of connector;

FIG. 58*a* is a perspective view of the connector shown in FIG. 58 in use holding a T-bar in position on a H-shaped girder;

FIG. 59 is a perspective view of a connector in an alternative embodiment for connecting a first C-shaped or H-shaped channel or beam to a second similar channel or beam;

FIG. 59*a* is a perspective view of the connector shown in FIG. 59 in use with a H-shaped channel;

FIG. 60 is a perspective view of a connector in an alternative embodiment for connecting a C-shaped channel to an angle trim;

FIG. 60*a* is a perspective view of the connector shown in FIG. 60 in use;

FIGS. 61*a* and 61*b* are two perspective views of a "top-hat" profile wall track;

FIG. 62 is a perspective view of the wall track in use with the first connector of the present invention;

FIG. 63 is a further perspective view from below of the wall track in use with a connector;

FIGS. 64*a* and 64*b* are perspective views of components of a two-part rivet for use with a fastener shown in FIG. 64*c* for securing panels and trap doors in suspended ceilings;

FIG. 64*d* is a perspective view of the two-part rivet inserted in the fastener;

FIG. 65 is a perspective view of the two-part rivet and fastener of FIGS. 64*a* to 64*c* holding a trap door in a closed position;

FIG. 66 is a perspective view of a grip tool adapted for sliding connectors 50 of the present invention along T-bars or wall tracks;

FIGS. 67*a* and 67*b* are perspective views of the grip tool in use;

FIG. 68*a* is a perspective view of an alternative connector for connecting joint profiles to T-bars in a ceiling grid;

FIG. 68*b* is a perspective view from below, of the connector shown in FIG. 68*a;*

Figure 69:
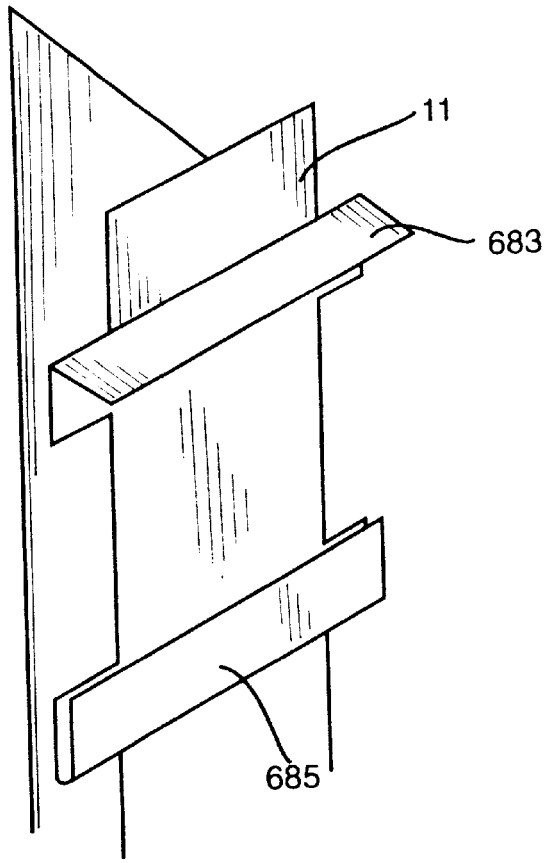
Figure 70:
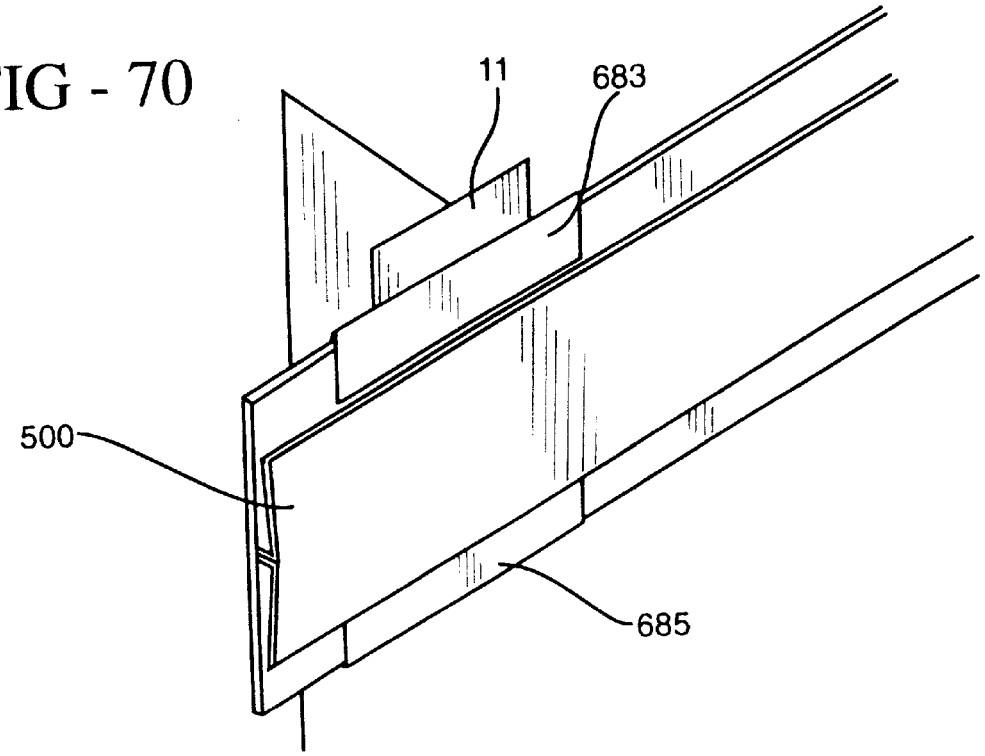
Figure 71A:
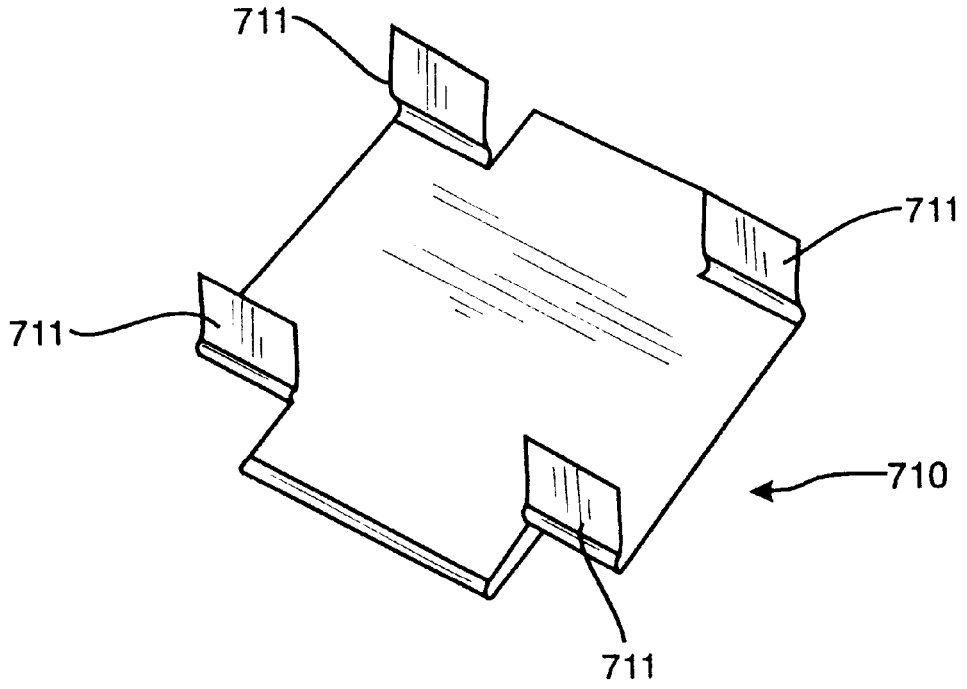
Figure 71B:
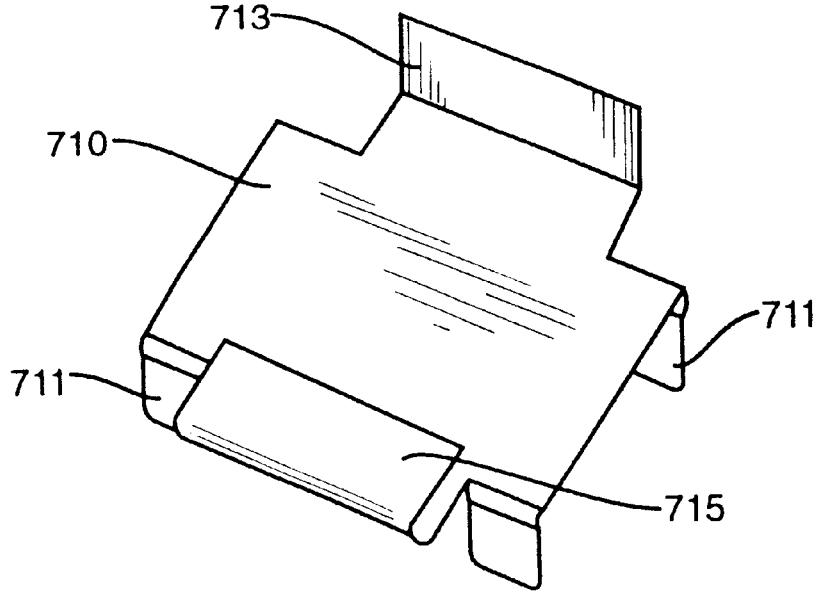
Figure 72:
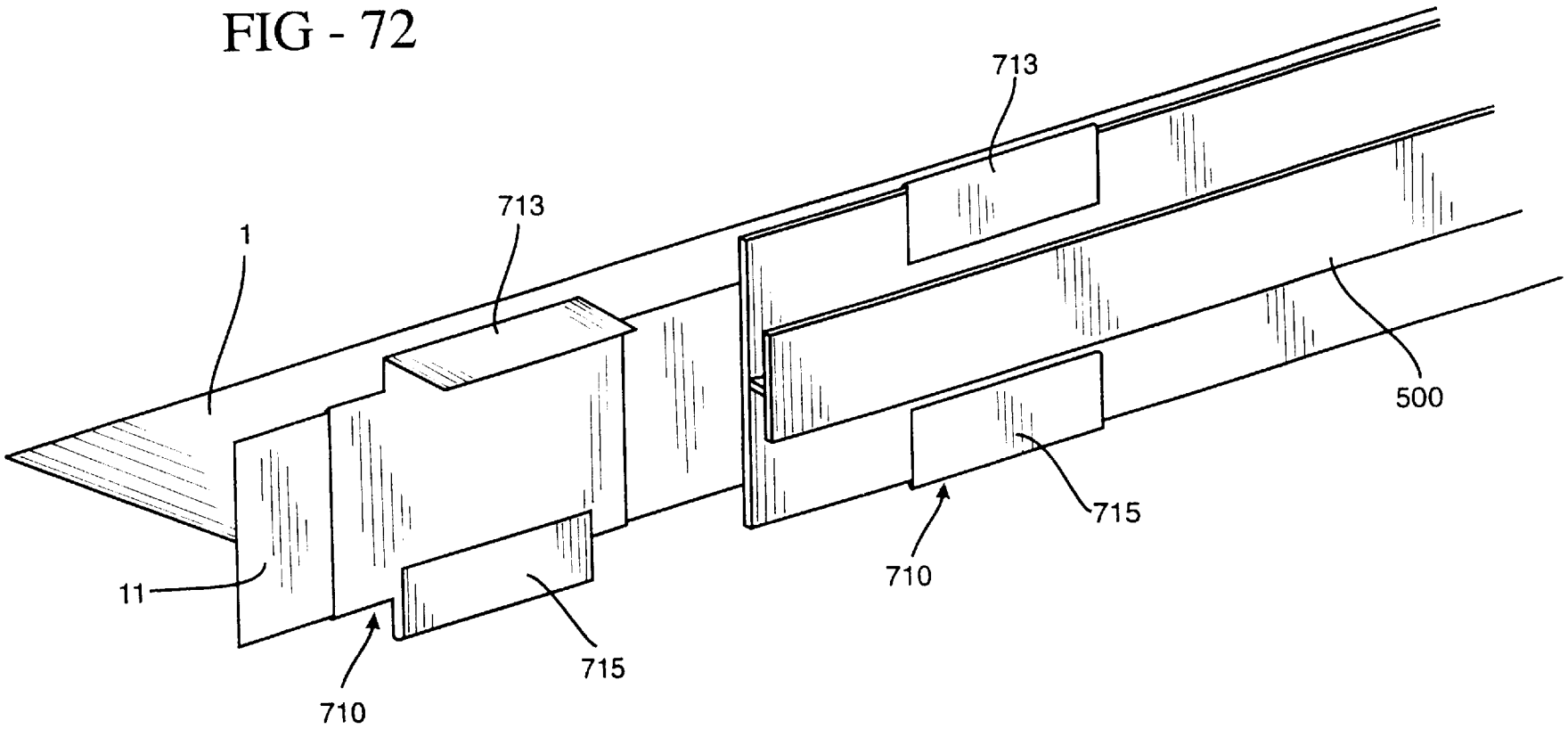

FIG. 69 is a perspective view of the connector of FIGS. 68*a* and 68*b* attached to a T-bar;

FIG. 70 is a perspective view of the arrangement shown in FIG. 69 attached to a joint profile;

FIGS. 71*a* and 71*b* are perspective views of a modified connector similar to the connector shown in FIGS. 68*a* and 68*b* from above and below respectively;

FIG. 72 is a perspective view from below of a joint profile and a T-bar connected together by the modified connector shown in FIGS. 71*a* and 71*b;*

Figure 73A:
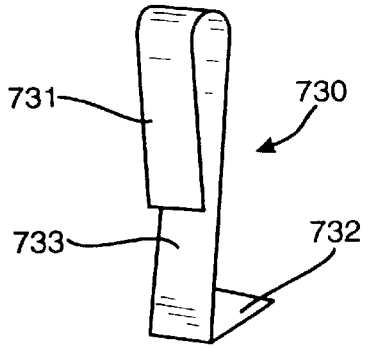

FIG. 73*a* is a perspective view of a perimeter profile connector similar to that of FIG. 25*b;*

Figure 73B:
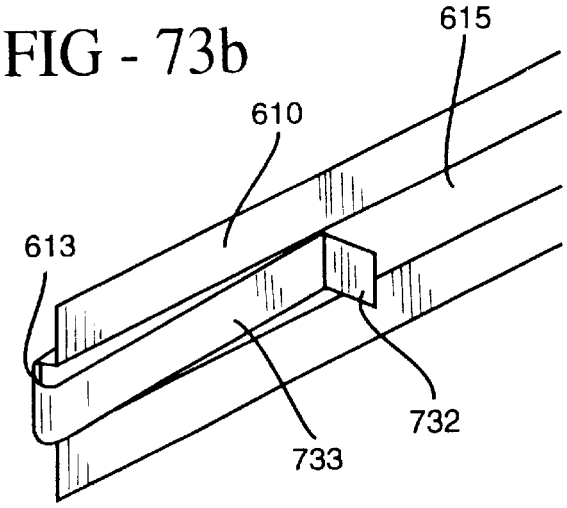
Figure 73C:
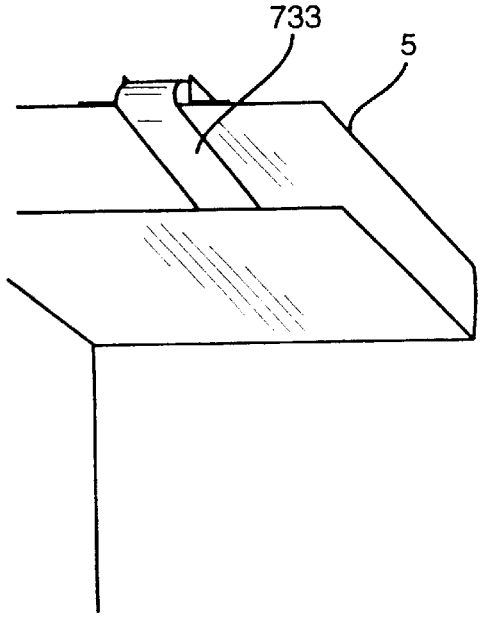
Figure 73D:
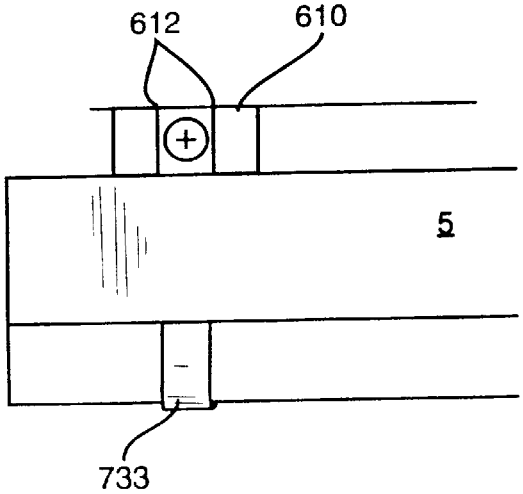
Figure 74A:
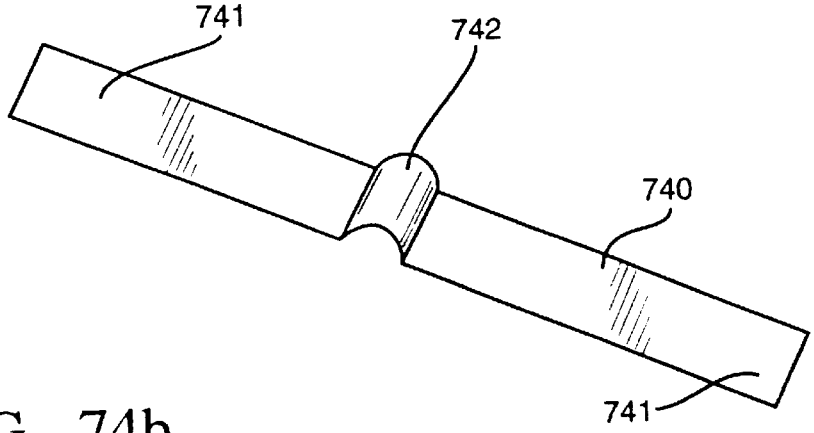
Figure 74B:
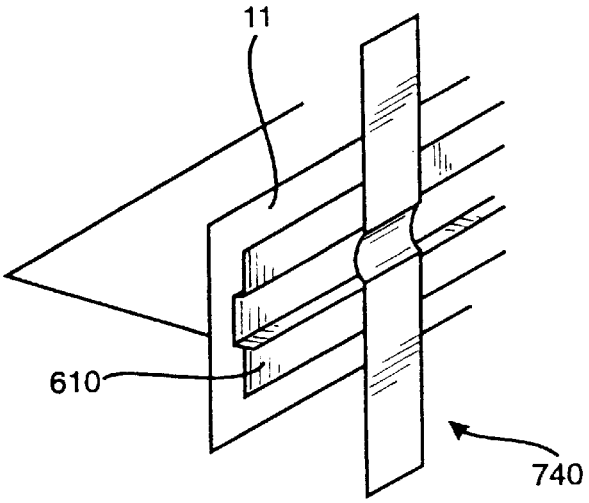
Figure 74C:
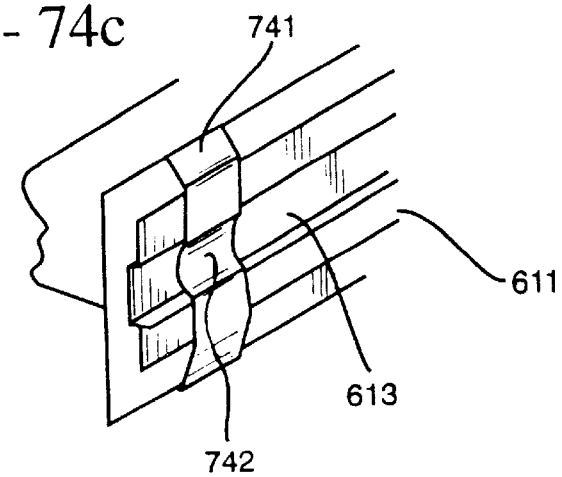

FIG. 73*b* shows the connector of FIG. 73*a* in use with a wall track;

FIG. 73*c* shows the connector of FIG. 73*a* in use with a section of starting or perimeter profile;

FIG. 73*d* is a front view of the connector of FIG. 73*a* in use with a profile;

FIG. 74*a* is a perspective view of a wall track connector;

FIG. 74*b* shows the connector of FIG. 74*a* abutting a wall track section in preparation for fixing the track to a T-bar; and FIG. 74*c* shows the connector of FIG. 74*a* in use.

Referring now to the drawings, the connectors in the various embodiments of the present invention will be described.

It will be noted that although the following description may refer to the construction of suspended ceilings, the connectors of the invention may be also used for constructing walls using panels and particularly UPVC panels.

Figure 1C:
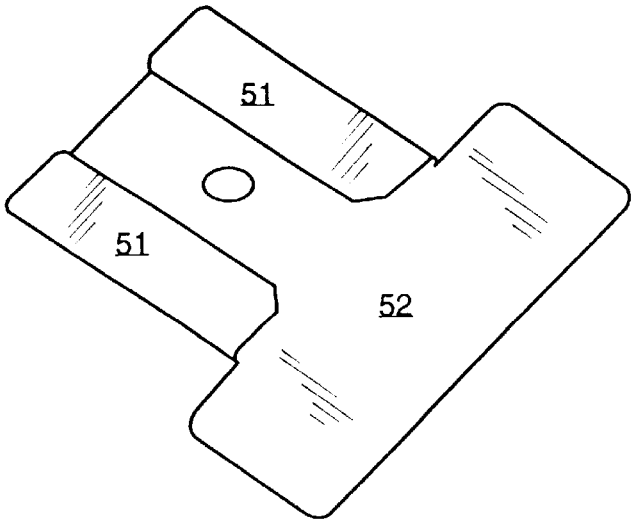

Referring initially to FIGS. 1, 1*a* and 1*c*, the connector of the present invention in a first embodiment will be described. The connector is indicated generally by the reference number 50 and includes two wings 51 and tongue member 52. The ends of the tongue member 52 are indicated by reference numeral 54. Each wing 51 includes a kink 55 thereon. The connector 50 also includes, a body 57 having an aperture 56.

Figure 3:
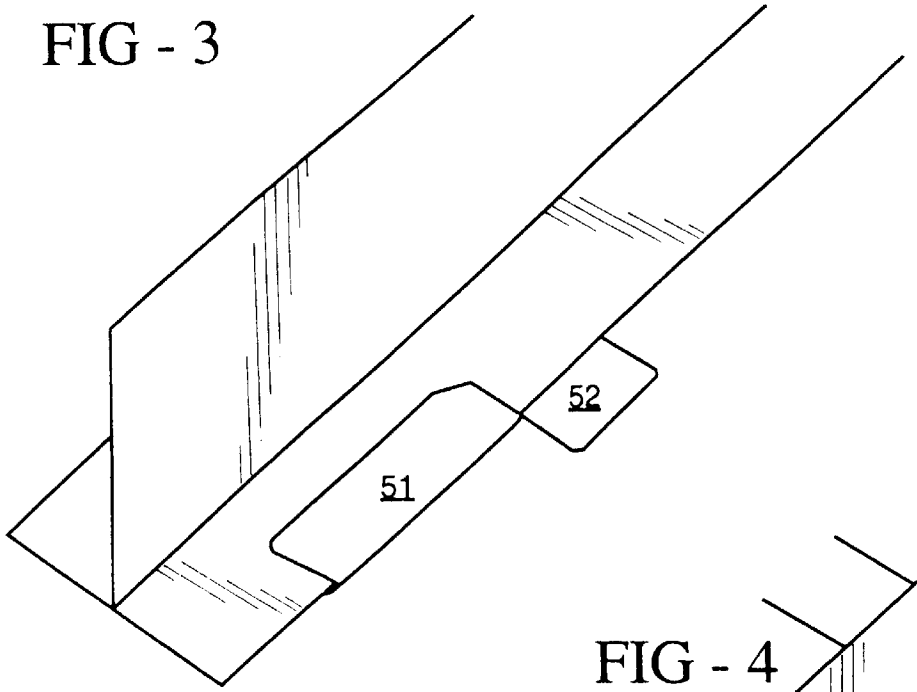
FIG. 3 is a perspective view from above of the connector mounted on a T-bar.
Figure 4:
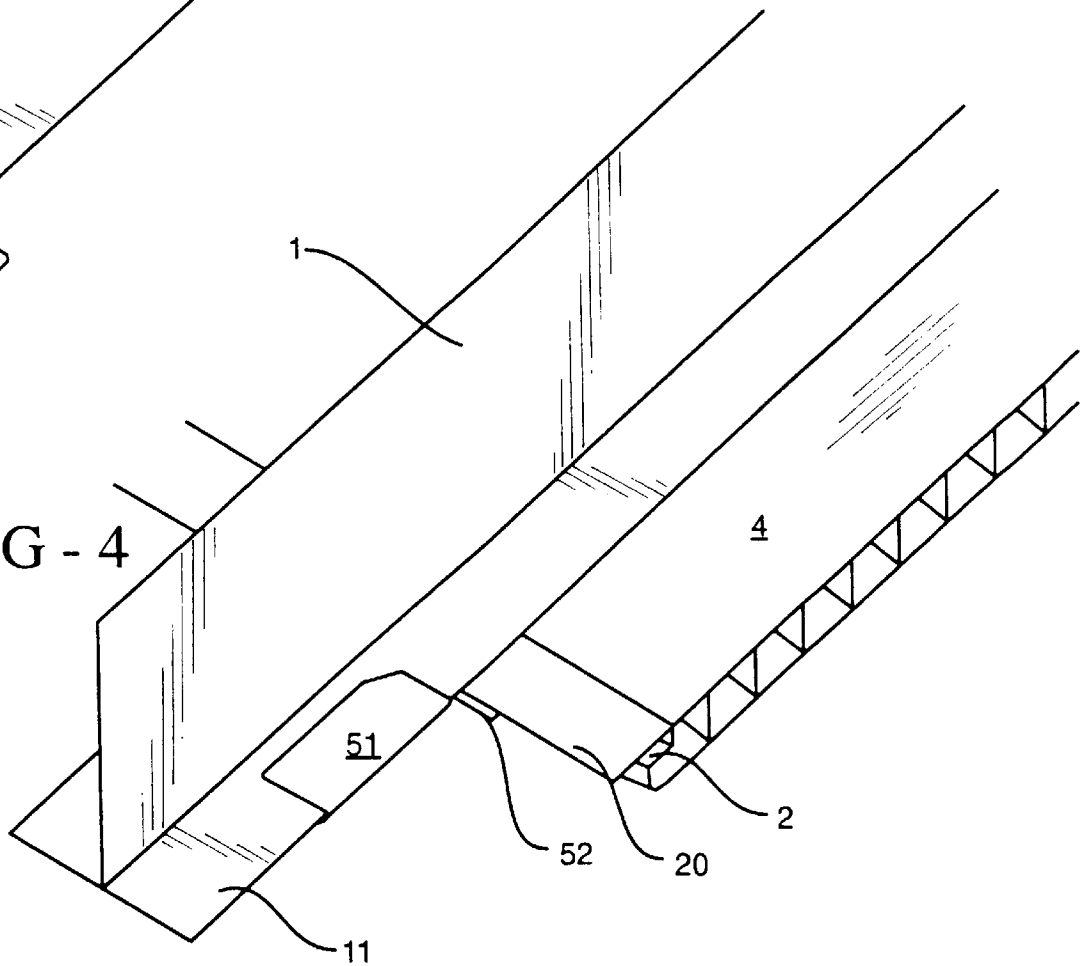
FIG. 4 is a perspective view as shown in FIG. 3 showing the connector also engaged to a UPVC panel.
Figure 5:
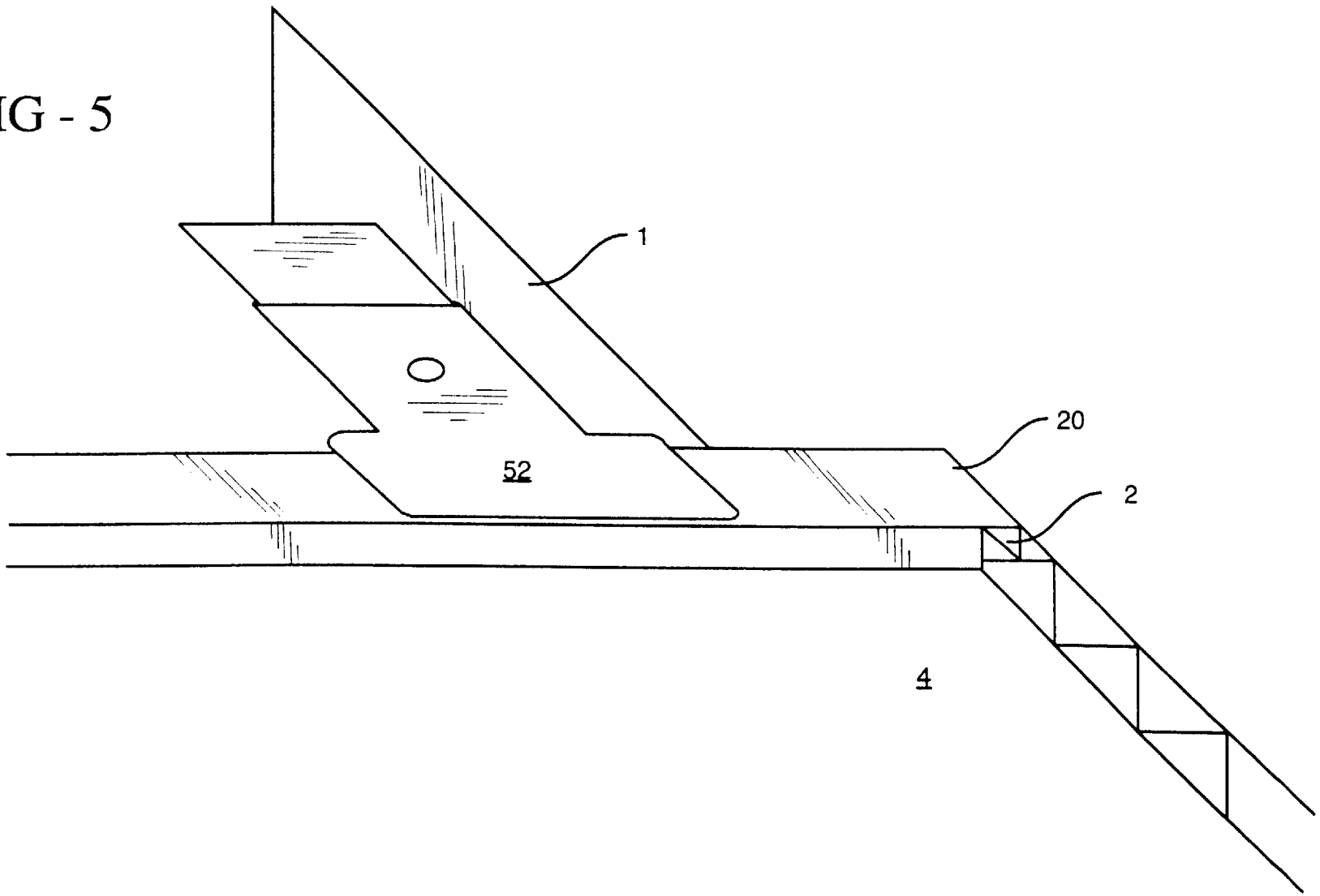
FIG. 5 is a perspective view from below of the construction of FIG. 4.

Referring also now to FIGS. 3, 4 and 5, in order to construct a ceiling supported on a ceiling grid comprising a network of T-bars using connector 50, an operator positions the connector 50 so that the horizontal flanges 11 of a T-bar 1 are located between the wings 51. The connector 50 will be held in position on the T-bar 1 because the kink 55 catches on the horizontal flanges 11. Each wing 51 is then pressed inwardly and downwardly onto each horizontal flange 11 using the thumb and fingers of one's hand so that the connector 50 is held on the T-bar 1. Thus the wings 51 are moved between an open, inoperational and a closed, operational position. The connector 50 may be slid along the T-bar to any desired position at which it is wished to place a UPVC panel and the wings 51 are then crimped securely on the horizontal flanges 11 of the T-bar 1. This operation is repeated using a number of connectors 50 so that several connectors 50 are attached to the T-bar 1. In order to hold a panel on the T-bar 1 using the connector 50, the tongue member 52 is pushed into the groove 2 defined by a flange 20 of a tongue and groove panel 4. Then the tongue of a second panel 4 is pushed into and engages in the groove 2 of the first panel 4. Thus the tongue member 52 is sandwiched between the flange 20 defining the groove of the first panel and the tongue of the second panel 4. The connector 50 is crimped so as to hold it securely in position. A second connector 50 is then positioned close to the groove 2 of the second panel 4 and the tongue member 52 of this second connector 50 is engaged in the groove of the second panel 4 and then the tongue of a third panel is also pushed into the groove 2 thereby sandwiching the tongue member 52 in place. Each connector 50 is crimped and the panels are held securely on the T-bar by using connector 50. This sequence is repeated until the entire ceiling has been constructed.

If desired, a screw may be pushed through aperture 56 located on the body 57 and may be used to provide additional security in holding the connector on the T-bar 1.

Figure 2:
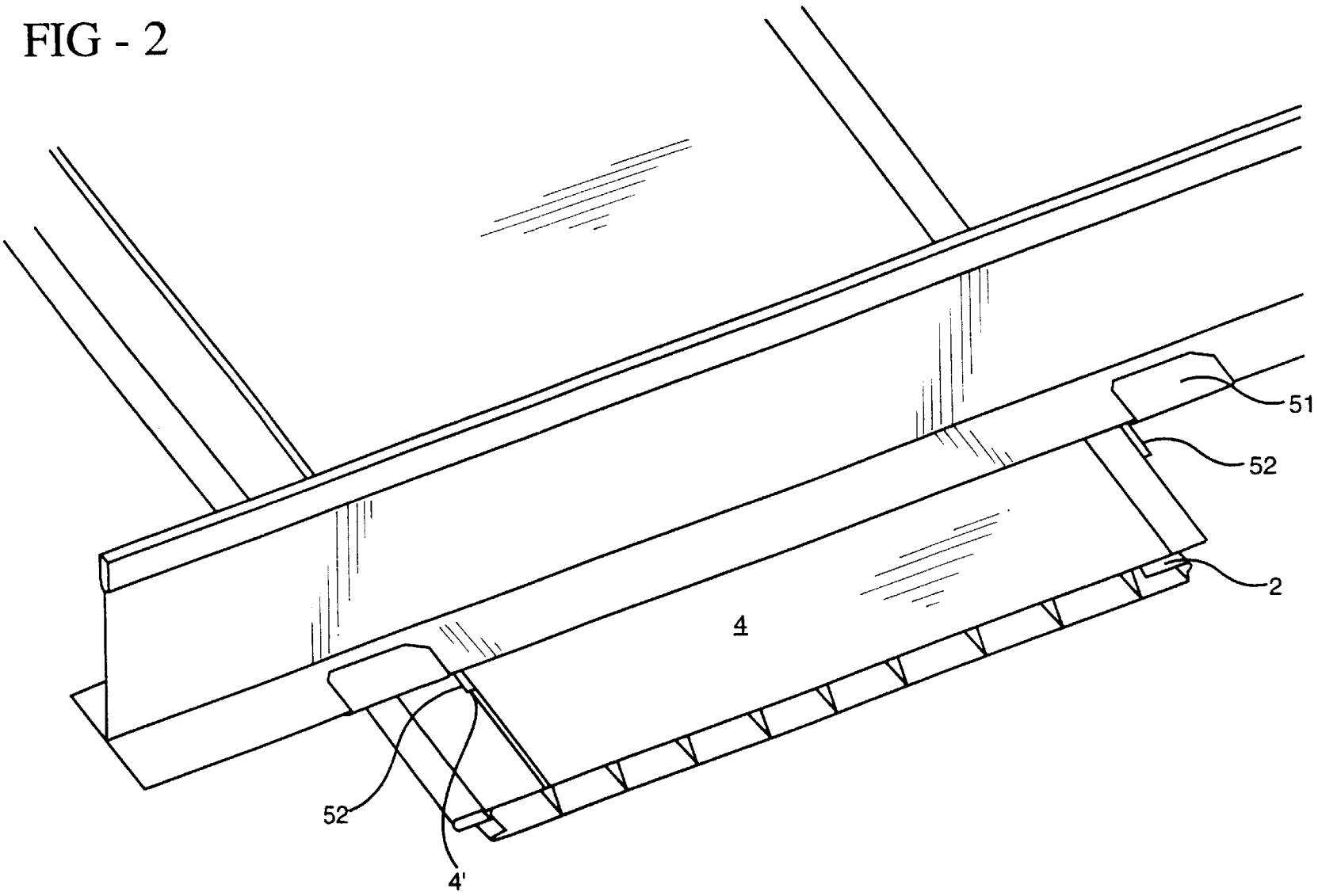

It should be noted that in order to hold the first panel 4 in position on the T-bar 1 before any other panel is engaged therewith, an operator may make a slit in the tongue side of the panel and the tongue member 52 of a connector 50 may be inserted therein so as to hold this first panel in place while a second panel 4 is being brought into engagement therewith. Referring now to FIG. 2, a connector 50 is shown holding a panel on a T-bar with the wings 52 folded over onto the horizontal flanges 11 of the T-bar 1. The tongue member 52 is shown inserted in the groove 2 of the panel 4 while on the tongue side of the panel 4, a slit 4' is made on the panel and tongue member 52 of the second connector 50 is inserted therein.

Figure 2A:
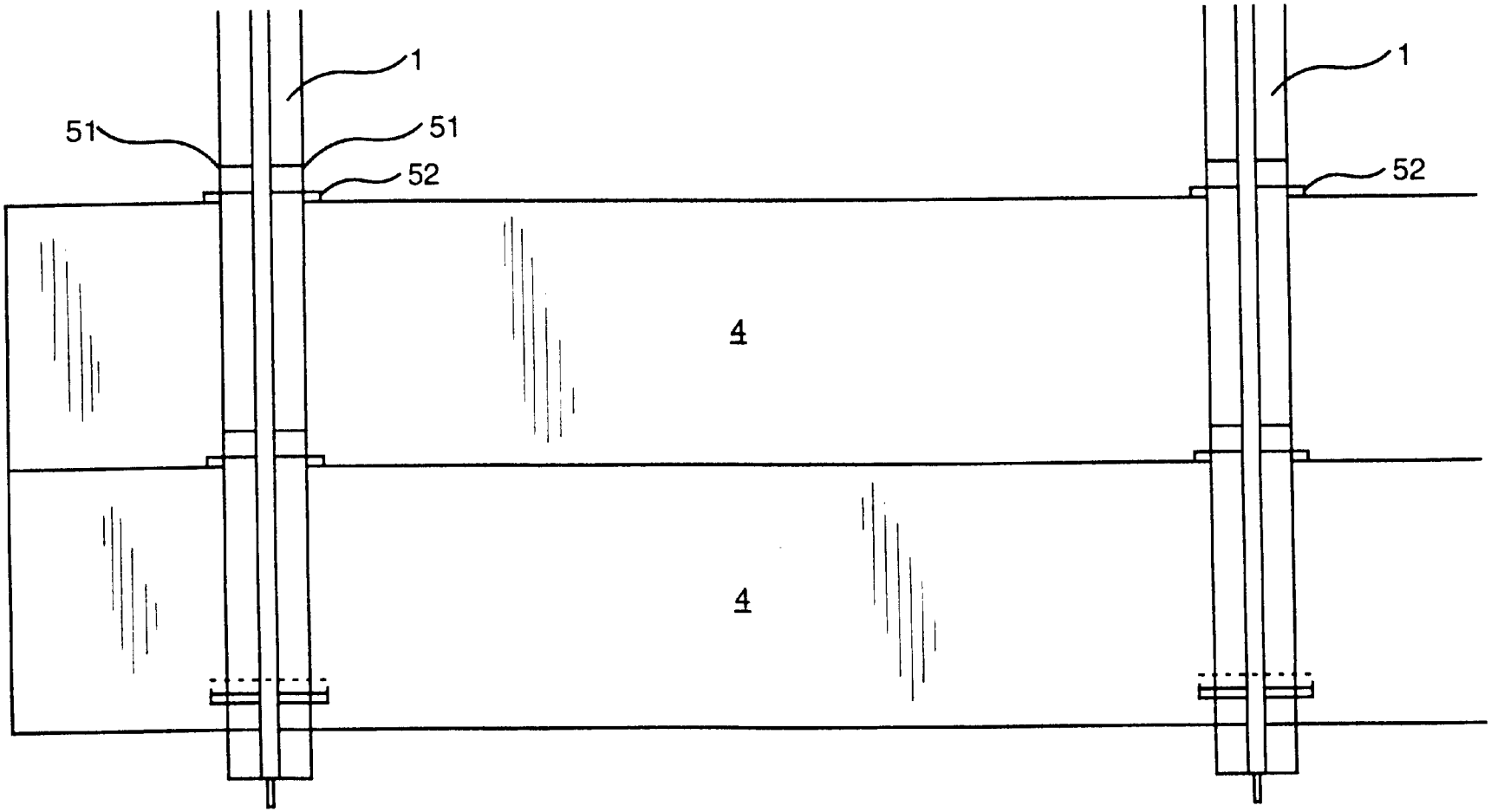

FIG. 2*a* shows the view from above with the respective tongue members 52 of connectors 50 inserted in the grooves 2 of panels 4. To form a trap door, a slit may be made in the panel and the tongue member 52 inserted therein so as to hold the panel 4 on the ceiling grid.

Figure 2B:
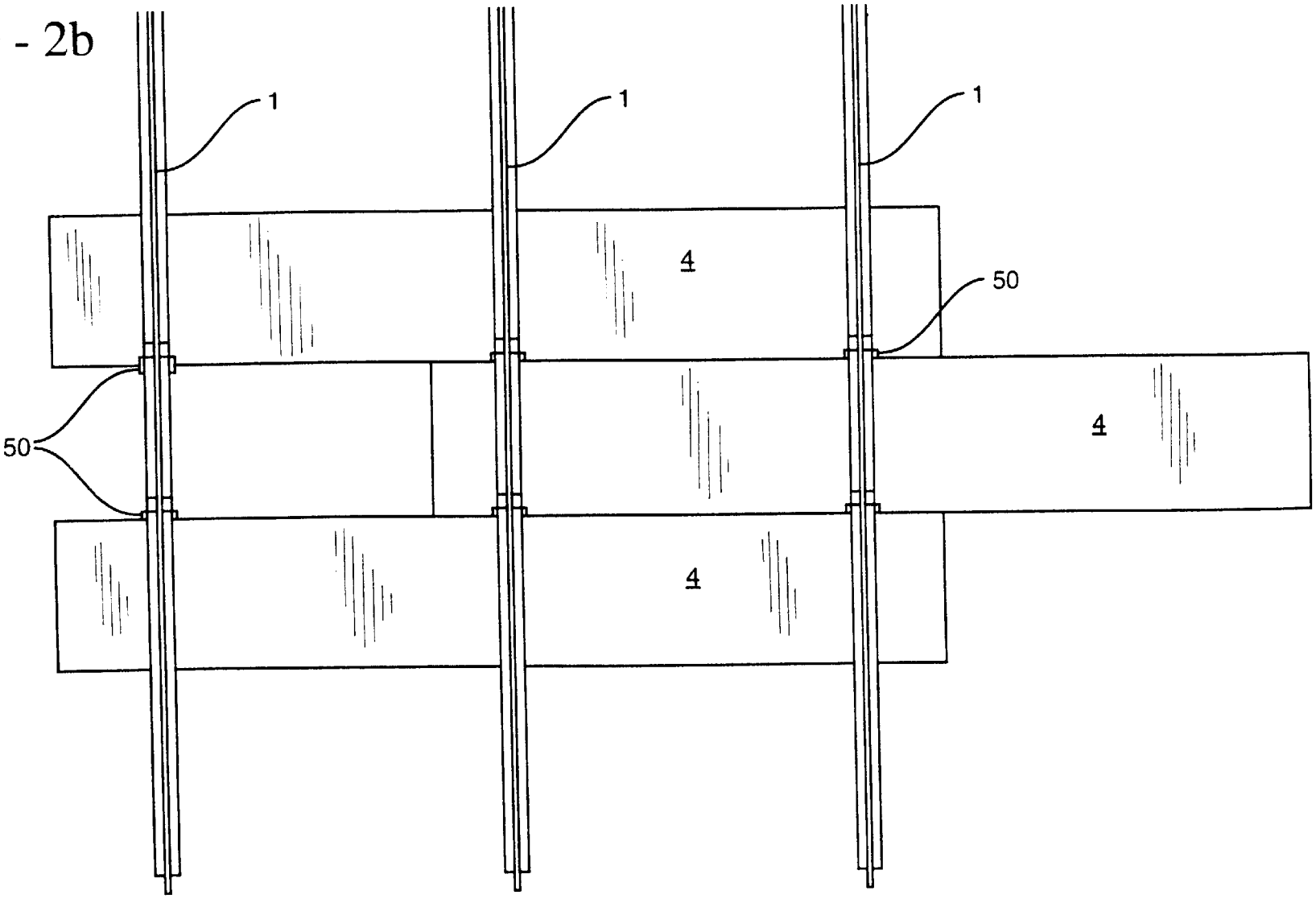

FIG. 2*b* shows how a damaged panel may be replaced by a new panel 4. The damaged panel may be easily slid out transversely across the tongue members 52 of connectors 50 and the new panel slid in, in the same manner, in its place. Previously, in the prior art, the use of a lot of nails and screws was required especially when replacing broken or damaged panels.

The T-bar 1 has holes along its vertical section 10 so that the T-bar 1 can be suspended directly from the existing ceiling structure or from brackets mounted on a wall depending on whether one is using the connector 50 and T-bars 1 for the construction of a suspended ceiling or a wall, respectively.

With reference to FIGS. 26 to 37, various uses of the connector 50 will now be described.

Referring now to FIG. 26, the connector 50 is shown in use with a joint profile indicated generally by reference numeral 500'. The respective tongue members 52 of the connectors 50 are inserted in the groove of the joint profile 500'. In this way, a joint profile 500' is connected across two parallel T-bars 1 which form the ceiling grid network. A tongue of a tongue and groove panel or the edge of a flat edge panel (not shown) may then be inserted in each groove of the joint profile 500' and a ceiling or wall is then constructed using the panels and connectors 50 in the manner described above.

FIG. 27 shows the connectors 50 in use with an internal corner profile indicated generally by the reference numeral 273 which is required at internal corners. The connectors 50 are used to hold the internal profile trim 273 on the T-bar so as to allow construction of a wall around an internal corner. The connector 50 may be connected to a T-bar or wall track depending on which of these is being used.

FIG. 28 shows the connectors 50 in use with an external corner profile indicted by the numeral 283. The external corner profile 283 is used at external corners to allow the wall to be constructed around an external corner.

FIG. 29 shows the connector 50 in use, holding a perimeter profile 5 on the horizontal flanges 11 of a T-bar 1. Instead of using the perimeter connectors 200, 250, the connector 50 can be used instead and this maintains the T-bar parallel with other T-bars in the ceiling grid network.

We refer now to FIG. 30*a* in which the connector 50 is shown in an alternative use. The tongue member 52' is turned upwardly, i.e. perpendicular to the body 57 of the connector 50 rather than lying co-planar with the body 57 as previously shown. In this manner, the connector 50 may be screwed directly to the existing wall structure instead of using an angle trim 3 together with a perimeter connector 200, 250. Thus, the connector 50 can be used to connect the T-bar 1 of the ceiling grid network to the existing wall structure using a screw inserted through the tongue member 52'. The connector 50, when used thus, can be used to substitute the entire angle trim 3 all around the perimeter of a ceiling or wall and this can be very convenient if an operator runs out of angle trim while on site constructing a ceiling or wall. Therefore, the use of connector 50, saves enormously on down-time.

We refer now to FIGS. 31 and 31*a* in which is shown an alternative use for the connector 50 at bulkheads, the connector 50 when used in this manner is indicated generally by the reference numeral 310. The connector 310 is used for connecting a bulkhead and holding it in place on the ceiling grid network. The wings 311 of a first connector 310 are pushed onto the horizontal flanges 11 of a first T-bar 1. The tongue member 312 has two slits made therein on site, forming two portions 314 which are bent upwardly, perpendicular to the plane of the tongue member 312. Two slits are also made on the bulkhead profile 5' and each portion 314 of the connector 310 is pushed through each respective slit in the inner leaf of the bulkhead profile 5'. Each portion 314 is then bent backwardly so as to abut against the upper side of the inner leaf of the bulkhead profile 5'. The tongue member 312 of connector 310 together with the portions 313 are inserted into the groove of the bulkhead profile 5' and abut against the underneath of the profile 5'. A second connector 310 is connected by having its wings 311 folded over onto the horizontal portion 11' of a second T-bar 1'. The portion 313 together with the tongue member 312 are inserted in the other groove of the bulkhead profile 5' and abut against the rear of the inner leaf of the bulkhead profile 5' while each portion 314 is inserted into two slits made on the inner leaf of the bulkhead profile 5' so that the portions 314 are folded upwardly and abut against the front of the inner leaf of the profile 5' thereby holding the T-bar 1' securely in place. The connector 310 of this embodiment can also be used at external corners.

We refer now to FIGS. 32, 32*a* and 33 in which an alternative use of the connector 50 is shown. Referring initially to FIG. 32, the connector 50 is connected to the horizontal flanges 11 of the T-bar 1 and the tongue member 52 is bent backwardly towards the body 57 such that the tongue member 52 is protruding perpendicular to and downwardly from the horizontal flanges 11 of the T-bar 1. A second T-bar 1' is brought into abutment with the horizontal portion 11 of the first T-bar 1 so that the vertical portion 10' of the second T-bar 1' abuts against the body 57 of the connector 50. The tongue member 52 is brought into abutment with the horizontal portion 11' of the second T-bar 1' and the end portions 54 of the tongue member 52 are folded over onto the horizontal portion 11' thereby holding the second T-bar 1' attached to the first T-bar 1 to form the bulkhead.

We refer now to FIG. 34 in which the connector 50 is shown attached to the horizontal portion 11 of T-bar 1. The tongue member 52 is inserted in the groove 2 of a UPVC panel 4 and an end portion 54 of tongue member 52 is bent downwardly so that it is abutting against the edge of the panel 4 as to hold the panel securely in place. This arrangement is suitable for use around a light fitting. The advantage of using the connector 50 in this application is that it prevents the panels from moving and hitting off the light fitting. A perimeter profile is then inserted over the edge of the panel 4 so as to provide a smooth finish around a light fitting. The end portion 54 of tongue member 52 can be slit and can then be bent backwardly onto the perimeter profile so as to secure the profile in place.

FIG. 35 shows an additional use for the the connector 50 The tongue member 52 is bent upwardly and is fixedly attached to the wall and a perimeter connector 250' is used to hold a perimeter profile 5 on the connector 50. The connector 50 may be used in this manner when the connectors 50 are also being used in the application shown in FIG. 30 i.e. when an angle trim is not being employed and the connector 50 with T-bar 1 connected thereto is being used at spaced apart intervals. Then the connector 50 can also be used with the perimeter connector 250' to hold the perimeter profile 5 in place. The connector 50 is used to hold the perimeter profiles in place as shown in FIG. 35 at locations between points where the T-bar is secured to the wall as shown in FIG. 30.

FIG. 36 shows the connector 50 being used to hold a T-bar on an angle trim 3 and holding a perimeter profile 5 connected to the angle trim 3 and T-bar 1. This is an alternative use for the connector 50 which may be useful as a substitute for using a perimeter connector 250, 250', 250" or 255 for connecting the perimeter profile 5 to the angle trim 3. A perimeter connector may also be used at locations between the points where T-bars are located. Using the connector 50 in this manner stabilises the T-bar on the angle trim 3 rather than just allowing the T-bar to rest on the angle trim 3 as in the prior art.

FIG. 37 is a view showing the connectors 50 holding two T-bars connected together. This is required around ducting and vents to hold the T-bars securely in place.

We refer now to FIGS. 6 and 6*a* in which a connector in accordance with an alternative embodiment is shown. This connector is indicated generally by the reference numeral 60 and includes a tongue member 62, wings 61 and flaps 63 which have apertures 64. The connector 60 is brought into contact with the horizontal flanges 11 of the T-bar 1 and the wings 61 are pushed inwardly and downwardly onto the horizontal flanges 11, so that the connector 60 is secured on the T-bar 1. The connector 60 may then be moved along the T-bar 1 to any desired location. The flaps 63 are then brought into contact with the vertical section 10 of the T-bar 1 and the flaps 63 are screwed to the main T-bar 1 thereby fixedly holding the connector 60 in position on the main T-bar 1.

Referring now to FIGS. 7, 7*a* and 7*b* in which a connector in accordance with an alternative embodiment of the invention is shown. This connector is indicated generally by the reference numeral 70 and includes a tongue member 72, wings 71, flaps 73, and overhead portion 74. The connector 70 is brought into contact with the T-bar 1 with the tongue member 72 aligned with the horizontal flanges 11 of the T-bar 1. The connector 70 is positioned at any desired location along the T-bar 1 and the wings 71 are then pushed inwardly onto the horizontal flanges 11. The flaps 73 abut against the vertical section 10 of the T-bar 1 and the overhead portion 74 abuts against the top of the vertical section 10 so as to provide extra strength.

We refer now to FIG. 8 in which is shown an alternative embodiment of the present invention and in which the connector is indicated generally by the reference numeral 80. The connector 80 comprises two wings 81 and two tongue members 82. The connector 80 is useful where it is desired to engage each tongue member 82 into the groove of a panel 4. Alternatively, one may engage one tongue member 82 into the groove of one panel and the other tongue member 82 into the tongue side of a second panel, by firstly making a slit using for instance, the blade of a knife, into the panel on its tongue side and the tongue member 82 may then be inserted into the slit. The connector 80 is particularly useful with butt joint panels and when using profiles. Each tongue member 82 can be bent so that it is arranged at an angle to the body of the connector 80 and thus the connector 80 can be used at internal and external corners if one does not wish to use internal and external corner profiles, respectively.

We refer now to FIGS. 9 and 9*a* in which a connector 90 is shown in an alternative embodiment of the present invention. The connector 90 is useful where a circular pipe or tube is provided instead of a T-bar. The connector 90 comprises tongue member 92, wings 91 and flaps 93. The flaps 93 include holes through which a screw may be inserted in order to secure the connector 90 onto the tube.

Referring now to FIGS. 10*a*, 10*b* and 10*c*, an alternative connector is shown and is indicated generally by reference numeral 100. The connector 100 comprises wings 101 and tongue member 102. The connector 100 is designed for use with heavy UPVC panels, grooved panels and cladding board. The wings 101 are folded over onto the horizontal flanges 11 of a T-bar 1 or the horizontal flanges of a wall track 610 (described below).

With particular reference to FIG. 10(*c*), a panel can be secured in place using the connector 100 by sandwiching the panel between the tongue member 102 and the wall track 610. Alternatively, the tongue member 102 can be bent so that the connector 100 can be used to form bulkheads, external corners, internal corners and butt joints.

FIGS. 11 and 12 show respectively two further alternative embodiments of the connector of the present invention which are identified by numerals 110 and 120 respectively and include wings 111 and 121, respectively, for holding the connectors 110 and 120 on T-bars.

FIG. 11*a* shows the connector 110 in an alternative use showing that in addition to attaching a panel to a T-bar 1, it may also be used to hold a display such as an EXIT sign, on the T-bar.

Referring to FIGS. 11*b* and 11*c*, the connector 50 in an alternative embodiment can also be used for holding signs onto the T-bar. The connector in this embodiment is indicated generally by reference number 110'. The connector 110' includes wings 111' and tongue member 112' which is turned perpendicularly downwardly from the body of the connector 110', the tongue member 112' having an aperture 116'. The wings 111' are connected to the T-bar 1 in the manner described previously and the hooks of the exit sign are hung from the aperture 116' on the down-turned tongue member 112'.

FIG. 13 shows the connectors 110 and 120 respectively, located on the T-bar 1. The connector 110, 120 is ideal for use at butt joints, access panels and trap doors. The connectors 110, 120 can be used with tongue and groove type panels and flat edge panels. In either case, the panel edge is inserted in the hook member which is formed when the tongue member is bent perpendicularly downwardly from the plane of the body of the connector and then rearwardly so that the tongue member is parallel to the body of the connector. With the panel inserted in the hook member 102, there is a smooth finish achieved, as required at trap doors and access panels.

FIGS. 14 and 14*a* show the connector of the invention in an alternative embodiment. This connector which is indicated generally by the reference numeral 140 includes wings 141 and oppositely directed tongue members 142, is designed particularly for use with panels which do not include a flange at the groove of the panel. This connector 140 is ideal for use in dry lining and plaster board slabbing applications. A panel or dry-lining board (usually plasterboard) can be inserted between a tongue member 142 so that the panel is sandwiched between the tongue member 142 and the horizontal flanges 11 of the T-bar. Alternatively, the tongue member 142 can be inserted in a groove of a panel to hold the panel in place.

Referring to FIGS. 14*b* and 14*c* the connector in an alternative embodiment is shown. The connector in this embodiment is indicated generally by the reference numeral 146. The tongue member 142' is arranged at an angle of 45° to the wings 148. This connector 146 is used to achieve a diagonal arrangement ("herring bone" effect) of panels and produces an aesthetically pleasing effect. The connector 146 has the advantage that the operator does not need to measure the required angle since it is already provided by the connector 146.

We refer now to FIGS. 15*a* and 15*b*. A connector 150 is indicated and includes wing members 151 which are formed in the closed, operational position and a tongue member 152 which is arranged at an angle of 45° to the body 155 of the connector 150. The connector 150 also includes an aperture 156 through which a screw may be inserted, if desired. This connector 150 is also used to achieve a diagonal arrangement i.e. "herring-bone" aesthetic effect of panels as shown in FIG. 15*b*. Because the wings 151 are formed in the closed position, the connector 150 is attached to a wall track 610 (described below) by positioning the connector 150 close to the wall track 610 with one wing 151 positioned immediately above the wall track 610 and the other wing 151 immediately below the wall track 610. The connector 150 is pivoted onto the wall track 610 rather than having to fold the wings 151 over onto the flanges of the wall track. Thus, the connector 150 is particularly suited for situations when a connector must be attached to a wall track and the operator is working close to the wall or ceiling, as the case may be, and there is not enough room for the wings to be folded over the wall track 610.

We refer now to FIG. 16 in which is shown an alternative connector 160 including a body 165, tongue member 162 and wings 161. The connector 160 also includes an aperture 166. The wings 161 are formed in the closed position and the connector is pivoted onto the wall track 610 in the same manner as described for the connector 150. The connector 160 is also particularly suited for working closely against the wall or ceiling and is similar to connector 150 except that the connector 160 does not have a 45° angle but has the standard 90° between the tongue 162 and body 165. FIG. 16*a* shows the connector 160 located on the T-bar with the tongue member 162 inserted in the groove 2 of panel 4.

We refer now to FIGS. 17 and 17*a* in which are shown a connector 170 in an alternative embodiment of the invention. The connector 170 is similar to the connector 50 except that the tongue member 172 is formed in the shape of a semi-circle.

In FIG. 18, a unit comprising a C-channel and connector 50 is shown. For some applications, it may be desirable to use a C-channel rather than a T-bar; a connector 50 in accordance with the present invention may also be used in conjunction with the channel. The connector is used to hold panels in position in the same manner as already described above, i.e. the tongue member 52 engages in the groove of a panel.

Referring now to FIG. 19, a unit 190 comprising a baton 191 with groove 192 is shown with the connector 195 held thereon. This baton 191 may be manufactured from plastics material, wood, or metal such as steel or aluminium, for instance. The baton 191 may be used instead of a T-bar for some applications; the connectors 50 can also be used with batons 191.

Referring now to FIGS. 20 to 25*d* inclusive, connectors in alternative embodiments for connecting perimeter profiles and angle trims to a T-bar or wall track, in accordance with the third aspect of the invention will described. Referring initially to FIG. 20, a connector for affixing perimeter profiles to wall tracks and ceiling grid networks is shown in a first embodiment and is indicated generally by the reference numeral 200. The profile connector 200 comprises a hook member 201 and a ledge portion 202.

FIG. 21 shows the profile connector in an alternative embodiment which is indicated generally by the reference numeral 215. The profile connector 215 comprises a hook member 216 and ledge portion 217.

Referring now to FIGS. 22*c* and 22*d*, the profile connectors 200 and 215, respectively, are shown in use, connecting a perimeter profile 5 and a joint profile 500 respectively, with horizontal flanges 11 of a T-bar. In order to secure the perimeter profile connector 200 and joint profile connector 215, respectively, the respective ledge portions 202, 217 are crimped onto the respective profiles 5, 500 and the respective hook members 201, 216 are hooked onto the horizontal flanges 11 of the T-bar 1. The perimeter profile 5 is used at floor level to support panels which will be built up parallel to the existing wall structure. The ledge portion 202 bears the weight of the panels rather than having the weight of the panels being borne by the perimeter profile and this supports the panels comprising the wall.

The joint profile 500 may be used instead of the perimeter profile 5 if it is desired to have the edge of the floor covering such as the carpet, pushed up into the joint profile 500 so that there are no gaps between the wall and floor carpet or similar floor covering, for hygiene reasons.

The connectors 200, 215 can be used with both tongue and groove type UPVC panels and flat edge panels.

Referring now to FIG. 22, profile connectors in alternative embodiments are shown. These profile connectors are indicated generally by numerals 220 and 225 and include respective hook members 221 and 226. As shown in FIGS. 23 and 24, in use the respective hook members 221, 226 grip a profile 500 and hold it in place on a T-bar which comprises the ceiling grid or which may in turn be affixed to the existing wall structure by means of a bracket.

Referring to FIGS. 25*a* to 25*d*, perimeter profile connectors in alternative embodiments are indicated generally by the reference numerals 250, 250', 250" and include respective hook members 251, 251', 251", having respective (detents) catch members 253, 253', 253" thereon and the connectors also have respective ledge portions 252, 252', 252". These perimeter profile connectors 250, 250', 250" are used to connect an angle trim 3 to a perimeter profile 5. The respective hook members 251, 251', 251" together with respective catch member 253, 253', 253" engage in the groove 3' of angle trim 3 and thereby hold the angle trim 3 and the perimeter profiles together while the respective ledge portions 252, 252', 252" abut against either the perimeter profile 5 or as shown in FIG. 25*d*, the angle trim 3. The ledge portion 252" may be screwed fixedly in position onto the angle trim 3. Thus the angle trim 3 is connected to the perimeter profile 5 using perimeter profile connectors and then the angle trim 3 maybe screwed to the existing wall or ceiling structure. The angle trim 3 is used around the perimeter of a ceiling or wall and is also used at bulkheads which occur where a wall or ceiling is being constructed over air ducts, piping and other services.

FIGS. 25*e* and 25*f* show an alternative perimeter profile connector 255 including a ledge portion 257, in use with an alternative angle trim 3". The connector 255 operates in the same manner as described above except that it does not include a catch member but is secured in place by a screw.

We refer now to FIGS. 55 and 55*a* in which an alternative profile connector indicated by reference numeral 550 is shown. The connector 550 comprises a hook member 553 and a ledge portion 555. The hook member 553 includes a kink 557. The connector 550 is used to connect an angle trim 3 to a perimeter profile 5. In order to secure the angle trim 3 and the perimeter profile 5 together, the respective limbs of the respective trims 3 and 5 are brought into alignment and the connector 550 is pushed onto the two trims 3, 5 respectively, so that the ledge portion 555 is inserted into the groove of the perimeter profile. The profile of the hook member 553 together with the kink 557 assist in griping the angle trim 3 and holding it to the perimeter profile 5. A tongue of a panel 4 (not shown) will then be pushed into the groove of the perimeter profile 5 thereby forcing the ledge portion 555 inwardly and maintaining the connection between the angle trim and the perimeter profile. Use of the connector 550 has the advantage that there is no need to drill a timber piece to the perimeter profile or staple the angle trim to the timber as was necessary in the prior art.

Referring now to FIGS. 38 and 38*a*, the present invention in a fourth aspect will be described. These figures show a panel or plank rest connector indicated generally by the reference numeral 380. The connector 380 comprises a tooth 382, mouth 381 and hook member 383. The connector 380 is used to conveniently allow the positioning of a panel 4 in any desired location. The panel 4 may be supplied in ten foot or twenty foot lengths and usually three or four operators are required for off-loading this length of panel from a truck and positioning it where required across a ceiling or a wall. The connector 380 may be conveniently located on a main T-bar 1 by hooking the hook member 383 over the vertical portion of the T-bar or dry lining. The length of panel 4 may be conveniently rested on the tooth 382 and then pulled through the mouth 381 and may be located as required. This operation may be carried out by one person since the main weight of the panel 4 may be allowed rest on the tooth 382. This panel or plank rest connector 380 is very convenient for handling lengths of panels or dry-lining.

We refer now to FIGS. 39 and 39*c* in which a fifth aspect of the invention is shown. In this aspect, the present invention provides a key indicated generally by the reference numeral 390, for use with trap doors and access panels. The key 390 comprises a substantially L-shaped member 391 and a cap 392, a seal member 393 may be used in conjunction with the key 390. The key 390 may be coloured so as to provide an easy means of identification of the location of a trap door and or access panel. When the key is in the closed position as shown in FIG. 39*a,* it prevents the panel being pushed upwardly when pressured is applied there to the underneath surface of the panel 4, for instance, when the panels are being washed.

Referring now to FIGS. 40 and 40*a,* an alternative connector for clip-on panels and blades which comprise a shaped channel is shown. The connector of this alternative embodiment is indicated generally by the reference numeral 40 and includes a wing 401 and flap members 401'. The connector 401 also includes arms 402 for engaging underneath the lip (not shown) of another clip-on panel. The connector 400 may be pushed onto a clip-on panel (C-channel) such that the side portions 405 abut against the sides of the C-shaped channel. The connector 400 may be secured on the channel by pushing the wing 401 downwardly onto the inside of the channel and similarly by pushing the flaps 401' onto the channel.

We refer now to FIG. 40*b,* 40*c* and 40*d* in which an alternative embodiment of connector for clip-on panels or blades is shown. This connector is indicated generally by the reference numeral 405 and includes wings 409 and arm members 407. This connector 405 is designed for use with clip-on panels (C-channels) 20 which include a lip 22 and which are adjoined and which have an in-fill 21 there between. The clip-on panels (C-channels) 20 are connected to the T-bar 1 by firstly folding the wings 409 onto the horizontal flanges 11 of a T-bar. The arm members 407 are then inserted underneath the lip 22 of the C-channel 20. With the wings 409 pushed onto the horizontal portion of the T-bar 1, the channels 20 are secured in place on the T-bar 1. The in-fill 21 is then positioned between the C-channels 20. The use of C-channel 20 and connector 405 allows the construction of varied appearances of ceilings or walls having tongue and groove UPVC panels abutting the C-channels 20 by inserting the flange defining the groove 2 of a tongue and groove panel so that the flange is sandwiched between the horizontal flanges 11 of the T-bar and the lip 22 of the C-channel 20.

We refer now to FIGS. 41 and 41*a* in which a swivel connector for use with clip-on panels and blades is shown. This swivel connector is indicated generally by the reference numeral 410 and includes an upper portion 410" and a lower portion 410'. The upper portion 410" includes wings 412 and the lower portion 410' includes arm members 411. The upper and lower portions 410", 410' respectively, are connected by a swivel joint 415. The arms 411 are inserted underneath the lip 22 of a channel 20 while the wings 412 are pushed onto the horizontal portion of the main T-bar thus the upper portion is comprised of the wings 412 is held stationary on the main T-bar while the lower portion including the flaps 411 holding the channel 20 in place, is allowed to swivel through an angle of 360°.

Referring now to FIGS. 42 and 42*a,* a connector indicated generally by the reference numeral 420 is shown. The connector 420 comprises a base portion 424 and wings 422. The connector 420 is attached, for instance, by gluing to a tongue and groove panel 4. In FIG. 42*a*, a T-bar 1 is shown slided through the connector 420 with the horizontal flanges 11 of T-bar 1 fitting in the space provided between the base portion 424 and the folded wings 422. The T-bar 1 may be moved relative to the panel 4 so that the panel may be located at any desired position along the T-bar 1. The connector 420 may thus to be used to connect the T-bar to the panel 4 and may be used in constructing a suspended ceiling or a wall.

In FIGS. 43 and 43*a,* a bracket connector is indicated generally by the reference numeral 430. The bracket connector 430 comprises an L-shaped member with clip members 432 integrally formed on each side of the L-shaped portion of bracket 430. The longer limb of the L-shaped portion of bracket 430 is screwed to the wall and the clip members 432 are pushed onto the vertical section 10 of the T-bar 1, thus gripping the T-bar 1 tightly. In this way, it is necessary to screw the bracket on one limb only, of the L-shaped portion of the bracket 430 and the T-bar 1 is held securely against the wall. Thus a network of T-bars 1 can be attached to the wall and wall panels may then be attached to the T-bars 1 by means of connector 50 described above. The bracket connector 430 provides an extremely convenient means of constructing a wall out from an existing wall structure.

We refer now to FIGS. 44 and 44*a* in which is shown an alternative type of connector, indicated by reference numeral 440, for suspending T-bars from the existing ceiling structure. The connector 440 comprises clip members 443 and an upstanding portion 444 having an aperture 445 formed therein. The clip members 443 are pushed onto the vertical section 10 of the T-bar 1 and thus grip the T-bar 1 securely. The shape of the connector 440 is such that the connector 440 is in a mating arrangement with the section 9 of the T-bar 1. Steel suspension wire or hanging angle may be inserted through the aperture 445 and tied securely so as to suspend the T-bar 1 from the existing ceiling structure.

We refer now to FIGS. 45 and 45*a* in which is shown a connector 450 comprising a backing member 451 and hook member 453, wings 452 and base portion 454. The connector 450 is used for holding an angle trim 3 on T-bars 1 comprising the ceiling grid network. The connector 450 is ideal for use with reinforced concrete or steel walls into which it is extremely difficult to insert screws. Use of this angle trim connector 450 eliminates the necessity for screwing or stapling since the angle trim connector 450 holds the angle trim 3 on the T-bar 1. The angle trim connector 450 is also ideal for use with floating ceilings i.e. suspended ceilings which are not in contact with the walls so that in using the connector 450 there is no need to fix the angle trim 3 to the wall. The hook member 453 of the connector 450 is crimped onto the angle trim 3 and the connector 450 is held on the T-bar 1 by means of the wings 452. The wings 452 may then be crimped in position and the angle trim 3 held securely in place on the T-bar 1.

We refer now to FIGS. 45*c* and 45*d* in which is shown an alternative connector to the type shown in 45*a* and 45*b*. This alternative angle trim connector is indicated generally by the reference numeral 450' and includes a backing member 451' and wings 452'. The connector 450' is similar to connector 450' except that there is no hook member included in the connector 450'. Thus, to connect the angle trim 3 to the T-bar 1, the connector 450' is crimped onto the angle trim 3 and the wings 452' are folded over onto the T-bar 1, thereby holding the angle trim 3 in position on the T-bar 1. In this embodiment, the wings 452' are movable between an open, inoperational position and a closed, operational position whereas the wings 422, 452, of connectors 420, 450' are formed in the closed position.

We refer now to FIGS. 46 and 46*a* in which is shown a connector 460 for use with an alternative type of UPVC panel system. The connector 460 is used to attach an alternative panel 4' to T-bar 1. The connector 460 comprises wings 461 and stepped portion 466. The stepped portion 466 fits snugly over the tongue section 44 of the panel 4' and the wings 461 are folded over onto the horizontal flanges 11 of the T-bar 1 and crimped securely in place.

FIG. 47 and FIG. 48 show respective connectors, in alternative embodiments, for connecting panels to a T-bar. These connectors 470 and 480, respectively, operate in a similar manner to those previously described except that connectors 470 and 480 are manufactured from spring-like material. The connector 470 comprises wings 471 which fold over onto the T-bar and hold connector 470 on the T-bar 1. A tongue member 472 is included to engage with a panel (not shown).

FIG. 48 shows connector 480 comprising wings 481 and tongue member 482 which operates in the same manner as described in relation to FIG. 47.

We refer now to FIGS. 49 and 49*a* in which is shown a connector indicated generally by the reference numeral 490, for engaging in two panels and connecting both to a T-bar 1. The connector 490 comprises two tongue members 492 together with wings 491. This connector 490 is used to achieve a "herring bone" effect i.e. the tongue member 492 is arranged at an angle of 45° to the wings 491 and is used to achieve a diagonal arrangement of panel's and produces an aesthetically pleasing effect without involving the extra labour of having to measure the desired angle. The connector 490 by virtue of the two tongue members 492 is capable of engaging a panel (not shown) on each tongue member 492. Alternatively, the connector 490 can be used to hold an alternative type of clip-on panel on a T-bar with the wings 491 folded over onto the horizontal flanges 11 of the T-bar and the tongue members 492 each engaged underneath a lip of a C-channel.

We refer now to FIG. 50 in which is shown a wall/ceiling grooved cladding lath 500. The cladding lath 500 is screwed to the wall or to the ceiling and the connectors of the invention can be mounted on the cladding lath 500 using the wings which may be folded over onto the protruding portion of the cladding lath 500. This cladding lath 500 is manufactured so as to compliment the connectors of the present invention. Use of such a cladding lath enables an operator to construct a wall/ceiling close to the existing wall ceiling structure.

We refer now to FIGS. 51 and 51*a*, in which is shown a connector 510 comprising wings 511 and grip members 512. The grip members 512 are manufactured from resilient material such as spring steel. The connector 510 may be attached to a horizontally aligned T-bar 1 or wall track 610 by folding the wings 511 tightly over onto the horizontal flanges 11 of the T-bar 1. A second T-bar 1 may then be brought into vertical arrangement with the first T-bar 1 and the connector 510 may be attached to the second T-bar 1 by pushing the vertical section 10 of the T-bar into the grip members 512 of the connector 510. In this way, two T-bars may be readily connected together. Use of this particular connector 510 allows a framework of T-bars to be constructed. This framework may then be used to construct a wall from a variety of panels. The T-bars may be affixed to the existing wall structure using the brackets 430 described above and shown in FIG. 43 and panels can be attached to the T-bars using the connectors of the invention. The connector 510 is also ideal for use with end panels.

An alternative embodiment of connector 510 is shown in FIG. 52 and is indicated generally by reference numeral 520. The connector 520 comprises wings 521 and grip member 522. The grip members 522 are manufactured from resilient material. The connector 520 is stronger than the connector 510. Connector 520 is used to connect two T-bars in the manner described above by folding the wings 521 over onto the horizontal flanges 11 of a first T-bar 1 and by pushing the vertical section 10 of a second T-bar 1 into the grip members 522 so that the second T-bar 1 is clipped securely in the connector 520.

Referring now to FIGS. 53 and 53*a*, a further alternative connector 530 is shown. The connector 530 comprises base portion 535, wings 531 and grip members 532. The grip members 532 are manufactured from resilient material. The wings 531 are used to secure the connector to a first T-bar 1 while a second T-bar 1 is engaged in the grip members 532. The grip member 532 is pop riveted in the centre so that the grip member 532 is movable with respect to the base portion 535 thereby allowing the first T-bar to be moved with respect to the second T-bar to any desired angle.

We refer now to FIGS. 54*a* and 54*b* in which is shown a connector strip 540 having a screw 16 inserted therethrough. The connector strip 540 with screw 16 is mounted on a wall and a liner panel 6 is brought into contact with the connector strip 540. The edges of the connector strip 540 are pushed underneath the lip 67 on the liner panel 6. Thus the liner panel is fixed in position on the connector strip 540 and since the connector strip 540 may be rotated with respect to the screw 16 thus the liner panel 6 may be turned and arranged at any desired angle to obtain a pleasing novel aesthetic effect. All the connectors in accordance with the present invention are moveable along the T-bar or wall track whichever is being used.

Referring now to FIGS. 54*c* and 54*d*, an alternative connector strip 540' is shown in which a nail is used instead of a screw.

Referring now to FIGS. 56, 56*a*, 57 and 57*a*, connectors 560 and 570, respectively are shown. The connector 560 includes an aperture 564 and hook member 563. The connector 560 is used to secure a smoke alarm onto an existing ceiling structure. The connector 560 is firstly mounted on the existing ceiling structure by means of the screw 16'. The hook 563 is then brought into contact with the base of a smoke detector 569 and the hook member 563 is inserted in an aperture (not shown) in the base of the smoke detector 569. In an alternative embodiment shown in FIGS. 57 and 57*a*, the smoke detector may also be mounted in a similar fashion on a T-bar 1 using the connector 570. Connector 570 includes flaps 571. The hook member 573 is interlocked with an aperture (not shown) on the base of the smoke detector 579 in the same way as described in relation to connector 560.

We refer now to FIGS. 58 and 58*a* in which are shown the connector in an alternative embodiment, this connector being generally indicated by the reference numeral 580. The connector 580 includes side walls 582 and wings 581 which are formed in the closed position shown in FIGS. 58 and 58*a*, prior to engagement with the T-bar. The connector 580 is used for connecting a H-shaped channel to a T-bar. In order to use the connector 580, the horizontal flanges 11 of the T-bar 1 are inserted between the closed wings 581 of the connector 580. The connector 580 is then engaged with the wall track in a pivot-like action so that the horizontal flanges 11 are gripped by the closed wings 581.

The wings 581 are then crimped. The H-shaped channel 584 is pushed up against the connector 580 with the side walls 582 of the connector 580 abutting against the sides 585 of the H-shaped channel 584. The side walls 582 of connector 580 are crimped fixedly in position in the H-shaped channel. This allows the H-shaped channel to be connected onto the ceiling or wall grid network.

We refer now to FIG. 59 and 59*a* in which are shown a connector in an alternative embodiment which is indicated generally by the reference numeral 590 for connecting H-shaped channels together, thus allowing for the construction of a partition wall network. The connector 590 includes L-shaped members 593, 594, respectively and side portions 595. The connector 590 is inserted into the channel of a H-shaped channel 584 such that the side portions 595 of the connector 590 abut against the side wall 585 of the generally H-shaped channel. The side walls 585 of the girder taper slightly and the side portions 595 of the connector 590, taper in a corresponding manner. The connector 590 is crimped in position. In order to connect a second H-shaped channel so as to allow for the construction of a partition wall, a second generally H-shaped channel 584 is brought into abutment with the L-shaped member 593 such that the sides 595 of the member 593 abut against the side wall of the second H-shaped channel. The limb 593 is also crimped in place in the channel of the second generally H-shaped channel and in this way the two generally H-shaped channels 584 are securely fixed together.

We refer now to FIGS. 60 and 60*a* in which connector 600 is shown. The Connector 600 is for connecting a C-shaped channel 20 to an angle trim 3. The connector 600 is inserted into the C-shaped channel 20 with the connector 600 pressed in a tight fit arrangement between the side walls of the C-shaped channel 20. The hook member 602 is pushed over the top of the angle trim 3 and is crimped securely in position thereby holding the C-shaped channel 20 in place on the angle trim 3.

We refer now to FIGS. 61*a*, 61*b*, 62 and 63 in which is shown a "Top-hat" shaped wall track 610 which includes horizontal flanges 611 and a channel 613 defined by ribs 612. FIGS. 62 and 63 show the connector 50 in use with the wall track 610. This wall track 610 is used when it is desired to work closely against the wall. The wall track 610 may be secured to a wall by drilling a screw through the raised portion of the wall track. The wings 51 of the connector 50 may then be folded over onto the horizontal flanges 611 of the wall track 610 and crimped in position in a similar fashion as when the wings 51 are being connected on the horizontal flanges 11 of T-bar 1. The dimensions of the flanges 611 are slightly smaller than the dimensions of the wings 51 of connector 50 so that even if there is some expansion of the wall track 610, the flanges 611 can still be accommodated within the wings 51 when they are in the closed operational position.

We refer now to FIGS. 64*a*, 64*b*, 64*c* and 64*d* in which is shown a trap door latch comprising a two part UPVC rivet and a fastener 642. The rivet includes a pin 640 and a sleeve 641 which has a longitudinal slit made thereon resulting in two sleeve members being formed. To use the trap door latch, the fastener 642 is positioned at the desired location at a trap door, the sleeve 641 is pushed into the aperture 643 in the fastener 642 and is inserted into the panel 4. The pin 640 is then inserted into the sleeve 641 and pushed in fully, thereby causing the sleeve members to separate out from each other. This secures the fastener 642 in place on the panel 4. The fastener 642 is rotatable so as to allow a trap door to be opened and subsequently closed. This holds the trap door or an access panel tightly in place when the ceiling is being cleaned which may involve pressure hosing the ceiling in meat packaging factories, for instance.

Referring now to FIGS. 66, 67*a* and 67*b*, a grip tool suitable for use with the connectors of the present invention is shown. The grip tool indicated by reference numeral 660 is used for gripping the connector 50 behind the tongue 52 and sliding the connectors along T-bars 1 and wall tracks 610. The grip tool 660 is also suitable for locating perimeter profiles 5 on UPVC panels by inserting the tool inside the perimeter profile 5 and pulling gently on the grip tool 660. It is also useful for trimming the edges of cut panels 4 so as to leave a smooth finish.

Referring now to FIGS. 68*a*, 68*b*, 69 and 70, a connector 680 in an alternative embodiment for connecting a joint profile (cover slip) to a T-bar 1 of the ceiling grid network will be described.

The joint profile 500 is used at regular intervals along a ceiling or wall for joining flat edged panels together and providing a neat, aesthetically appealing finished appearance on the ceiling or wall. The joint profiles 500 are also used with tongue and groove panels but in that case, the joint profiles are not used at such frequent intervals as is required when using the flat edge panels.

The connector 680 is for connecting joint profiles 500 to a T-bar or wall track, when constructing a wall or ceiling using either flat edge panels or tongue and groove panels. The connector 680 includes wings 681, hook member 685 and flap member 683. In order to connect a joint profile 500 in perpendicular arrangement, to a T-bar 1, the connector 680 is brought into abutment with the horizontal flanges 11 of the T-bar 1 and the wings 681 are folded over onto the horizontal flanges 11 thereby holding the connector 680 in place on the T-bar 1. A joint profile 500 is brought into perpendicular arrangement with the T-bar 1, One side of the joint profile 500 is pushed into the hook member 685 and then the flap member 683 is folded inwardly onto the other side of the joint profile 500 thereby securely holding the latter in place.

Referring now to FIGS. 71*a*, 71*b* and 72, an alternative connection 710 will be described. The connector 710 operates in a similar fashion and is used when the joint profile 500 is parallel with the T-bar 1. The connector 710 includes four wings 711, a hook member 715 and flap member 713. In use, the connector 710 is used in the same manner as connector 680 except that the four wings 711 rather than two wings 681 are folded over and hold the connector 710 on the T-bar.

Thus, the connector 680 is for use when the joint profile is perpendicular to the T-bar 1 and the connector 710 is used when the joint profile is parallel to the T-bar 1 on the ceiling grid.

Referring now to FIGS. 73*a*, 73*b*, 73*c* and 73*d*, a perimeter connector 730 is shown including hook member 731, back 733 and ledge portion 732. The wall track 610 is screwed directly to the existing ceiling or wall structure, as the case may be, by means of a screw inserted through the channel 613 defined by ribs 612.

The perimeter connector 730 can then be pushed into a perimeter profile 5 with the ledge portion 732 abutting the inner groove of the perimeter profile 5 and then pushed onto the wall track 610 as shown in FIG. 73*c* with the hook member 731 fitting snugly in the channel 613 between the ribs 612, and engaging both the perimeter profile 5 and the channel 613 of the wall track 610.

FIG. 73*c* shows the perspective view when the wall track 610 is screwed to the ceiling with a perimeter connector 730 and perimeter profile 5 attached thereto.

FIG. 73*d* is a perspective view of the wall track 610 when it is screwed to the wall and being used with the perimeter connector 730 and perimeter profile 5.

A portion of the hook member 731 may be snapped off so as to shorten the length of the hook member 731 so that it does not lie on or abut the screw used to affix the wall track 610 to the existing structure (wall or ceiling, as the case may be).

We refer now to FIGS. 74*a* and 74*b* in which are shown a connector 740 including a ridge 742 and wings 741 for holding a wall track 610 onto T-bars having horizontal flanges of dimensions other than those corresponding to the dimensions of wings 51. In a situation where the dimensions of connector 50 do not correspond to the dimensions of the existing grid network, the wall track 610 is attached to the existing grid network by means of the connector 740, the ridge 742 which is inserted in the groove 615 of the wall track 610 and the connector is folded over around the wall track 610 and the wings 741 abut the horizontal sections 11 of the T-bar of the grid network. Once the wall track 610 is secured on the grid network, the connectors 50 may then be attached to the wall track 610 rather than being attached directly to the T-bars of the grid network, as previously described and the panels may then be affixed to the wall track 610 using the connectors 50 in the manner previously described and a ceiling or wall may be constructed using the connectors 50.

The connectors and brackets of the present invention, in accordance with any of the above described embodiments, can be manufactured for any type of material, including, stainless steel, light alloys, light metal and also UPVC plastics and fibre.

The ceiling or wall UPVC panel connector 50 or the perimeter connectors 250, 250', 250", in accordance with any of the above embodiments, can be made from all types of material including stainless steel, light alloys, light metal also UPVC plastics and fibre. The connector can be made to suit all types of main grid networks including circular systems. There are major cost savings on expenses involved in construction. The connector is ideal for fixing all profiles e.g. intermediate or centre joint section, start and end edging profiles, external and internal corner pliable joint section. No batons or screws are needed with the connector therefore there are major cost saving and labour savings. The connector of the present invention can be used to butt joint panels or planks together. The connector is ideal for most types of light fittings. Grid system can be slid through connector to suit recess light fittings. The flange or tongue of a panel is not damaged if something falls from above and comes through ceiling. A panel will slide through the connector in tact. In the prior art systems, the flange tended to tear and could not be refixed therefore a new panel was needed. Repairs to ceilings are faster than old system and can be repaired from overhead where possible by sliding connector into flange of panel or plank along grid network. Old system cannot be repaired from overhead. No drilling or screws are needed for the connector once the grid network is in place. This aspect is extremely convenient for hospitals or business areas where peace and quiet is essential.

The connector of the present invention are particularly useful when it is required to replace a damaged/broken panel. The damaged panel and connector may be removed and replace easily and without need to remove neighbouring panels from the ceiling. The feature is also useful in that is easy to access the area above the ceiling via access panels and/or trap doors.

The multi purpose connectors of the present invention are ideal for fixing most ceiling systems, start and end edging trims e.g. external corners trim, internal corners trim, intermediate or centre joint sections, pliable joint sections and panel or planks to bulkhead grid.

They are also ideal for fixing panels or planks together with grid bars to form trapdoors access doors etc. the connectors fixed to T-bars can allow ceiling to be angled up to 180° degrees.

The connectors of the present invention are ideal for fixing a variety of surface mounted accessories to grid network e.g. exit signs, smoke alarms etc.

The connectors are ideal for fixing some surface mounted light fittings while the trim connectors are ideal to butt join panels or planks together. The connectors can be used to hang a variety of signs from the ceiling grid. Using the multi-purpose connectors of the present invention, it is possible to fix both the tongue and groove sides of panels and planks to a grid.

Use of the multipurpose connectors of the present invention allows damaged panels or planks to be removed from walls or ceiling by sliding transversely along the tongue member of the connector.

It is possible to repair damaged or sagging ceiling panels from above the ceiling, by sliding new connectors along T-bar flanges. To do this, an operator climbs above the ceiling via an access panel or trap-door. Another operator pushes up the damaged panels from underneath, the old connector(s) is/are removed and new ones inserted in the groove 2 of the panel 4. The connectors are ideal for fixing around ducting, air conditioning and recess light fittings. A T-bar can be slid together with connectors attached through grooves of panels to accommodate a variety of light fitting sizes.

The connectors of the present invention are particularly suited for use with unplasticised polyvinyl chloride (UPVC) panels.

The connectors in all of the above embodiments have the advantage that when used in a ceiling or wall system, each connector allows for expansion and contraction of the panels due to temperature fluctuations in the room. This is possible since a limited amount of sliding movement of the connectors along a T-bar or wall track, is allowed.

It will of course be understood that the invention is not limited to the specific details described herein, which are given by way of example only, and that various modifications and alterations are possible within the scope of the invention as defined in the appended claims.

We claim:

1. A connector assembly for securing panels for use in the construction of suspended ceilings, walls, partition walls and the like comprising:

a support element having a profile including a central member from which a pair of flanges extend outwardly therefrom; and a first connector (50) for securing a panel (4) to the support element, the first connector comprising a first body, a first panel connecting element (52,54) and a first wing member (51) formed of plastically deformable material, the first wing member (51) being movable between an open position and an engaged position in which the first wing member is folded over onto the support element (1,610) thereby holding the panel (4) in position on the support element (1,610) characterized in that the first panel connecting element (52,54) is formed of a plastically deformable material enabling the panel connecting element (52,54) to be bent so that it may be arranged out of the plane of the first body (57) of the first connector (50).

2. A connector assembly as defined in claim 1 wherein the first wing of the first connector includes a kink formed therein, thereby enabling the connector to be held on the support element when the first wing member is in the open position.

3. A connector assembly as defined in claim 2 wherein the first connector is substantially T-shaped with the panel connecting element corresponding to a horizontal element of the "T" and the first body corresponding to a vertical element of the "T", the first body having opposed sides and the first wing member disposed at one side and a second wing member disposed at the other side.

4. A connector assembly as defined in claim 1, further including a second connector (200,250) for securing a channeled profile to the support element, the second connector comprising a second body, a profile-connecting element and a second wing member (201) of plastically deformable material, characterized in that the second wing member (201) is formed in the closed position and the second wing member is adapted to hold the channeled profile positioned on the support element (1) and further characterized in that the second wing member (201) is folded over in a plane parallel to a principal axis of the second body (733) of the second connector and the profile-connecting element is substantially perpendicular to the principal axis of the second body (733) and further characterized in that the length of the profile-connecting element (202) is shorter than the length of the second body (733).

5. An assembly as claimed in initial cap claim in all cases claim 4, wherein the second connector (250) includes a detent formed in the second body, the detent engaging a groove formed in the support element where the second connector (250) is in use, thereby securing the second connector on the support element.

6. A connector assembly as defined in claim 1, further including

A second connector (100) for attaching the panel to the support element, the second connector having a flat second body having a second panel connecting element of generally "L-shaped" configuration (102) projecting along a front edge of the flat second body and at lease one second wing member (101) provided along a side of the second body, perpendicular to the panel connecting element, the second wing member being of a generally "S-shaped" configuration to hold the second connector on the support element.

7. A connector assembly according to claim 6 further including a third connector (200,250), the third connector (200,250) comprising a third body, a profile-connecting element (202) and a third wing member (201) of plastically deformable material, characterized in that the third wing member (201 )is formed in the engaged position to hold the profile (5) in position on the support element (1) and further characterized in that the third wing member (201) is folded over in a plane parallel to the principal axis of the third body (733) of the third connector and the profile-connecting element is substantially perpendicular to the principal axis of the third body (733) and further characterized in that a length of the profile-connecting element (202) is shorter than a length of the third body (733).

8. An assembly according to claim 7 wherein the third connector (250) includes a detent formed in the third body of the third connector, the detent engaging a groove formed in the support element when the third connector (250) is in use, thereby securing the third connector on the support element.

9. A connector assembly as defined in claim 1, further including a second connector (460) comprising second body, a flat second body having a second panel connecting element (466) and at least one second wing member (461) of plastically deformable material, the second wing member (461) being moveable between an open position and an engaged position in which the second wing member is folded over onto the support element thereby holding the panel in position on the support element, and wherein the second panel connecting element has a step-type profile in which the second panel connecting element includes a top portion co-planar with the second body of the second connector and a bottom portion parallel to the top portion, the top and bottom portions being joined at their edges remote from the second body of the second connector, by a step comprising a first member perpendicular to the top portion, an intermediate member perpendicular to the first member and third member perpendicular to the intermediate member, the bottom portion pointing in a direction towards the second body of the second connector.

10. A connector assembly according to claim 9, further including a third connector (200,250) comprising a third body, a profile-connecting element (202) and a third wing member (201) of plastically deformable material, characterized in that the wing member (201) is formed in the engaged position to hold a channeled profile (5) in position on the support element (1) and further characterized in that the third wing member (201) is folded over in a plane parallel to a principal axis of the third body (733) of the third connector and the profile-connecting element is substantially perpendicular to the principal axis of the third body (733) and further characterized in that a length of the profile-connecting element (202) is shorter than a length of the third body (733).

11. A connector assembly as defined in claim 10 wherein the third connector (250) includes a detent formed in the third body of the third connector, the detent engaging a groove formed in the support element when the third connector (250) is in use, thereby securing the third connector on the support element.

12. A connector assembly as defined in claim 1, further including a second connector (140) comprising a flat second body having a second panel-connecting element (142) and at least one second wing member (141) of plastically deformable material, the second wing member (141) being moveable between an open position and an engaged position in which the second wing member is folded over onto the support element thereby holding the panel in position on the support element, and wherein the second panel connecting element (142) includes a first portion arranged perpendicularly to the second body of the second connector and a second portion and a third portion attached to the first portion with the second and third portions being arranged parallel to the plane of the second body of the second connector, the second portion pointing away from the second body of the second connector and the third portion pointing in a direction towards the second body of the second connector.

13. A connector assembly as defined in claim 12 further including a second connector (200,250) comprising a second body, a profile-connecting element and a second wing member (201) of plastically deformable material, characterized in that the second wing member (201) is formed in the engaged position to hold a channeled profile positioned on the support element (1) and further characterized in that the second wing member (201) is folded over in a plane parallel to the principal axis of the second body (733) of the second connector and the profile-connecting element is substantially perpendicular to the principal axis of the second body (733) and further characterized in that the length of the profile-connecting element (202) is shorter than the length of the second body (733).

14. A connector assembly as defined in claim 13 wherein the third connector (250) includes a detent formed in the third body of the third connector, the detent engaging a groove formed in the support element when the third connector (250) is in use, thereby securing the third connector on the support element.

15. A connector assembly as defined in claim 1, further including a second connector (410) having a tongue member engageable with a second support element having a C-channel profile, and at least one second wing member (412) included on a first portion of the second connector and the tongue member is included on a second portion of the second connector, the first and second portions being moveable with respect to each other.

16. An assembly as defined in claim 15, further including a third connector (200,250) connector (200,250) comprising a third body, a profile-connecting element (202) and a third wing member (201) of plastically deformable material, characterized in that the third wing member (201) is formed in the engaged position and the third wing member (201) holding the profile (5) in position on the support element (1) and further characterized in that the third wing member (201) is folded over in a plane parallel to the principal axis of the third body (733) of the third connector and the profile-connecting element is substantially perpendicular to the principal axis of the third body (733) and further characterized in that length of the profile-connecting element (202) is shorter than the length of the third body (733) so that it fits into space defined by walls of the profile into which the profile-connecting element is inserted.

17. An assembly according to claim 16 wherein the connector (250) includes a detent formed in the body of the third connector, the detent engaging a groove formed in a support element when the connector (250) is in use, thereby securing the connector on the support element.

18. A connector assembly as defined in claim 1, further including a second connector (380) for supporting a length of panel, the second connector (380) having a second body panel supporting element defined by an orifice in the second body and a second wing member which is formed in the engaged position prior to engagement with the support element, the length of panel being locatable in the orifice in a direction which is generally transverse to a longitudinal axis of the second connector.

19. A connector assembly as defined in claim 1, further including a second connector (560,570) for securing a smoke alarm device to the support element (1,610), the second connector (560,570) comprising a flat second body portion provided with means (564,16, 571) for securing the second connector (560,570) the support element (1,610) and a hook member (563,573) insertable in an aperture in a base of the smoke alarm device so that the hook member (563,573) is engaged in the aperture thereby holding the smoke alarm device securely on the support element (1,610).

20. A connector assembly as defined in claim 1, further including a second connector (580) connecting a structural member having a generally H-shaped cross-section to the support member (1,610), the second connector (580) including a main body portion having side walls (582) extending upwardly along two sides of the main body portion, each of the side walls (582) being provided with a second wing (581) which is formed in a closed position prior to engagement with the support member (1,610), such that in use, flanges of the support member (1,610) are inserted between each of the closed second wings (581) and the flanges are gripped by the closed second wings (581).

21. A connector assembly according to claim 1 further including a second connector (590) connecting structural members having a generally H-shaped cross section together for construction of partition walls, the second connector (590) having a generally L-shaped profile comprising two generally planar second body elements (593,594) provided at right angles to each other, each of the two second body elements (593,594) having side walls (595) which are tapered in a manner corresponding to tapering of the structural members of generally H-shaped cross section, so that, in use, one second body element (594) is inserted into one side of a first structural member with the other second body element (593) projecting from the first structural member and inserted in a second similarly profiled second structural member.

22. A connector assembly according to claim 21 wherein the first and second structural members each have a generally H-shaped cross-section having side walls which taper gradually inwardly.

23. An assembly of connectors for securing panels to a support element for use in the construction of suspended ceilings, walls, partition walls and the like comprising:

a support element having flanges extending therefrom;

a first connector (50) securing a panel (4) to the support element (1,610), the first connector comprising a panel-connecting element (52,54) and at least one first wing member (51) of plastically deformable material, the first wing member (51) being movable between an open position and an engaged position in which the first wing member is folded over onto the support element (1,610) thereby holding the panel (4) in position on the support element (1,610) characterized in that the panel connecting element (52,54) is formed of a plastically deformable material enabling the panel-connecting element (52,54) to be bent so that it is arranged out of the plane of the body (57) of the connector (50);

a first structural member having a generally H-shaped cross-section having side walls which taper gradually inwardly;

a second connector (580) connecting the first structural member to the support element (1,610), the second connector (580) including a main second body portion having side walls (582) extending upwardly along two sides of the main second body portion, each of the side walls (582) being provided with a second wing (581) which is formed in a closed position prior to engagement with the support element (1,610), such that in use, the flanges of the support element (1,610) are inserted between each of the closed wings (581) and the flanges are gripped by the closed wings (581); and a third connector (590) connecting the first structural member to a second similarly formed structural member together for construction of partition walls, the third connector (590) having a generally L-shaped profile comprising two generally planar third body elements (593,594) provided at right angles to each other, each of the third body elements (593,594) having side walls (595) which are tapered in a manner corresponding to tapering of the structural members of generally H-shaped cross section, so that, in use, one body element (594) can be inserted into one side of the first structural member with the other body element (593) projecting from the first structural member and inserted in the second similarly profiled structural member.

* * * * *